US007223153B2

(12) United States Patent
Jeong

(10) Patent No.: US 7,223,153 B2
(45) Date of Patent: May 29, 2007

(54) APPARATUS AND METHOD FOR POLISHING SEMICONDUCTOR WAFERS USING ONE OR MORE POLISHING SURFACES

(75) Inventor: In Kwon Jeong, Cupertino, CA (US)

(73) Assignee: Inopla Inc., San Jose, CA (US)

( * ) Notice: Subject to any disclaimer, the term of this patent is extended or adjusted under 35 U.S.C. 154(b) by 0 days.

(21) Appl. No.: 10/829,593

(22) Filed: Apr. 21, 2004

(65) Prior Publication Data

US 2004/0209550 A1 Oct. 21, 2004

Related U.S. Application Data

(60) Provisional application No. 60/541,432, filed on Feb. 3, 2004, provisional application No. 60/516,891, filed on Nov. 3, 2003, provisional application No. 60/477,480, filed on Jun. 10, 2003, provisional application No. 60/475,292, filed on Jun. 2, 2003, provisional application No. 60/472,581, filed on May 22, 2003, provisional application No. 60/470,933, filed on May 15, 2003, provisional application No. 60/469,691, filed on May 12, 2003, provisional application No. 60/464,290, filed on Apr. 21, 2003.

(51) Int. Cl.
*B24B 49/00* (2006.01)
*B24B 7/00* (2006.01)

(52) U.S. Cl. ..... 451/11; 450/287; 450/289

(58) Field of Classification Search ..... 451/285–289, 451/388, 5, 8, 11
See application file for complete search history.

(56) References Cited

U.S. PATENT DOCUMENTS 3,707,944 A * 1/1973 Grundon et al. ..... 118/50
5,498,199 A * 3/1996 Karlsrud et al. ..... 451/289
5,549,502 A 8/1996 Tanaka et al.
5,605,487 A 2/1997 Hileman et al.
5,618,227 A 4/1997 Tsutsumi et al.
5,908,347 A * 6/1999 Nakajima et al. ..... 451/5
6,048,259 A 4/2000 Asai
6,050,885 A 4/2000 Morsch et al.
6,095,908 A * 8/2000 Torii ..... 451/285
6,227,950 B1 * 5/2001 Hempel et al. ..... 451/66
6,309,279 B1 10/2001 Bowman et al.
6,346,038 B1 * 2/2002 Kajiwara et al. ..... 451/339
6,406,359 B1 * 6/2002 Birang et al. ..... 451/67

(Continued)

FOREIGN PATENT DOCUMENTS

JP 2003-0067391 8/2003

*Primary Examiner*—M. Rachuba
(74) *Attorney, Agent, or Firm*—Thomas H. Ham; Wilson & Ham

(57) ABSTRACT

An apparatus and method for polishing objects, such as semiconductor wafers, utilizes one or more polishing surfaces, multiple wafer carriers and at least one load-and-unload cup. The load-and-unload cup may be configured to move to and from the wafer carriers in a pivoting manner. The load-and-unload cup may be configured to move to and from the wafer carriers in a linear reciprocating manner. The wafer carriers may be configured to move to and from the load-and-unload cup in a pivoting manner. The wafer carriers may be configured to move to and from the load-and-unload cup in a linear reciprocating manner.

20 Claims, 45 Drawing Sheets

U.S. PATENT DOCUMENTS 6,435,941 B1 * 8/2002 White ..... 451/5
6,447,370 B1 * 9/2002 Weldon ..... 451/6
6,562,184 B2 5/2003 Sommer
6,575,816 B2 * 6/2003 Hempel et al. ..... 451/41
6,575,818 B2 6/2003 Jeong
6,656,028 B2 * 12/2003 Chokshi et al. ..... 451/339
6,780,083 B2 8/2004 Ising et al.
2002/0137448 A1 9/2002 Suh et al.
2002/0177386 A1 11/2002 Smith
2003/0209320 A1 * 11/2003 Sommer ..... 156/345.12
2003/0217811 A1 11/2003 Jeong
2004/0009738 A1 1/2004 Doi et al.

* cited by examiner

APPARATUS AND METHOD FOR POLISHING SEMICONDUCTOR WAFERS USING ONE OR MORE POLISHING SURFACES

CROSS REFERENCE TO RELATED APPLICATION

This application is entitled to the benefit of U.S. Provisional Patent Application Ser. No. 60/464,290 filed on Apr. 21, 2003, 60/469,691 filed on May 12, 2003, 60/470,933 filed on May 15, 2003, 60/472,581 filed on May 22, 2003, 60/475,292 filed on Jun. 2, 2003, 60/477,480 filed on Jun. 10, 2003, 60/516,891 filed on Nov. 3, 2003, and 60/541,432 filed on Feb. 3, 2004, which are all incorporated herein by reference.

FIELD OF THE INVENTION

The invention relates generally to semiconductor processing equipments, and more particularly to an apparatus and method for polishing semiconductor wafers.

BACKGROUND OF THE INVENTION

Local and global planarization of semiconductor wafers becomes increasingly important as more metal layers and interlayer dielectric layers are stacked on the wafers. A preferred method to planarize semiconductor wafers is the chemical mechanical polishing (CMP) method, where a surface of a semiconductor wafer is polished using a slurry solution supplied between the wafer and a polishing pad. The CMP method is also widely used for damascene process to form copper structures on the semiconductor wafers.

In general, a CMP equipment includes a polishing table where a polishing pad is placed and a wafer carrier that supports a semiconductor wafer and presses the wafer against the polishing pad. One of the most important performances of a CMP equipment is productivity. For higher productivity, a CMP equipment typically requires more polishing tables and more wafer carriers. As the number of polishing tables and wafer carriers included in a CMP equipment is increased, the arrangement of the polishing tables and the wafer carriers becomes important to efficiently polish multiple semiconductor wafers. Furthermore, the manner in which the semiconductor wafers are transferred to and from the wafer carrier becomes important as well. However, the footprint of a CMP equipment must also be considered since a CMP equipment with a large footprint requires a larger clean room to house the equipment, which translates into greater cost of operation.

In view of these issues, what is needed is an apparatus and method for polishing semiconductor wafer using multiple polishing tables with high productivity that require small footprint.

SUMMARY OF THE INVENTION

An apparatus and method for polishing objects, such as semiconductor wafers, utilizes one or more polishing surfaces, multiple wafer carriers and at least one load-and-unload cup. The load-and-unload cup may be configured to move to and from the wafer carriers in a pivoting manner. The load-and-unload cup may be configured to move to and from the wafer carriers in a linear reciprocating manner. The wafer carriers may be configured to move to and from the load-and-unload cup in a pivoting manner. The wafer carriers may be configured to move to and from the load-and-unload cup in a linear reciprocating manner.

An apparatus for polishing objects in accordance with an embodiment of the invention comprises a first object carrier positioned over a first polishing surface, a second object carrier positioned over a second polishing surface, a first object relay device positioned between the first and second object carriers, and a second object relay device positioned adjacent to one of the first and second object carriers. The first object relay device includes a first load-and-unload cup and a first pivoting drive mechanism. The first pivoting drive mechanism is configured to pivot the first load-and-unload cup to and from the first and second object carriers about a first pivoting axis to transfer the objects from the first object carrier to the second object carrier. The second object relay device includes a second load-and-unload cup and a second pivoting drive mechanism. The second pivoting mechanism is configured to pivot the second load-and-unload cup to and from one of the first and second object carriers about a second pivoting axis to transfer the objects to the first object carrier or from the second object carrier.

A method for polishing objects in accordance with an embodiment of the invention comprises transferring an object to a first object carrier positioned over a first polishing surface, polishing the object on the first polishing surface using the first object carrier, transferring the object from the first object carrier to a second object carrier positioned over a second polishing surface using a first load-and-unload cup, polishing the object on the second polishing surface using the second object carrier, and transferring the object to a second load-and-unload cup positioned adjacent to one of the first and second object carriers to load the object onto the first object carrier or unload the object from the second object carrier. The transferring of the object from the first object carrier to the second object carrier includes pivoting the load-and-unload cup about a pivoting axis.

An apparatus for polishing objects in accordance with another embodiment of the invention comprises a plurality of object carriers positioned over a plurality of polishing surfaces, and a plurality of object relay devices positioned between the object carriers such that at least one object relay device is positioned between two adjacent object carriers. Each object relay device includes a load-and-unload cup and a pivoting drive mechanism. The pivoting drive mechanism is configured to pivot the load-and-unload cup to and from the two adjacent object carriers about a pivoting axis to transfer the objects between the two adjacent object carriers.

A method for polishing objects in accordance with another embodiment of the invention comprises sequentially transferring an object to a plurality of object carriers positioned over a plurality of polishing surfaces using a plurality of load-and-unload cups, and sequentially polishing the object on the polishing surfaces using the object carriers. The sequentially transferring includes pivoting each of the load-and-unload cups about a pivoting axis to transfer the object between two adjacent object carriers of the object carriers.

An apparatus for polishing objects in accordance with another embodiment of the invention comprises a first object carrier positioned over a first polishing surface, a second object carrier positioned over a second polishing surface, an object relay device positioned between the first and second object carriers, and a linear drive mechanism operatively connected to the object relay device. The object relay device includes a load-and-unload cup. The linear drive mechanism is configured to displace the load-and-unload cup of the object relay device in a substantially linear reciprocating manner to and from the first and second object carriers to transfer the objects from the first object carrier to the second object carrier.

A method for polishing objects in accordance with another embodiment of the invention comprises transferring an object to a first object carrier positioned over a first polishing surface, polishing the object on the first polishing surface using the first object carrier, transferring the object from the first object carrier to a second object carrier positioned over a second polishing surface using a load-and-unload cup, and polishing the object on the second polishing surface using the second object carrier. The transferring of the object from the first object carrier includes linearly displacing the load-and-unload cup from the first object carrier to the second object carrier.

An apparatus for polishing objects in accordance with another embodiment of the invention comprises an object polishing station having an input region to receive the objects and an output region to output the objects, and at least one object transport device to transfer the objects to the input region of the object polishing station and to transfer the objects from the output region of the object polishing station. The object polishing station includes a plurality of polishing surfaces, an object transfer station positioned between two adjacent polishing surfaces of the polishing surfaces, a plurality of object carriers, and at least one drive mechanism operatively connected to at least one of the object carriers, wherein each of the objects is transferred from the input region to the output region by way of the polishing surfaces of the object polishing station such that each of the objects is polished on the polishing surfaces. Each object carrier is configured to secure one of the objects. The drive mechanism is configured to displace at least one of the object carriers to and from the object transfer station and one of the two adjacent polishing surfaces.

A method for polishing objects in accordance with another embodiment of the invention comprises receiving an object at an input region of an object polishing station, sequentially transferring the object to a plurality of polishing surfaces of the object polishing station using a plurality of object carriers of the object polishing station, sequentially polishing the object on the polishing surfaces using the object carriers, transferring the object to an object transfer station of the object polishing station from a first adjacent polishing surface of the polishing surfaces using a first object carrier of the object carriers, transferring the object from the object transfer station to a second adjacent polishing surface of the polishing surfaces using a second object carrier of the object carriers, and outputting the object from an output region of the object polishing station after the object has been polished on the polishing surfaces.

An apparatus for polishing objects in accordance with another embodiment of the invention comprises a first object transport device, a second object transport device, and an object polishing unit positioned between the first and second object transport devices. The object polishing unit comprises at least one polishing surface, first and second object carriers positioned over the polishing surface to polish the objects on the polishing surface. Each object is transferred from the first object transport device to the second object transport device by way of one of the first and second object carriers.

A method for polishing objects in accordance with another embodiment of the invention comprises transferring first and second objects to a first end of an object polishing unit using a first object transport device, polishing the first object on at least one polishing surface of the object polishing unit using a first object carrier of the object polishing unit, polishing the second object on at least one polishing surface using a second object carrier of the object polishing unit, and transferring the first and second object from a second end of the object polishing unit using a second object transport device. The first and second ends are located on opposite ends of the object polishing unit.

An object relay device for loading and unloading an object in accordance with an embodiment of the invention comprises a load-and-unload cup, an arm operatively connected to the load-and-unload cup to laterally move the load-and-unload cup, and a cup ascending-and-descending mechanism operatively connected to the load-and-unload cup and the arm. The cup ascending-and-descending mechanism is configured to raise and lower the load-and-unload cup with respect to the arm.

Other aspects and advantages of the present invention will become apparent from the following detailed description, taken in conjunction with the accompanying drawings, illustrated by way of example of the principles of the invention.

DETAILED DESCRIPTION

Figure 1:
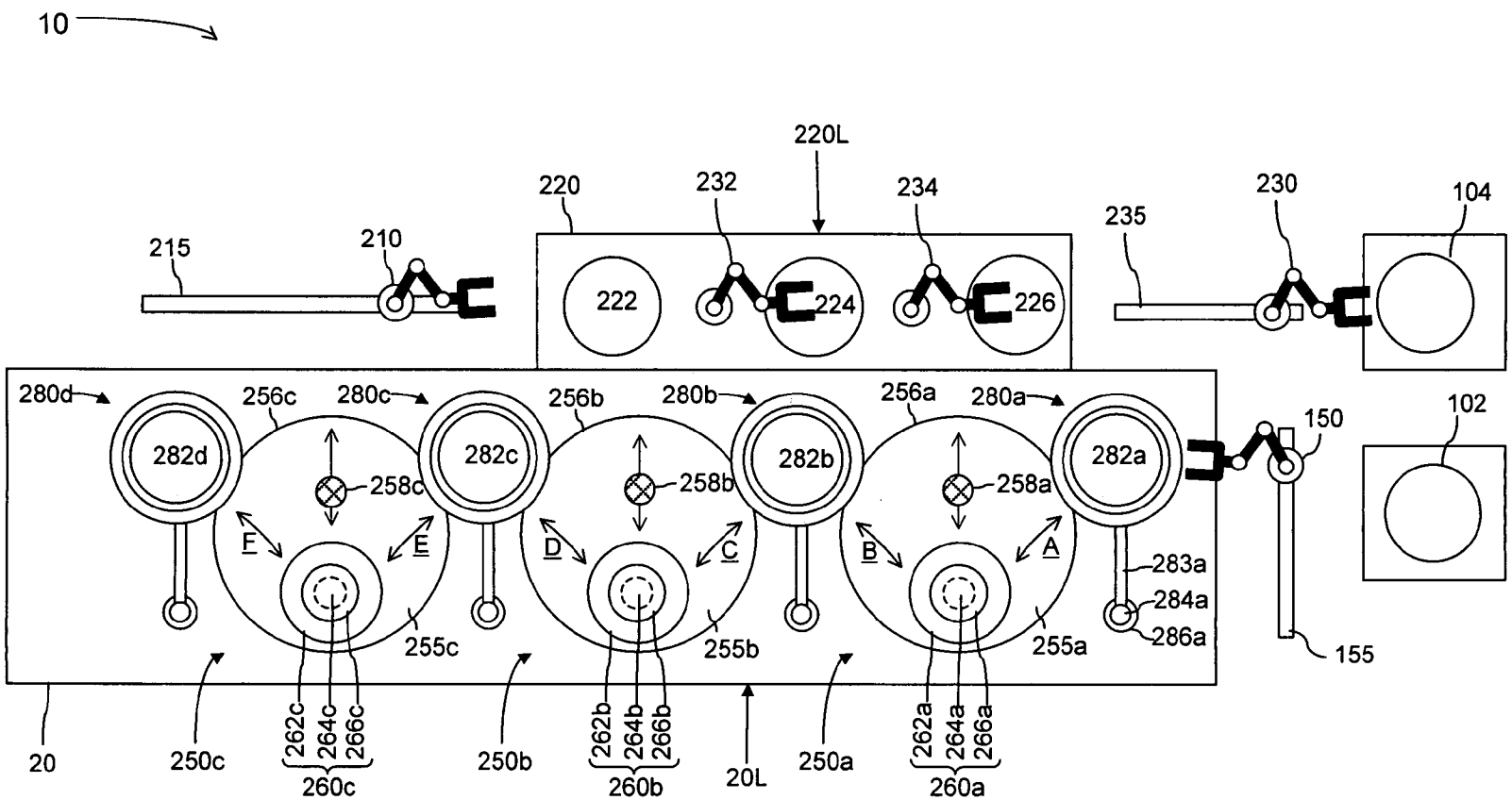
FIG. 1 is a top view of a polishing apparatus in accordance with an embodiment of the present invention.

With reference to FIG. 1, a polishing apparatus 10 in accordance with an embodiment of the present invention is described. FIG. 1 is a top view of the polishing apparatus 10. The polishing apparatus 10 comprises a polishing station 20, a wafer input station 102, a wafer output station 104, a first wafer transport device 150, a second wafer transport device 210, a third wafer transport device 230, and a wafer cleaner 220. The polishing station 20 comprises a first polishing unit 250*a*, a second polishing unit 250*b*, a third polishing unit 250*c*, a first wafer relay device 280*a*, a second wafer relay device 280*b*, a third wafer relay device 280*c*, and a fourth wafer relay device 280*d*.

The wafer input station 102 accommodates semiconductor wafers or other comparable objects to be polished by the polishing station 20. The wafer output station 104 accommodates semiconductor wafers or other comparable objects that have been polished and cleaned by the polishing station 20 and the wafer cleaner 220, respectively. The wafer input station 102 and the output station 104 may be configured to comprise multiple slots to accommodate multiple wafers. The polishing apparatus 10 can be configured to comprise the wafer input station 102 without the wafer output station 104. In such a configuration, wafers to be polished and polished wafers are accommodated together in the wafer input station 102.

The first wafer transport device 150 is configured to transfer wafers from the wafer input station 102 to the polishing station 20. More specifically, the first wafer transport device 150 is configured to transfer wafers from the wafer input station 102 to the first wafer relay device 280*a* of the polishing station 20, as described in more detail below. The second wafer transport device 210 is configured to transfer wafers from the polishing station 20 to the wafer cleaner 220. More specifically, the second wafer transport device 210 is configured to transfer wafers from the fourth wafer relay device 280*d* of the polishing station 20 to the wafer cleaner 220, as described in more detail below. The third wafer transport device 230 is configured to transfer wafers from the wafer cleaner 220 to the wafer output station 104 or to the wafer input station 102, as described in more detail below.

The first, second and third wafer transport devices 150, 210 and 230 may be situated on respective linear tracks 155, 215 and 235 such that the wafer transport devices can be moved in a linear manner on the linear tracks by respective linear drive mechanisms (not shown). As an example, the first, second and third wafer transport devices 150, 210 and 230 may comprise a robotic arm to handle a wafer for transfer. The first, second and third wafer transport devices 150, 210 and 230 may alternatively be configured to comprise dual robotic arms such that the devices can handle two wafers at a time. The first and second wafer transport devices 150 and 210 may also be configured to turn over wafers before transferring the wafers to the polishing station 20 and to the wafer cleaner 220, respectively.

The four wafer relay devices 280*a*–280*d* and the three polishing units 250*a*–250*c* are arranged in such a manner that the first polishing unit 250*a* is positioned between the first and second wafer relay devices 280*a* and 280*b*, the second polishing unit 250*b* is positioned between the second and third wafer relay devices 280*b* and 280*c*, and the third polishing unit 250*c* is positioned between the third and fourth wafer relay device 280*c* and 280*d*.

Preferably the polishing units 250 are arranged in a linear manner to minimize the width of the polishing station 20, as illustrated in FIG. 1. The polishing units 250 may be arranged so that the distances between two neighboring polishing units 250 are same, as illustrated in FIG. 1. The wafer relay devices 280 are also arranged in a linear manner to minimize the width of the polishing station 20, as illustrated in FIG. 1. More specifically, the wafer relay devices 280 are linearly arranged such that load-and-unload cups 282 of the wafer relay devices 280 are positioned in a linear manner when the load-and-unload cups are parked at their respective parking positions, as illustrated in FIG. 1. The wafer relay devices 280 may be linearly arranged so that the distances between two neighboring load-and-unload 282 are equivalent, as illustrated in FIG. 1. When the load-and unload cups 282 are parked at their respective parking positions, some portion of the load-and-unload cups 282 may be positioned over their neighboring polishing tables 256, as illustrated in FIG. 1.

In order to minimize the width of the polishing apparatus 10, the wafer cleaner 220 is preferably positioned such that its longer side 220L is facing the longer side 20L of the polishing station 20, as illustrated in FIG. 1. The area of the polishing station 20 is an area roughly defined by the polishing tables 256*a*, 256*b* and 256*c* of the polishing station 20.

The wafer relay devices 280 transfer wafers between wafer carriers 262*a*–262*c* of the polishing units 250*a*–250*c*, respectively, by pivoting motions A, B, C, D, E, and F, as illustrated in FIG. 1, in the following manner. First, a load-and-unload cup 282*a* of the first wafer relay device 280*a* receives a wafer from the first wafer transport device 150 and then transfers it to the wafer carrier 262*a* of the first polishing unit 250*a* by the pivoting motion A. Next, a load-and-unload cup 282*b* of the second wafer relay device 280*b* transfers the wafer from the wafer carrier 262*a* of the first polishing unit 250*a* to the wafer carrier 262*b* of the second polishing unit 250*b* by the pivoting motions B and C. Next, a load-and-unload cup 282*c* of the third wafer relay device 280*c* transfers the wafer from the wafer carrier 262*b* of the second polishing unit 250*b* to the wafer carrier 262*c* of the third polishing unit 250*c* by the pivoting motions D and E. Next, a load-and-unload cup 282*d* of the fourth wafer relay device 280*d* transfers the wafer from the wafer carrier 262*c* of the third polishing unit 250*c* by the pivoting motion F. The second wafer transport relay device 210 then removes the wafer from the load-and-unload cup 282*d* of the fourth wafer relay device 280*d*, and transfers the wafer to the wafer cleaner 220.

Figure 2:
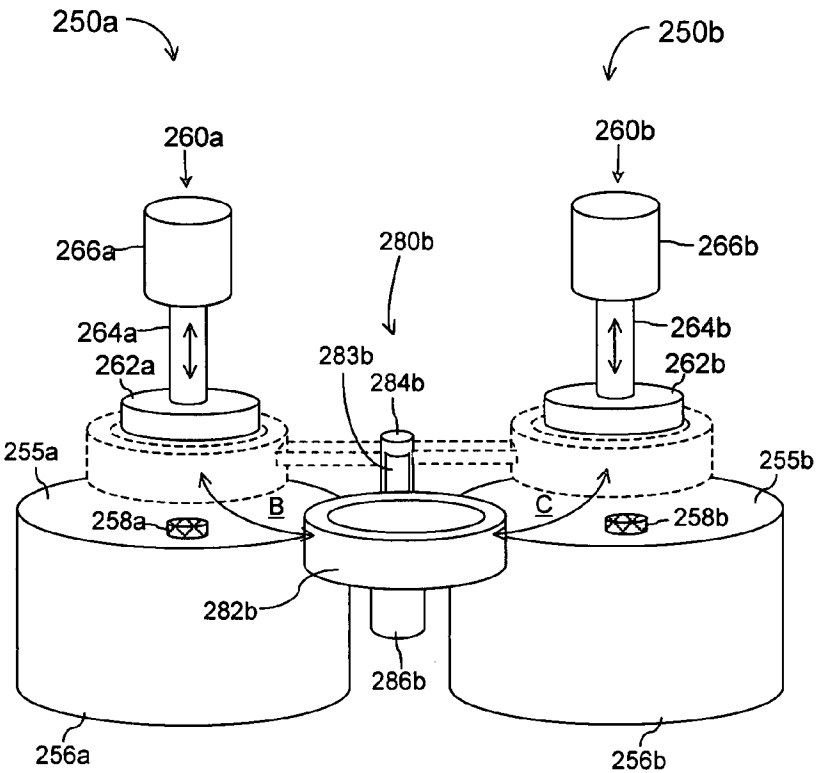
FIG. 2 is a perspective view of polishing units and a wafer relay device used in the polishing apparatus of FIG. 1.

With reference to FIG. 2, the polishing units 250 and the wafer relay devices 280 of the polishing station 20 are further described using the polishing units 250*a* and 250*b* and the wafer relay device 280*b* as examples. FIG. 2 is a perspective view of the second wafer relay device 280*b*, the first polishing unit 250*a* and the second polishing unit 250*b* of the polishing station 20. Each polishing unit 250 comprises the polishing table 256 and a wafer carrier assembly 260. The polishing table 256 can be rotated or orbited about an axis. The polishing pad 255 may be attached onto the polishing table 256 for chemical and mechanical polishing process of semiconductor wafers. One or more slurries containing abrasive particles and/or chemicals such as KOH are used with the polishing pad 255 to polish semiconductor wafers. Each polishing unit 250 may further comprises a pad conditioner 258 to condition the surface of the polishing pad 255 during the polishing process to refresh the surface of the polishing pad 255 for proper polishing. Although the polishing of wafers are described herein as being polished on one or more polishing pad surfaces, the wafers may be polished on any polishing surface such as a polishing surface of a polishing table.

Each wafer carrier assembly 260 comprises a wafer carrier 262, a carrier shaft 264 and a rotating-and-vertical drive mechanism 266. The wafer carrier 262 is designed to hold a semiconductor wafer such that the surface of the wafer to be polished is faced toward the polishing pad 255. The wafer carrier 262 is connected to the rotating-and-vertical drive mechanism 266 through the carrier shaft 264. The rotating-and-vertical drive mechanism 266, as well as the rotating-and-vertical drive mechanisms 266 of other wafer carrier assemblies 260, is mounted to a top housing structure (not shown) of the polishing station 20. The rotating-and-vertical drive mechanism 266 controls the rotational and vertical motions of the wafer carrier 262 through the connected carrier shaft 264. Thus, the rotating-and vertical drive mechanism 266 is configured to rotate the wafer carrier 262 by rotating the connected carrier shaft 264 and to vertically move the wafer carrier 262 by vertically moving the connected carrier shaft 264. The positions of the wafer carriers 262 illustrated in FIG. 2 are their wafer load-and-unload positions over the respective polishing tables 256. In order to polish semiconductor wafers, the wafer carriers 262 are moved down to the polishing positions on the respective polishing pads 255 from their wafer load-and-unload positions by the respective rotating-and-vertical mechanisms 266 to press the wafers held by the wafer carriers 262 onto the respective polishing pads 255.

Each wafer relay device 280 comprises a load-and-unload cup 282, a pivoting arm 283, a pivoting shaft 284 and a pivoting-and-vertical drive mechanism 286. The load-and-unload cup 282 is connected to the pivoting shaft 284 by the pivoting arm 283. The pivoting shaft 284 is connected to the pivoting-and-vertical drive mechanism 286. The pivoting-and-vertical drive mechanism 286 controls pivoting and vertical motions of the load-and-unload cup 282 through the pivoting shaft 284 and the pivoting arm 283. Thus, the pivoting-and-vertical drive mechanism 286 is configured to pivot the load-and-unload cup 282 through the connected pivoting shaft 284 about a pivoting axis at the pivoting shaft and to vertically move the load-and-unload cup 282 through the connected pivoting shaft.

The load-and-unload cup 282*b* of the wafer relay device 280*b* illustrated in FIG. 2 is positioned at a parking position between the two polishing units 250*a* and 250*b*. The load-and-unload cup 282*b* of the wafer relay device 280*b* can be pivoted to the wafer load-and-unload positions of the two wafer carriers 262*a* and 262*b* by the respective pivoting motions, B and C. The phantom lined wafer relay devices of FIG. 2 show that the load-and-unload cup 282*b* can be positioned at the respective wafer load-and-unload positions below the respective wafer carriers 262*a* and 262*b*.

Figure 3A:
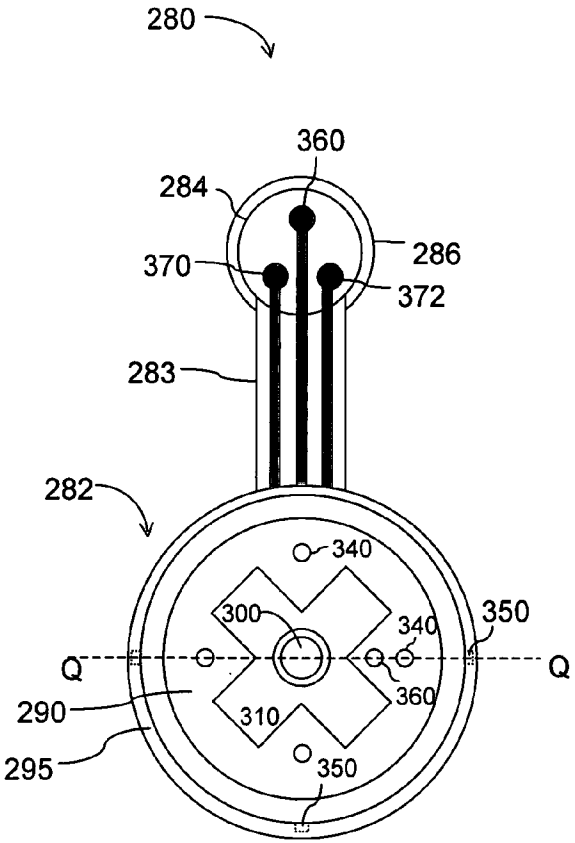
FIGS. 3(*a*) and (*b*) are top and cross-sectional views, respectively, of a wafer relay device used in the polishing apparatus of FIG. 1.
Figure 3B:
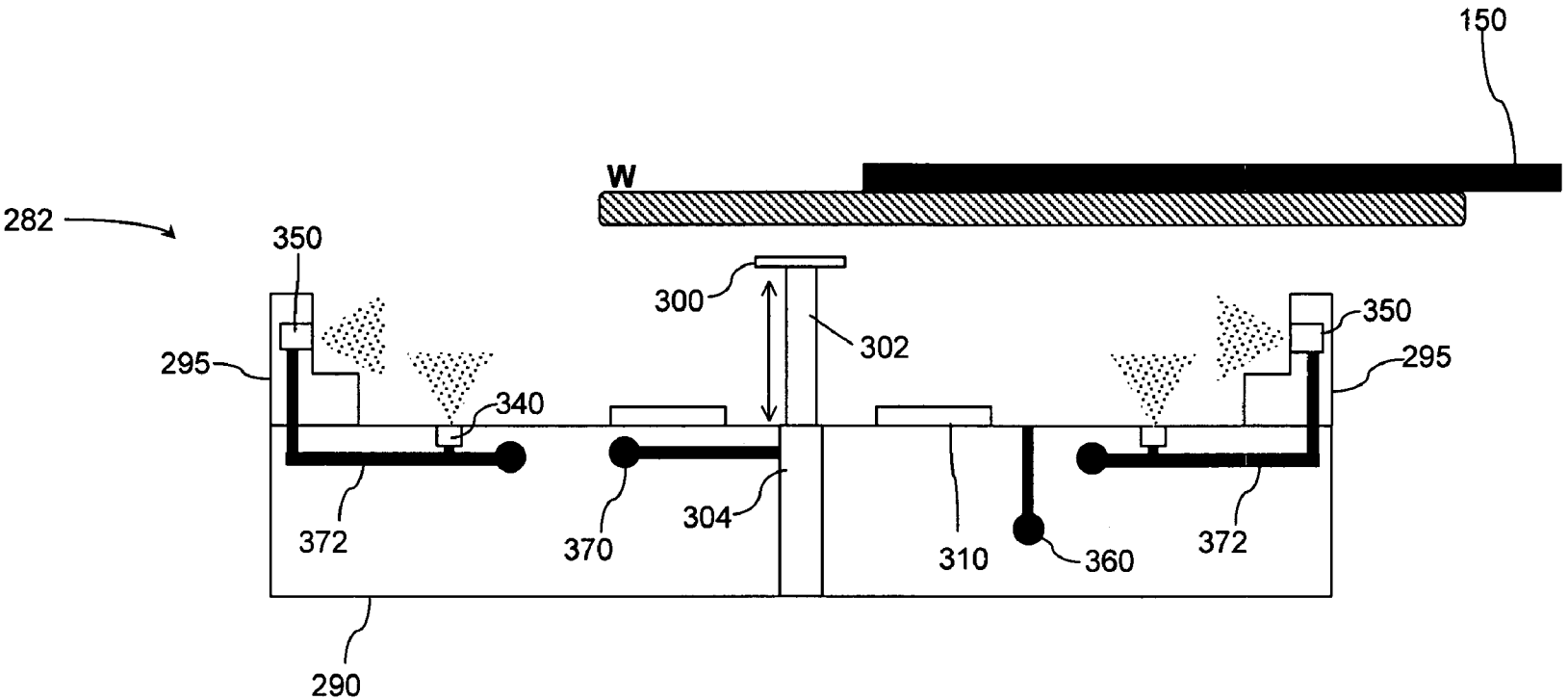

With reference to FIGS. 3(*a*) and 3(*b*), the wafer relay devices 280 of the polishing station 20 is described using a generic wafer relay device, which can be the wafer relay device 280*b* or the wafer relay device 280*a*, 280*c* or 280*d*. FIG. 3(*a*) is a top view of the wafer relay device 280. FIG. 3(*b*) is a cross sectional view of the load-and-unload cup 282 of the wafer relay device 280 of FIG. 3(*a*) along the line QQ.

As illustrated in FIGS. 3(*a*) and 3(*b*), the load-and-unload cup 282 comprises a cup base 290, a cup ring 295, a lifter 300, a wafer tray 310, first multiple nozzles 340, second multiple nozzles 350, a drain channel 360, a first fluid channel 370 and a second fluid channel 372. The fluid channels 370 and 372 may be connected to fluid sources (not shown) through the pivoting arm 283 and the pivoting shaft 284. The drain channel 360 may be connected to a drain pump (not shown) through the pivoting arm 283*b* and the pivoting shaft 284*b*, similar to the other fluid channels 370 and 372.

The cup ring 295 and the wafer tray 310 are mounted on the cup base 290. The wafer tray 310 comprises a hole at the center, which allows the lifter 300 to be positioned at the center of the cup base 290. The lifter 300 is connected to a lifter pneumatic cylinder 304 through a lift piston 302, as illustrated in FIG. 3(*b*). The lifter 300 is a wafer handling device to raise and lower a wafer to and from a wafer carrier. The lifter 300 is preferably made of soft materials such as rubber to avoid damaging wafer surface. The lifer 300 has a surface area that is smaller than the surface area of the wafer being handled by the lifer. The lifter cylinder 304 is connected to the first fluid channel 370 and operated by a fluid supplied through the first fluid channel 370. Nitrogen gas is one example of the fluid that can be used. The lifter 300 can be moved up and down by the lifter cylinder 304 using the pressure of the supplied fluid. The lifter 300 can be lifted above the top surface of the cup ring 295 to receive a wafer W from the wafer transport device 150, as illustrated in FIG.

3(*b*). After the lifter 300 receives the wafer W, the lifter can be moved down below the wafer tray 310 in order to place the wafer W on the wafer tray 310.

The first multiple nozzles 340 are mounted on the top of the cup base 290 and the second multiple nozzles 350 are mounted on the cup ring 295, as illustrated in FIG. 3(*b*). The first and second nozzles 340 and 350 are connected to the second fluid channel 372, and thus, can spray a fluid, such as deionized (D.I.) water, which is supplied through the second fluid channel 372. Used fluid, e.g., used D.I. water, is drained through the drain channel 360 by the drain pump (not shown).

Figure 4A:
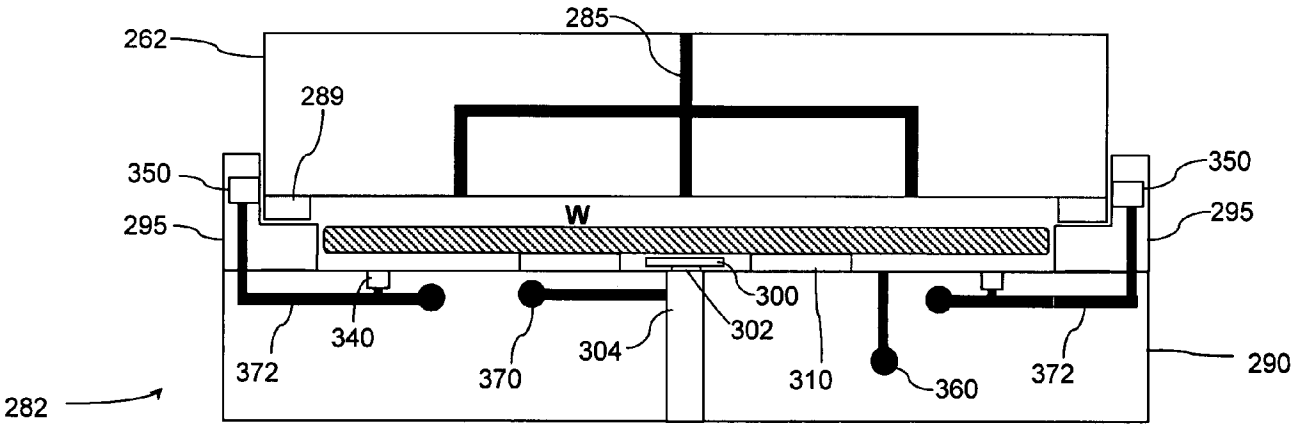
FIGS. 4(*a*) and (*b*) are cross-sectional views of one the wafer relay devices used in the polishing apparatus of FIG. 1, illustrating a wafer transfer process performed by the wafer relay device.
Figure 4B:
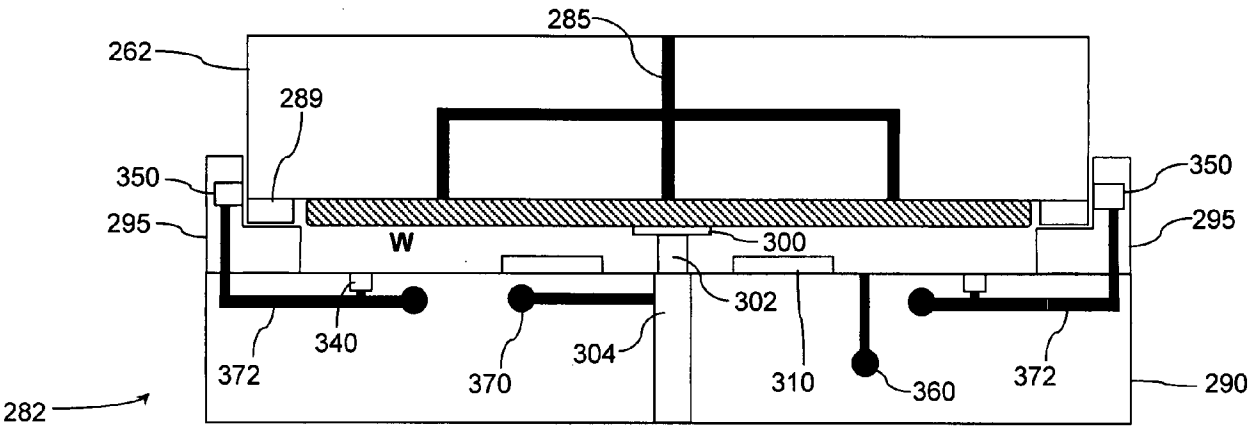
Figure 5A:
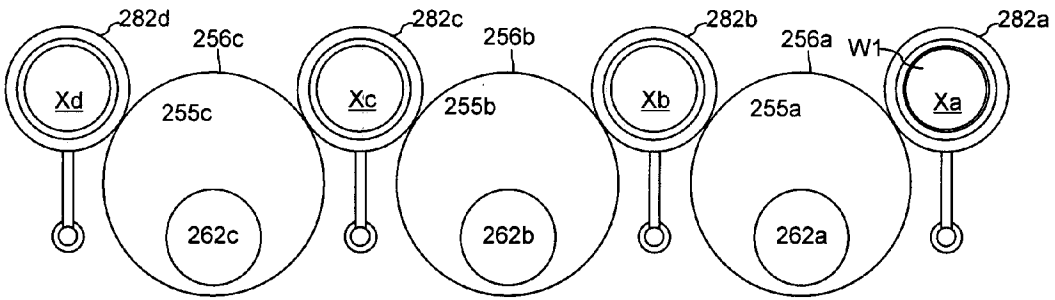
FIGS. 5(*a*)–(*n*) are sequential top views of a polishing station of FIG. 1, illustrating an exemplary method of wafer processing in the polishing station.
Figure 5B:
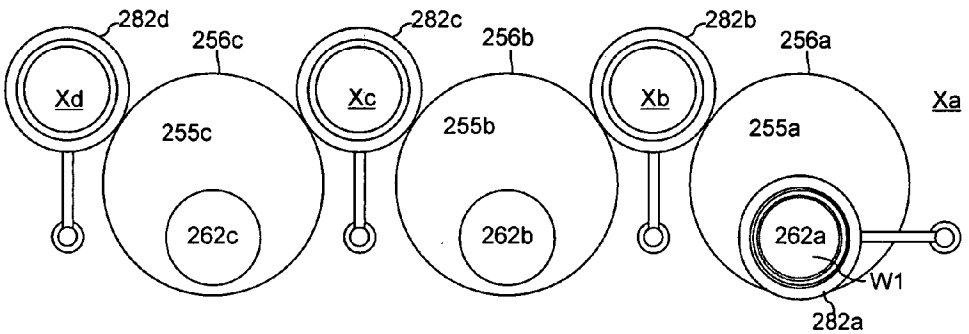
Figure 5C:
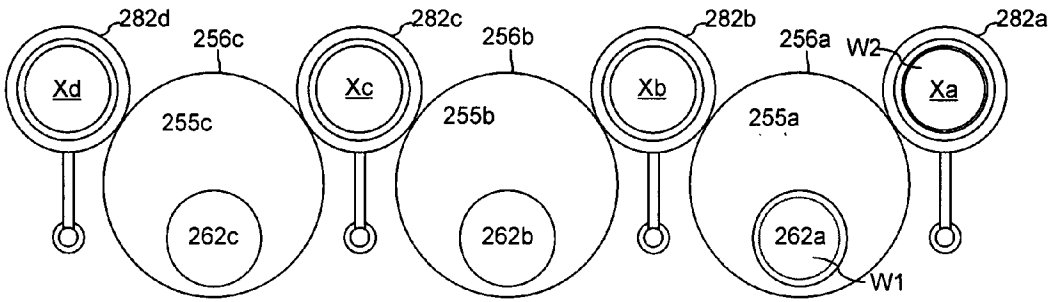
Figure 5D:
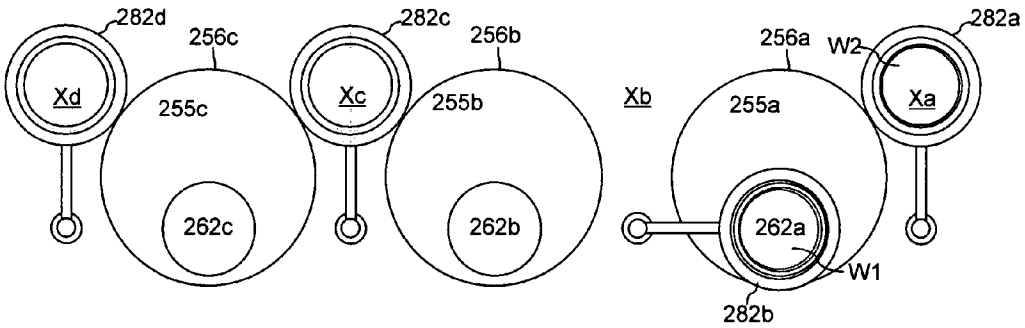
Figure 5E:
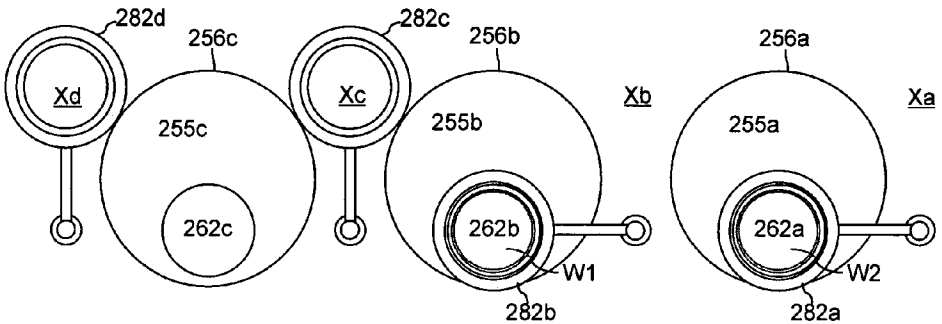
Figure 5F:
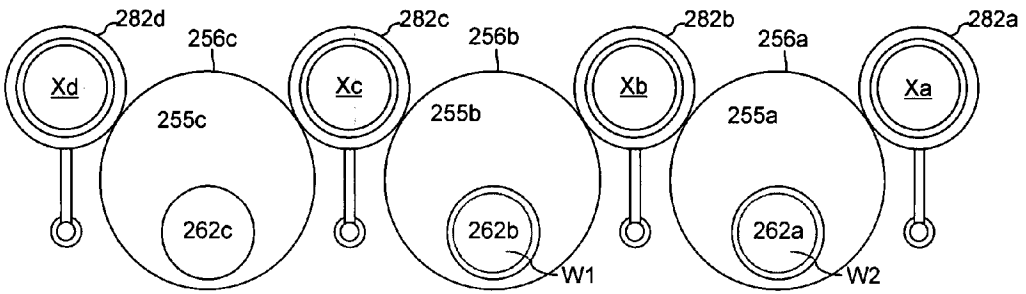
Figure 5G:
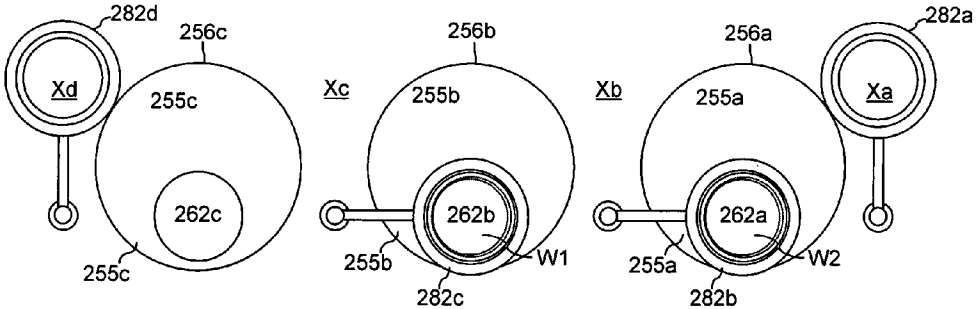
Figure 5H:
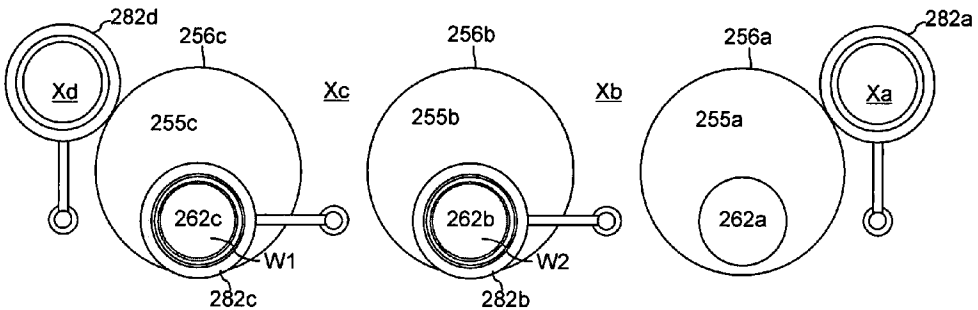
Figure 5I:
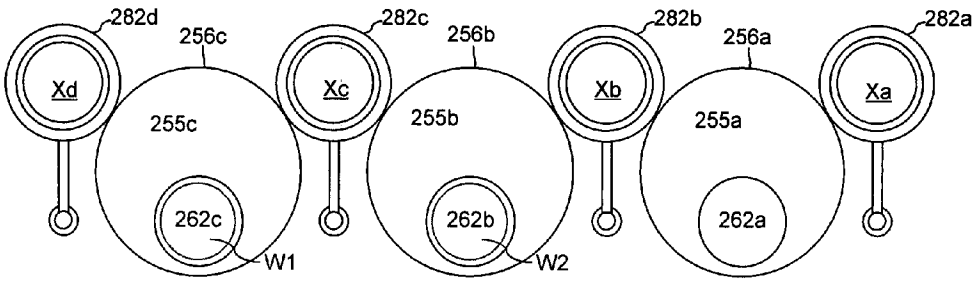
Figure 5J:
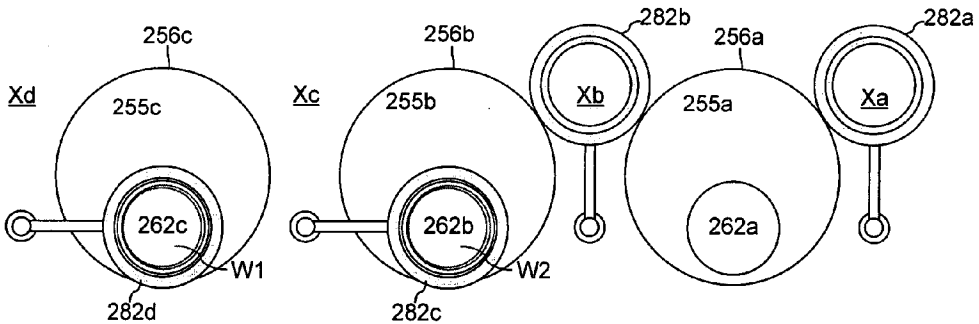
Figure 5K:
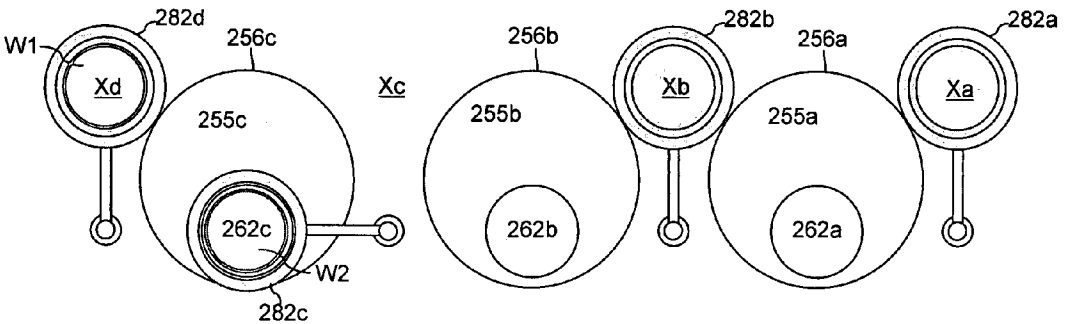
Figure 5L:
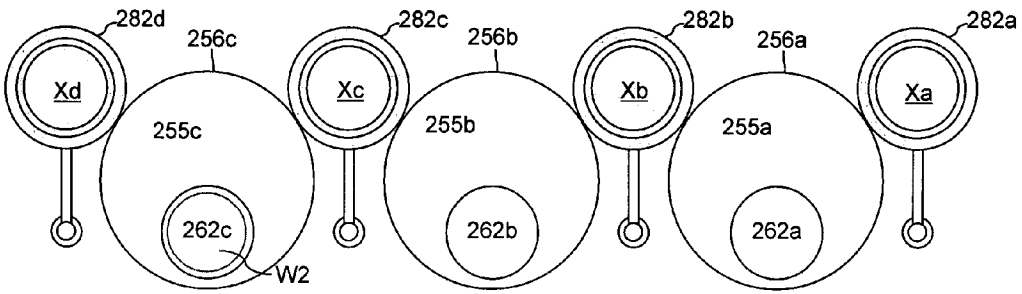
Figure 5M:
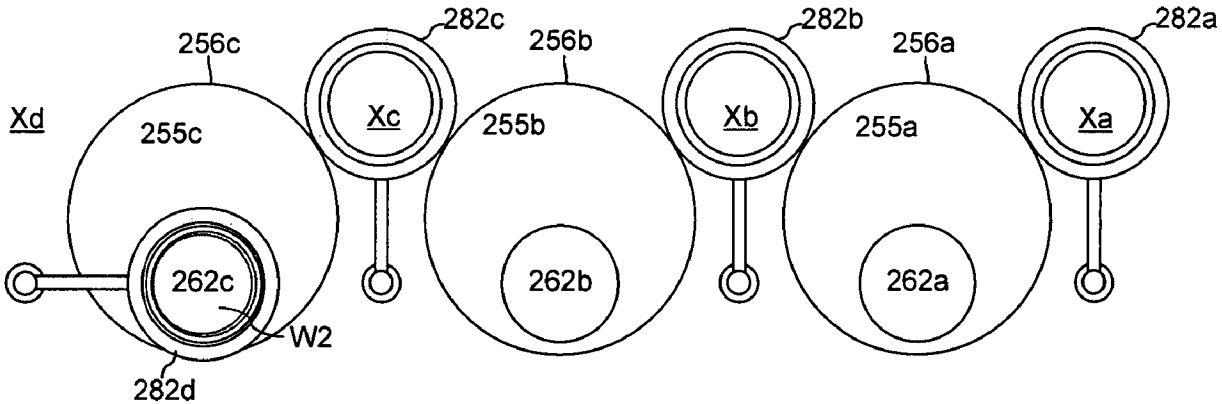
Figure 5N:
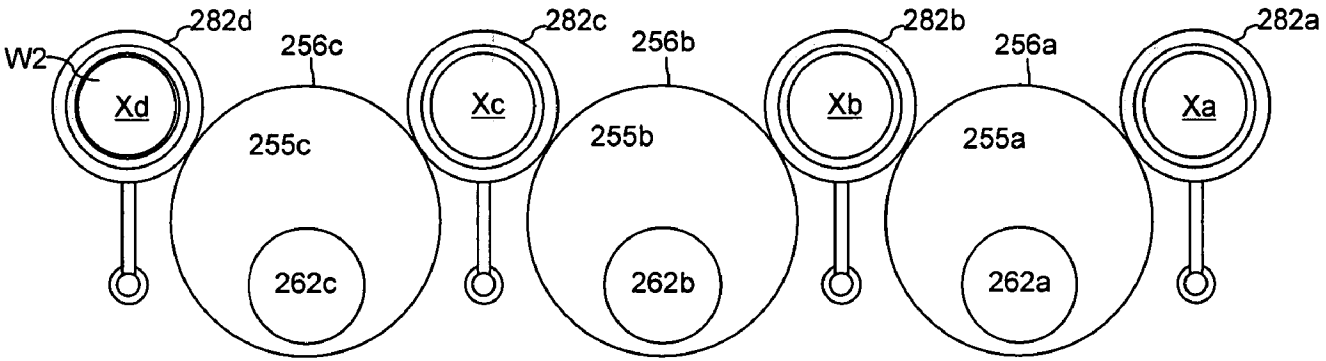

With reference to FIGS. 4(*a*) and 4(*b*), a wafer transfer process performed by one of the load-and-unload cups 282 is described. FIGS. 4(*a*) and (*b*) are sequential cross sectional views of the load-and-unload cup 282. After the wafer W is positioned on the wafer tray 310, as previously described with reference to FIG. 3(*b*), the load-and-unload cup 282 is transferred to a position where the wafer carrier 262 is positioned, as illustrated in FIG. 4(*a*). The wafer carrier 262 comprises a retainer ring 289 to confine the wafer during a polishing process. Next, the lifter 300 is moved up and the wafer on the lifer is received by the wafer carrier 262 using a vacuum supplied through vacuum channels 285, as illustrated in FIG. 4(*b*). After the wafer is received by the wafer carrier 262, the lifter 300 is moved down. For unloading the wafer from the wafer carrier 262 onto the load-and-unload cup 282, the vacuum provided through the vacuum channels 285 is removed, which releases the wafer W from the wafer carrier 262 onto the lifter 300 of the load-and-unload cup 282.

The load-and-unload cup 282 can wash the wafer carrier 262 by spraying D.I. water onto the wafer carrier 262. In the polishing station 20 of FIG. 1, the first wafer carrier 262*a* can be washed by the first and second load-and-unload cups 282*a* and 282*b*. The second wafer carrier 262*b* can be washed by the second and third load-and-unload cups 282*b* and 282*c*. The third wafer carrier 262*c* can be washed by the third and fourth load-and-unload cups 282*c* and 282*d*.

Even though a specific configuration of the load-and-unload cup 282 and its wafer loading and unloading processes have been described, any type of device that can load and unload wafers onto and from the wafer carrier 262 and wash the wafer carrier 262 can be used in the wafer relay device 280.

With reference to FIGS. 5(*a*)–(*n*), a method of processing wafers in the polishing station 20 is described. FIGS. 5(*a*)–(*n*) are sequential perspective views of the polishing station 20 to show the process sequence.

In FIG. 5(*a*), the load-and-unload cups 282*a*, 282*b*, 282*c* and 282*d* are positioned at their respective parking positions Xa, Xb, Xc and Xd. The wafer carriers 262*a*, 262*b* and 262*c* are positioned at the respective wafer load-and-unload positions over the respective polishing tables 256*a*, 256*b* and 256*c*. A first wafer W1 is supplied to the first load-and-unload cup 282*a* at the parking position Xa by the first wafer transport device 150 (not shown).

In FIG. 5(*b*), the first load-and-unload cup 282*a* is pivoted to the wafer load-and-unload position of the first wafer carrier 262*a* over the first polishing table 256*a* and then loads the first wafer W1 onto the first wafer carrier 262*a*.

In FIG. 5(*c*), the first load-and-unload cup 282*a* is pivoted back to the parking position Xa and then a second wafer W2 is supplied to the first load-and-unload cup 282*a* by the first wafer transport device 150 (not shown). The first wafer carrier 262*a* polishes the first wafer W1 using the polishing pad 255*a* on the first polishing table 256*a*. After the polishing process of the first wafer W1 is completed, the first wafer carrier 262*a* is lifted from the polishing table 256*a* to its wafer load-and-unload position.

In FIG. 5(*d*), the second load-and-unload cup 282*b* is pivoted to the wafer load-and-unload position of the first wafer carrier 262*a* and then receives the first wafer W1 from the first wafer carrier 262*a*.

In FIG. 5(*e*), the second load-and-unload cup 282*b* is pivoted to the wafer load-and-unload position of the second wafer carrier 262*b* and then loads the first wafer W1 onto the second carrier 262*b*. After the first wafer carrier 262*a* is empty, the first load-and-unload cup 282*a* is pivoted to the wafer load-and-unload position of the first wafer carrier 262*a* and then loads the second wafer W2 onto the first wafer carrier 262*a*.

In FIG. 5(*f*), the first and second load-and-unload cups 282*a* and 282*b* are pivoted back to the respective parking positions Xa and Xb. The first and second wafer carriers 262*a* and 262*b* polish the second and first wafers W2 and W1 using the polishing pads 255*a* and 255*b* on the first and second polishing tables 256*a* and 256*b*, respectively. After the polishing processes of the first and second wafers W1 and W2 are completed, the first and second wafer carriers 262*a* and 262*b* are lifted from the respective polishing tables 256*a* and 256*b* to the respective wafer load-and-unload positions.

In FIG. 5(*g*), the second and third load-and-unload cups 282*b* and 282*c* are pivoted to the wafer load-and-unload positions of the first and second wafer carriers 262*a* and 262*b*, respectively, and then receive the second and first wafers W2 and W1 from the first and second wafer carriers 262*a* and 262*b*, respectively.

In FIG. 5(*h*), the second and third load-and-unload cups 282*b* and 282*c* are pivoted to the wafer load-and-unload positions of the second and third wafer carriers 262*b* and 262*c* and then load the second and first wafers W2 and W1 to the second and third wafer carriers 262*b* and 262*c*, respectively.

In FIG. 5(*i*), the second and third load-and-unload cups 282*b* and 282*c* are pivoted back to the respective parking positions Xb and Xc. The second and third wafer carriers 262*b* and 262*c* polish the second and first wafers W2 and W1 using the polishing pads 255*b* and 255*c* on the second and third polishing tables 256*b* and 256*c*, respectively. After the polishing processes of the first and second wafers W1 and W2 are completed, the second and third wafer carriers 262*b* and 262*c* are lifted from the respective polishing tables 256*b* and 256*c* to the respective wafer load-and-unload positions.

In FIG. 5(*j*), the third and fourth load-and-unload cups 282*c* and 282*d* are pivoted to the wafer load-and-unload positions of the second and third wafer carriers 262*b* and 262*c*, respectively, and then receive the second and first wafers W2 and W1 from the second and third wafer carriers 262*b* and 262*c*, respectively.

In FIG. 5(*k*), the fourth load-and-unload cup 282*d* is pivoted back to its parking positions Xd. The third load-and-unload cup 282*c* is pivoted to the wafer load-and-unload position of the third wafer carrier 262*c* and then loads the second wafer W2 onto the third wafer carrier 262*c*.

In FIG. 5(*l*), the third wafer carrier 262*c* is pivoted back to its parking position Xc and then the third wafer carrier 262*c* polishes the second wafer W2 using the polishing pad 255*c* on the third polishing table 256*c*. After the polishing process of the second wafer W2 is completed, the third wafer carrier 262*c* is lifted from the polishing table 256*c* to its wafer load-and-unload position. The first wafer W1 is removed from the fourth load-and-unload cup 282*d* by the second wafer transport device 210 (not shown).

In FIG. 5(*m*), the fourth load-and-unload cup 282*d* is pivoted to the wafer load-and-unload position of the third wafer carrier 262*c* and then receives the second wafer W2 from the third wafer carrier 262*c*.

In FIG. 5(*n*), the fourth load-and-unload cup 282*d* is pivoted back to its parking position Xd and then the second wafer W2 is removed from the fourth load-and-unload cup 282*d* by the second wafer transport device 210 (not shown).

Even though an exemplary sequence of transferring and polishing semiconductor wafers in the polishing station 20 has been described using the two wafers W1 and W2, multiple wafers can be transferred and polished continuously one and after in the polishing station 20 in the same manner as these two wafers W1 and W2 have been transferred and polished.

Pivoting motions of the load-and-unload cups 282 of the polishing station 20 may be controlled individually. However, it is preferred that the pivoting motions of the load-and-unload cups 282 are synchronized such that the load-and-unload cups 282 cannot be pivoted to the same wafer load-and-unload positions at the same time. Simultaneous loading motions and simultaneous unloading motions of the load-and-unload cups 282, as described with reference to FIGS. 5(*g*) and (*h*), are also preferred because the simultaneous motions can increase the throughput of the polishing station 20 by making it possible for the wafer carriers 262 to be loaded with next wafers as soon as the wafers on the wafer carriers 262 are removed or unloaded from the wafer carriers 262.

In the polishing station 20, different polishing parameters, such as polishing pressure, slurry and polishing pad, can be used at different polishing units 250*a*, 250*b* and 250*c*. Wafers polished in the polishing station 20 have uniform polishing result without pad-to-pad variation and wafer carrier-to-wafer carrier variation because the wafers are processed sequentially by all of the wafer carriers 262 and on all of the polishing pads 255 of the polishing station 20.

Even though the polishing station 20 has been described in FIG. 1 as comprising three polishing units 250 and four wafer relay devices 280, the polishing station 20 can comprise other numbers of polishing units 250 and wafer relay devices 280. In a general form, the polishing station 20 comprises N polishing units 250 and N+1 wafer relay devices 280, where N is an integer equal to or larger than 2. The first wafer relay device 280 receives wafers from the first wafer transport device 150 and then transfers them to the wafer carrier 262 of the first polishing unit 250. The last wafer relay device 280 transfers wafers from the wafer carrier 262 of the last polishing unit 250 to the second wafer transport device 210. Each of the other wafer relay devices 280 of the N+1 wafer relay devices 280 is positioned between two different adjacent polishing units 250 and transfers wafers from the wafer carrier 262 of one of the adjacent polishing units to the wafer carrier 262 of the other adjacent polishing unit 250.

Turning back to FIG. 1, the wafer cleaner 220 of the polishing apparatus 10 is described. The wafer cleaner 220 comprises a first cleaning station 222, a second cleaning station 224, a drying station 226, a first wafer transport device 232, and a second wafer transport device 234. The first wafer transport device 232 transfers wafers from the first cleaning station 222 to the second cleaning station 224. The second wafer transport device 234 transfers wafers from the second cleaning station 224 to the drying station 226. Dried wafers are removed from the drying station 226 by the third wafer transport device 230 and then transferred to the wafer output station 104. The first and second cleaning stations 222 and 224 remove slurry particles from wafer surfaces using D.I. water and/or chemicals, such as $NH_4OH$, diluted HF and organic chemicals. After the cleaning process is completed, wafers are rinsed with D.I. water and then dried in the drying station 226. The wafer cleaner 220 may comprise more than two cleaning stations or may comprise a single cleaning station. In other embodiments, the wafer cleaner 220 may further comprise a buffer station (not shown) and an additional wafer transfer device (not shown) in front of the first cleaning station 222. The buffer station accommodates multiple wafers to be cleaned in the first cleaning station 222 and the additional wafer transfer device transfer the wafers from the buffer station to the first cleaning station 222.

Figure 6:
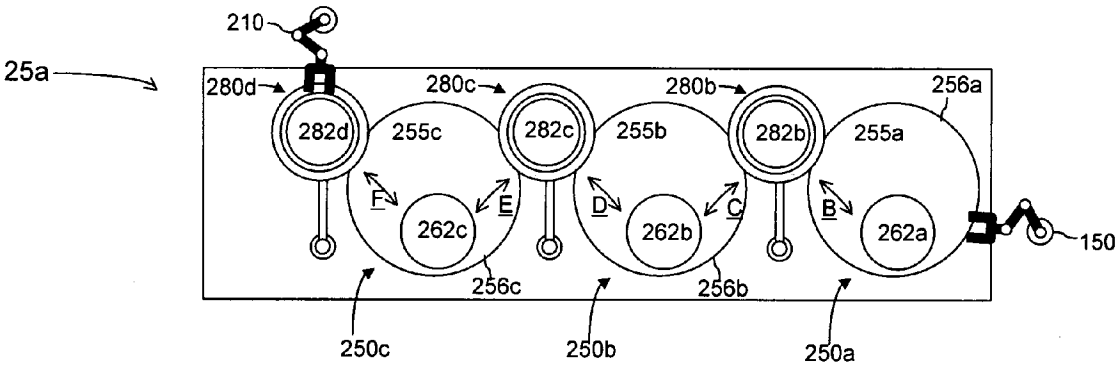
FIGS. 6–8 are top views of polishing stations, which can be used in the polishing apparatus of FIG. 1, in accordance with other embodiments of the invention.
Figure 7:
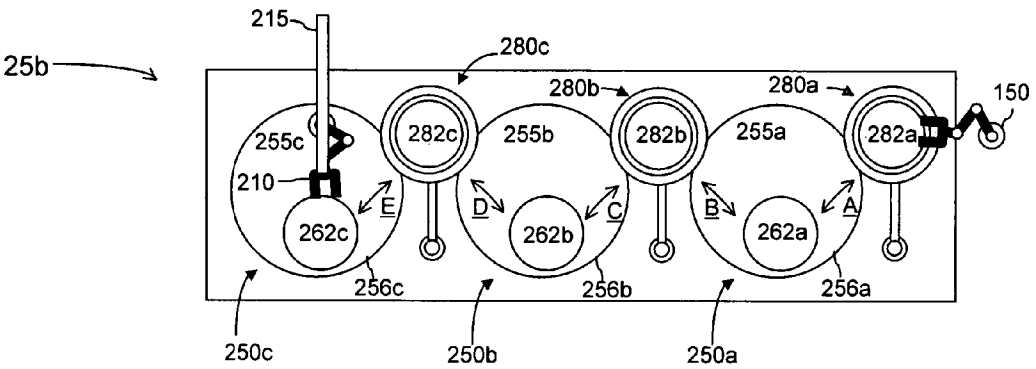
Figure 8:
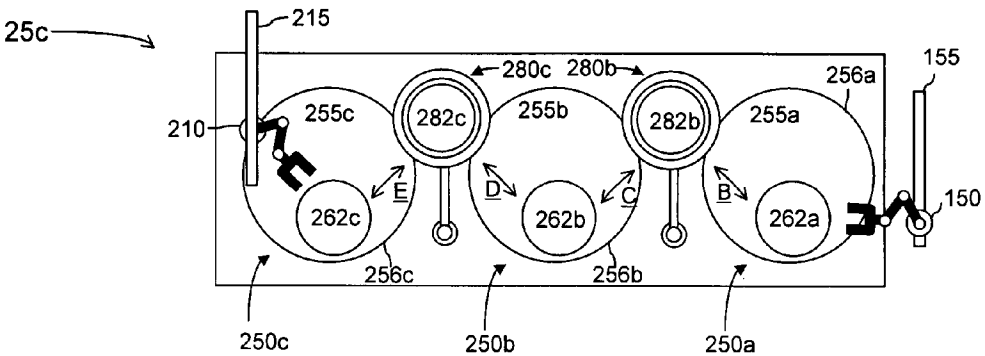

With reference to FIGS. 6–8, polishing stations 25*a*, 25*b* and 25*c* in accordance with other embodiments of the present invention are described. FIGS. 6–8 are top views of these polishing stations 25*a*, 25*b* and 25*c*, respectively. Any one of these polishing stations 25*a*, 25*b* and 25*c* can be used in the polishing apparatus 10 of FIG. 1 instead of the polishing station 20. In FIGS. 6–8, the wafer carriers 262 are illustrated without the respective carrier shafts 264 and the respective rotating-and-vertical drive mechanisms 266. However, each wafer carrier 262 of the polishing stations 25*a*, 25*b* and 25*c* is a part of a wafer carrier assembly 260 as described above with reference to FIGS. 1 and 2.

The polishing station 25*a* of FIG. 6 can be derived from the polishing station 20 of FIG. 1 by removing the first wafer relay device 280*a* from the polishing station 20. Thus, the wafer carrier 262*a* can be defined as an end wafer carrier of the wafer carriers in the polishing station 25*a*. In this polishing station 25*a*, the first wafer transport device 150 loads wafers directly onto the wafer carrier 262*a* of the first polishing unit 250*a*. Wafers are processed in the polishing station 250*a* from the wafer carrier 262*a* of the first polishing unit 250*a* through the last wafer relay device 280*d* in the same manner as wafers are processed in the polishing station 20, which was described above. In the polishing station 25*a*, the first wafer carrier 262*a* can be washed by the load-and-unload cup 282*b*, which can pivot to the first wafer carrier 262*a*.

The polishing station 25*b* of FIG. 7 can be derived from the polishing station 20 of FIG. 1 by removing the fourth wafer relay device 280*d* from the polishing station 20. Thus, the wafer carrier 262*c* can be defined as an end wafer carrier of the wafer carriers in the polishing station 25*b*. In this polishing station 25*b*, the second wafer transport device 210 removes wafers directly from the wafer carrier 262*c* of the third polishing unit 250*c*. Wafers are processed in the polishing station 25*b* from the first wafer relay device 280*a* through the wafer carrier 262*c* of the third polishing unit 250*c* in the same manner as wafers are processed in the polishing station 20, which was described above. In the polishing station 25*b*, the third wafer carrier 262*c* can be washed by the load-and-unload cup 282*c*, which can pivot to the third wafer carrier 262*c*.

The polishing station 25*c* of FIG. 8 can be derived from the polishing station 20 of FIG. 1 by removing the first and fourth wafer relay devices 280*a* and 280*d* from the polishing station 20. Thus, the wafer carriers 262*a* and 262*c* can be defined end wafer carriers of the wafer carriers in the polishing station 25*c*. In this polishing station 25*c*, the first wafer transport device 150 loads wafers directly onto the wafer carrier 262*a* of the first polishing unit 250*a* and the second wafer transport device 210 removes wafers directly from the wafer carrier 262*c* of the third polishing unit 250*c*. Wafers are processed in the polishing station 25*c* from the wafer carrier 262*a* of the first polishing unit 250*a* through the wafer carrier 262*c* of the third polishing unit 250*c* in the same manner as wafers are processed in the polishing station 20, which was described above. In the polishing station 25*c*, the first wafer carrier 262*a* can be washed by the load-and-unload cup 282*b*, which can pivot to the first wafer carrier 262*a*. Furthermore, the fourth wafer carrier 262*d* can be washed by the load-and-unload cup 282*c*, which can pivot to the third wafer carrier 262*c*.

In a general form, the polishing stations 25*a* and 25*b* have N polishing units 250 and N wafer relay devices 280, where N is an integer equal to or larger than 2. The polishing station 25*c* has N polishing units 250 and N−1 wafer relay devices 280. In the polishing stations 25*a* and 25*c*, the first wafer carrier 262 receives wafers directly from the first wafer transport device 150. In the polishing stations 25*b* and 25*c*, the last wafer carrier 262 unloads wafers directly to the second wafer transport device 210.

Figure 9:
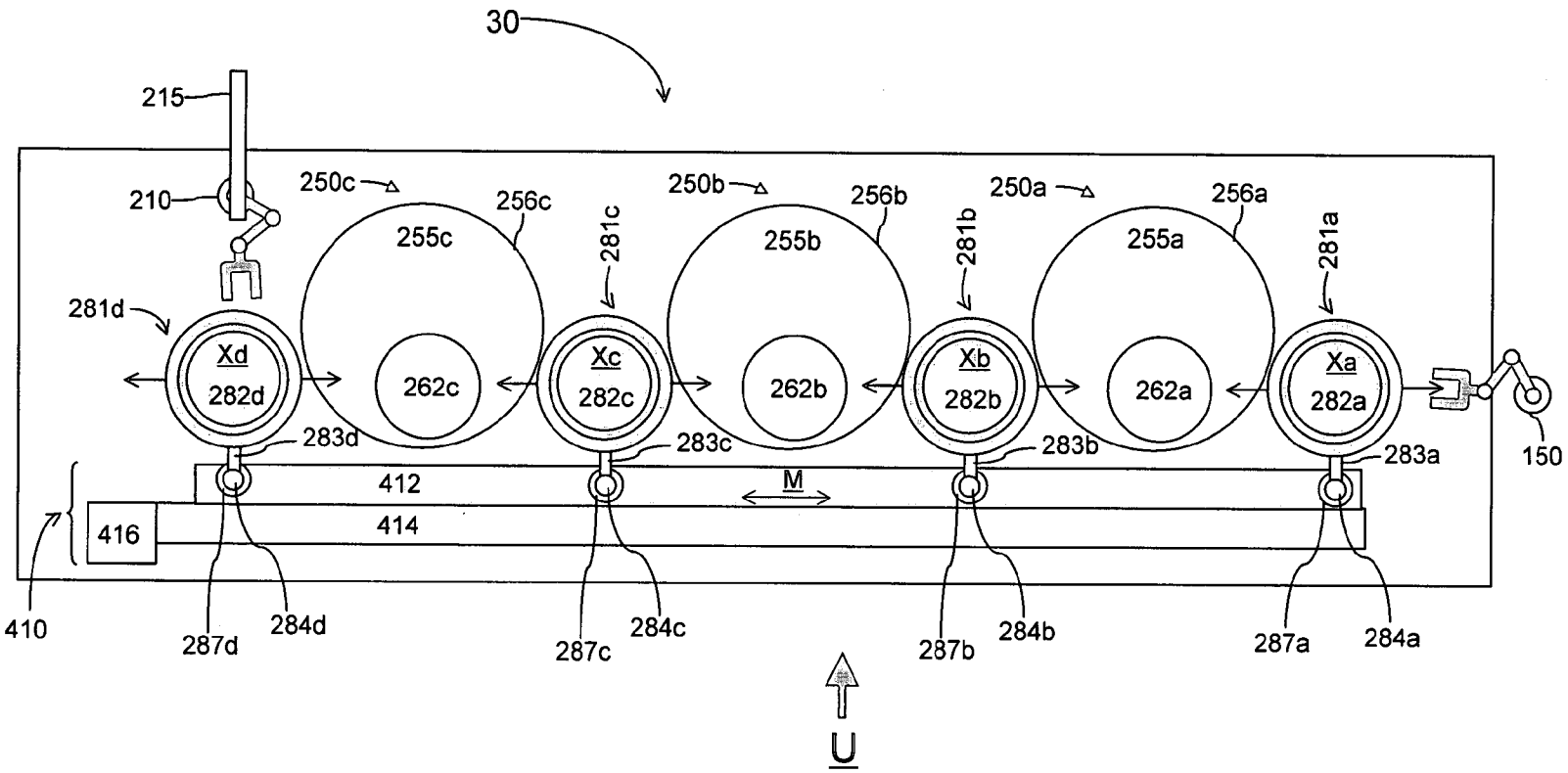
FIGS. 9 and 10 are a top view and a side view of a polishing station, respectively, which can be used in the polishing apparatus of FIG. 1, in accordance with another embodiment of the invention.
Figure 10:
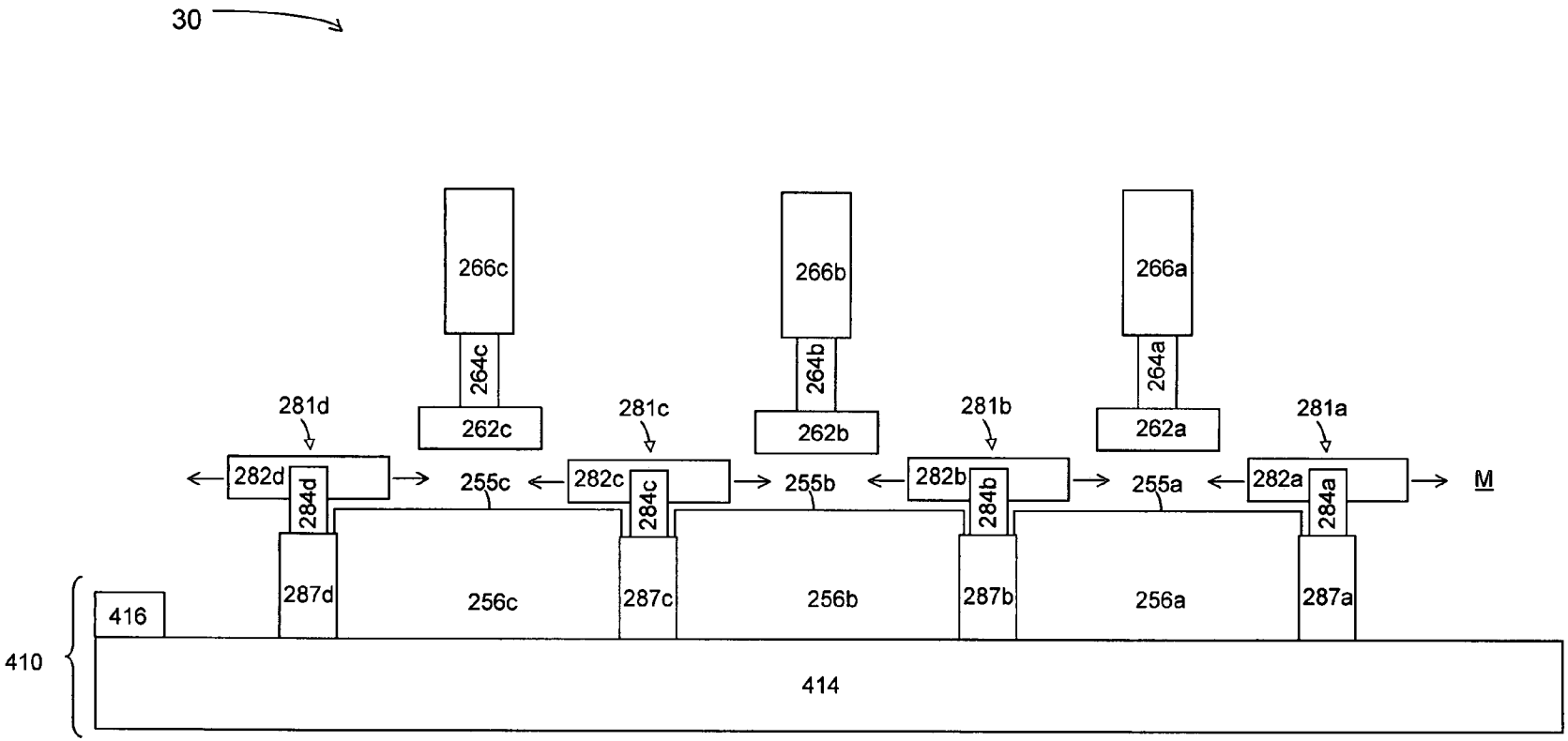

With reference to FIGS. 9 and 10, a polishing station 30 in accordance with an embodiment of the present invention is described. FIG. 9 shows a top view of the polishing station 30. FIG. 10 shows a side view of the polishing station 30, as viewed in the direction U illustrated in FIG. 9. The polishing station 30 can be used in the polishing apparatus 10 of FIG. 1 instead of the polishing station 20.

The polishing station 30 comprises a first polishing unit 250*a*, a second polishing unit 250*b*, a third polishing unit 250*c*, a linear reciprocating mechanism 410 and a set of four wafer relay devices 281*a*, 281*b*, 281*c* and 281*d*. Configuration of the polishing station 30 is similar to the polishing station 20 of FIG. 1 except that the wafer relay devices 281*a*, 281*b*, 281*c* and 281*d* are connected to the linear reciprocating mechanism 410 such that the wafer relay devices can be moved in a linear reciprocating manner in the directions illustrated by the arrow M in FIGS. 9 and 10.

The linear reciprocating mechanism 410 comprises a reciprocating shaft 412, a linear track 414 and a reciprocating drive mechanism 416. The wafer relay devices 281*a*, 281*b*, 281*c* and 281*d* are mounted on the reciprocating shaft 412. The reciprocating shaft 412 is connected to the linear track 414. The reciprocating drive mechanism 416 controls the linear reciprocating motions M of the wafer relay devices 281 by reciprocating the reciprocating shaft 412 along the linear track 414.

The polishing units 250*a*, 250*b* and 250*c* are positioned such that their wafer carriers 262*a*, 262*b* and 262*c* are equally spaced in a linear manner. The wafer relay devices 281*a*, 281*b*, 281*c* and 281*d* are mounted on the reciprocating shaft 412 such that their load-and-unload cups 282*a*, 282*b*, 282*c* and 282*d* are equally spaced in a linear manner and the distance between two adjacent load-and-unload cups 282 is equal to the distance between two adjacent wafer carriers 262.

The wafer relay devices 281 of the polishing station 30 are similar to the wafer relay devices 280 of FIG. 1 except that the load-and-unload cups 282 of the wafer relay devices 281 in the polishing station 30 do not need to pivot. Therefore, the shafts 284 of the wafer relay devices 281 of the polishing station 30 are connected to respective vertical drive mechanisms 287 instead of the pivoting-and-vertical drive mechanisms 286 as in the polishing station 20.

A method of processing wafers in the polishing station 30 is described with reference to FIG. 9. First, the set of wafer relay devices 281*a*, 281*b*, 281*c* and 281*d* are positioned at their respective parking positions Xa, Xb, Xc and Xd, as illustrated in FIG. 9. The first wafer relay device 281*a* receives a first wafer from the first wafer transport device 150 and then transfers the first wafer to the first wafer carrier 262*a* by the linear motion M. Next, the first wafer relay device 281*a* is linearly moved back to its parking position Xa and then the first wafer carrier 262*a* polishes the wafer using the polishing pad 255*a* on the first polishing table 256*a*.

After the polishing process is completed, the first wafer carrier 262*a* is lifted from the polishing table 256*a* and then the second wafer relay device 281*b* transfers the first wafer from the first wafer carrier 262*a* to the second wafer carrier 262*b* by the linear motion M. Next, the second wafer relay device 281*b* is linearly moved back to its parking position Xb and then the second wafer carrier 262*b* polishes the wafer using the polishing pad 255*b* on the second polishing table 256*b*.

After the polishing process is completed, the second wafer carrier 262*b* is lifted from the polishing table 256*b* and then the third wafer relay device 281*c* transfers the first wafer from the second wafer carrier 262*b* to the third wafer carrier 262*c* by the linear motion M. Next, the third wafer relay device 281*c* is linearly moved back to its parking position Xc and then the third wafer carrier 262*c* polishes the wafer using the polishing pad 255*c* on the third polishing table 256*c*.

After the polishing process is completed, the third wafer carrier 262*c* is lifted from the polishing table 256*c* and then the fourth wafer relay device 281*d* transfers the first wafer from the third wafer carrier 262*b* to the second wafer transport device 210 by the linear motion M.

In a general form, the polishing station 30 has N polishing units 250 and N+1 wafer relay devices 281, where N is an integer equal to or larger than 2. The first wafer relay device 281 receives wafers from the first wafer transport device 150 and transfers the wafers to the first wafer carrier 262. The last wafer relay device 281 receives wafers from the last wafer carrier 262 and transfers the wafers to the second wafer transport device 210. Each of the other N+1 wafer relay devices 281 transfers wafers between the respective two adjacent wafer carriers 262.

Figure 11:
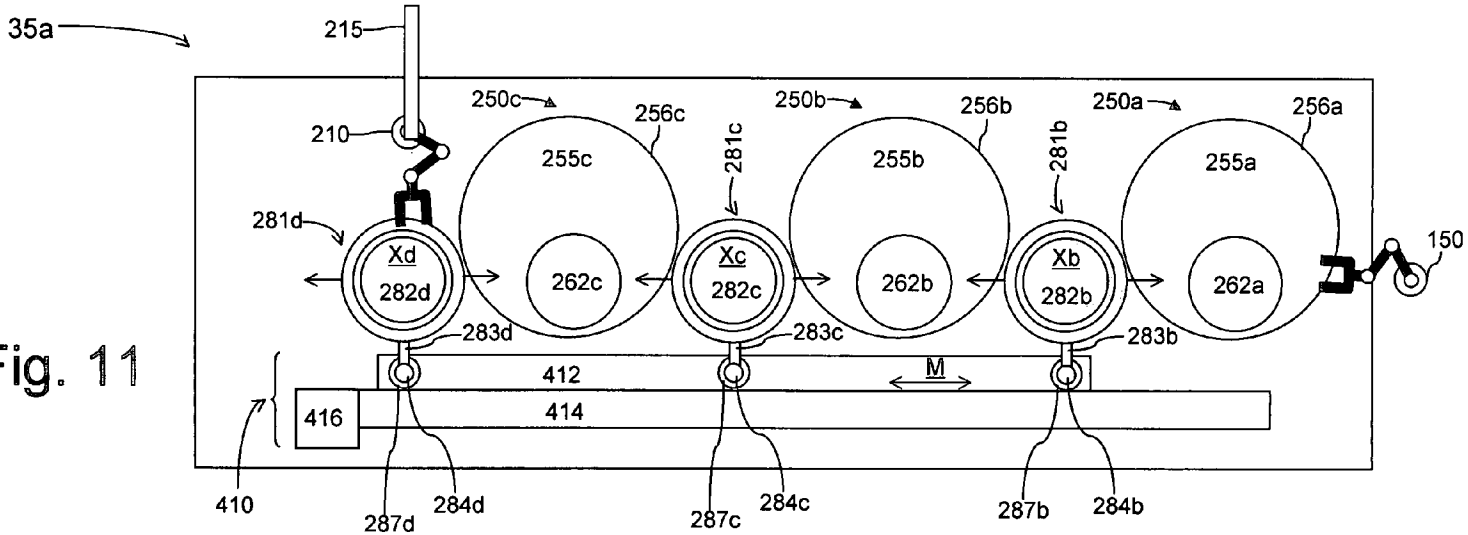
FIGS. 11–17 are top views of polishing stations, which can be used in the polishing apparatus of FIG. 1, in accordance with other embodiments of the invention.
Figure 12:
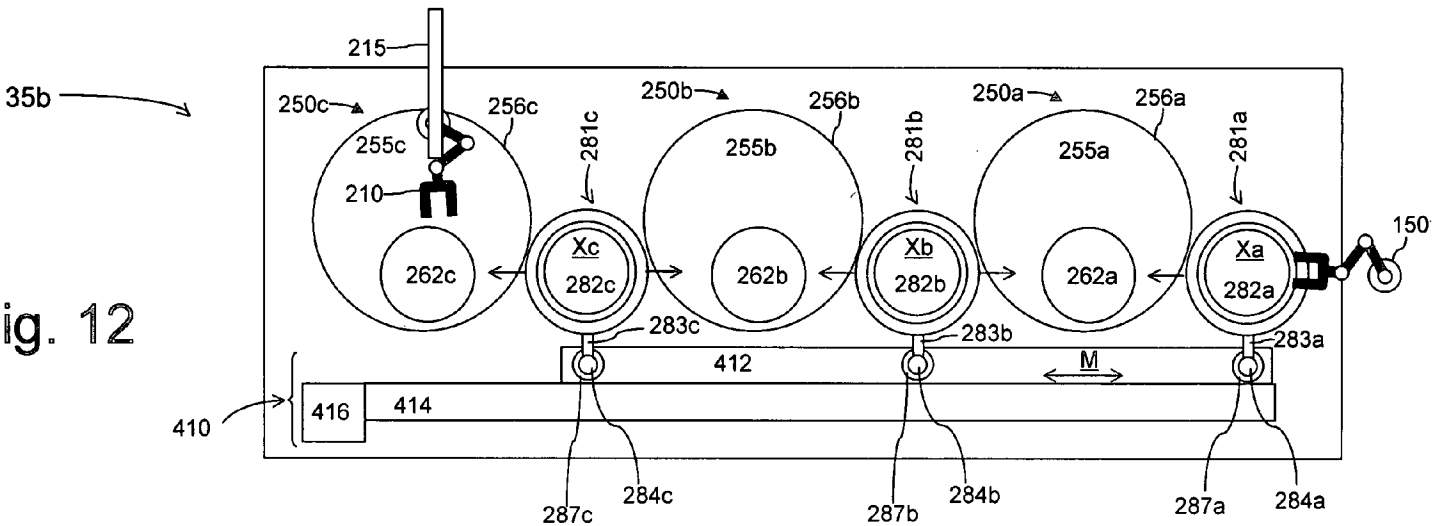
Figure 13:
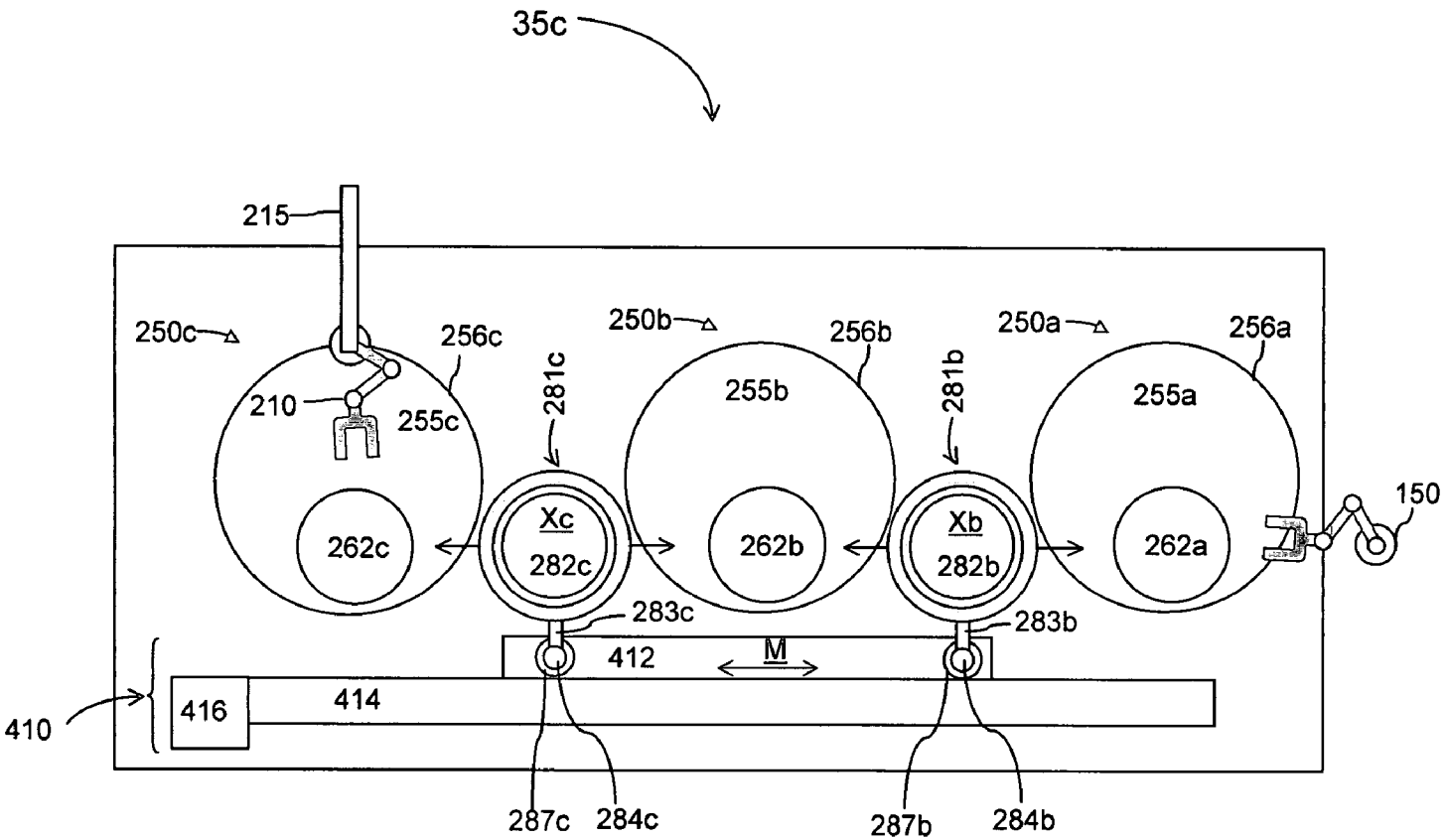

With reference to FIGS. 11–13, polishing stations 35*a*, 35*b* and 35*c* in accordance with other embodiments of the present invention are described. FIGS. 11–13 are top views of these polishing stations 35*a*, 35*b* and 35*c*. Any one of these polishing station 35*a*, 35*b* and 35*c* can be used in the polishing apparatus 10 of FIG. 1 instead of the polishing station 20.

The polishing station 35*a* of FIG. 11 can be derived from the polishing station 30 of FIG. 9 by removing the first wafer relay device 281*a* from the polishing station 30. In this polishing station 35*a*, the first wafer transport device 150 loads wafers directly onto the wafer carrier 262*a* of the first polishing unit 250*a*. Wafers are processed in the polishing station 35*a* from the wafer carrier 262*a* of the first polishing unit 250*a* through the last wafer relay device 281*d* in the same manner as wafers are processed in the polishing station 30, which was described above with reference to FIG. 9. In the polishing station 35*a*, the first wafer carrier 262*a* can be washed by the load-and-unload cup 282*b*, which can be moved to the first wafer carrier 262*a*.

The polishing station 35*b* of FIG. 12 can be derived from the polishing station 30 of FIG. 9 by removing the fourth wafer relay device 281*d* from the polishing station 30. In this polishing station 35*b*, the second wafer transport device 210 removes wafers directly from the wafer carrier 262*c* of the third polishing unit 250*c*. Wafers are processed in the polishing station 35*b* from the first wafer relay device 281*a* through the wafer carrier 262*c* of the third polishing unit 250*c* in the same manner as wafers are processed in the polishing station 30, which was described above with reference to FIG. 9. In the polishing station 35*b*, the third wafer carrier 262*c* can be washed by the load-and-unload cup 282*c*, which can be moved to the third wafer carrier 262*c*.

The polishing station 35*c* of FIG. 13 can be derived from the polishing station 30 of FIG. 9 by removing the first and fourth wafer relay devices 281*a* and 281*d* from the polishing station 30. In this polishing station 35*c*, the first wafer transport device 150 loads wafers directly onto the wafer carrier 262*a* of the first polishing unit 250*a* and the second wafer transport device 210 removes wafers directly from the wafer carrier 262*c* of the third polishing unit 250*c*. Wafers are processed in the polishing station 35*c* from the wafer carrier 262*a* of the first polishing unit 250*a* through the wafer carrier 262*c* of the third polishing unit 250*c* in the same manner as wafers are processed in the polishing station 30, which was described above with reference to FIG. 9. In the polishing station 35*c*, the first wafer carrier 262*a* can be washed by the load-and-unload cup 282*b*, which can be moved to the first wafer carrier 262*a*. Furthermore, the third wafer carrier 262*c* can be washed by the load-and-unload cup 282*c*, which can be moved to the third wafer carrier 262*c*.

In a general form, the polishing stations 35*a* and 35*b* can have N polishing stations 250 and N wafer relay devices 281, where N is an integer equal to or larger than 2. The polishing station 35*c* can have N polishing stations 250 and N−1 wafer relay devices 281. In the polishing stations 35*a* and 35*c*, the first wafer carrier 262 receives wafers directly from the first wafer transport device 150. In the polishing stations 35*b* and 35*c*, the last wafer carrier 262 unloads wafers directly to the second wafer transport device 210.

Figure 14:
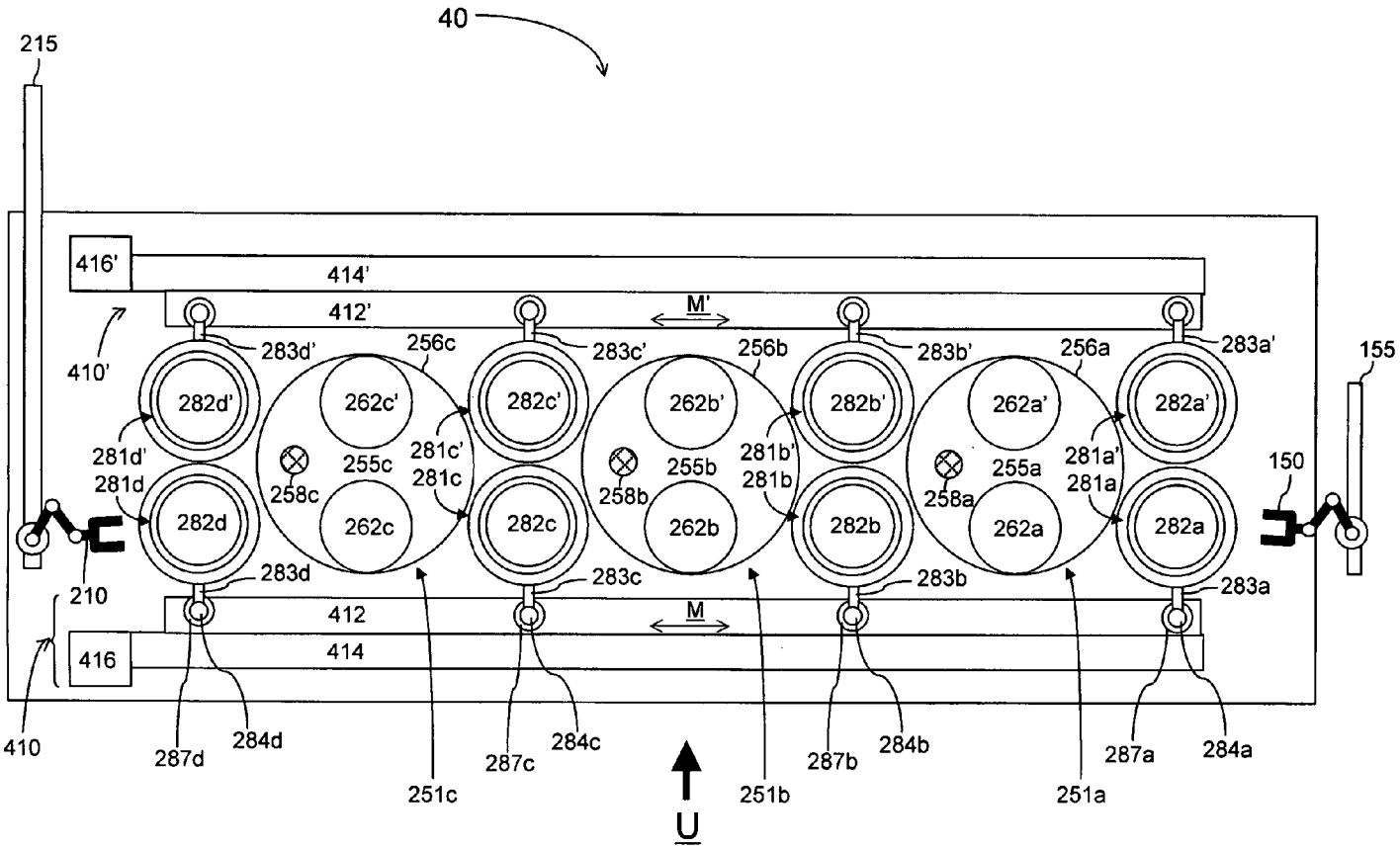

With reference to FIG. 14, a polishing station 40 in accordance with another embodiment of the present invention is described. FIG. 14 is a top view of the polishing station 40. A side view of the polishing station 40, as viewed in the direction U illustrated in FIG. 14, is similar to the side view of the polishing station 30 illustrated in FIG. 10. The polishing station 40 can be used in the polishing apparatus 10 of FIG. 1 instead of the polishing station 20.

The polishing station 40 comprises a first polishing unit 251*a*, a second polishing unit 251*b*, a third polishing unit 251*c*, first and second linear reciprocating mechanisms 410 and 410' and first and second sets of four wafer relay devices 281*a*–281*d* and 281*a*'–281*d*'.

Configuration of the polishing station 40 is similar to the polishing station 30 illustrated in FIG. 9 except that the polishing station 40 further comprises the second set of four wafer relay devices 281*a*'–281*d*' and the second linear reciprocating mechanism 410'. Another difference is that the polishing station 40 comprises the polishing units 251*a*, 251*b* and 251*c* instead of the polishing units 250*a*, 250*b* and 250*c*. Each polishing unit 251 comprises a polishing table 256 and first and second wafer carriers 262 and 262'. Each polishing unit 251 may further comprise a pad conditioner 258.

The polishing units 251*a*, 251*b* and 251*c* are positioned in the polishing station 40 such that the first wafer carriers 262*a*, 262*b* and 262*c* are equally spaced in a linear manner, the second wafer carriers 262*a*', 262*b*' and 262*c*' are also equally spaced in a linear manner, and the first and second wafer carriers 262*a*–262*c* and 262*a*'–262*c*' are arranged in parallel.

The second set of wafer relay devices 281*a*', 281*b*', 281*c*' and 281*d*' are connected to the second linear reciprocating mechanism 410' in the same manner as the first set of wafer relay devices 281*a*, 281*b*, 281*c* and 281*d* are connected to the first linear reciprocating mechanism 410, as described above with reference to the polishing station 30 of FIG. 9. The second linear reciprocating mechanism 410' controls reciprocating motion M' of the second set of wafer relay devices 281*a*'–281*d*' in the same manner as the first linear reciprocating mechanism 410 controls the reciprocating motion M of the first set of wafer relay devices 281*a*–281*d*, as described above with reference to the polishing station 30 of FIG. 9.

The second wafer carriers 262*a*'–262*c*' of the polishing units 251*a*–251*c*, the second set of wafer relay devices 281*a*'–281*d*' and the polishing tables 256*a*–256*c* transfer and polish wafers in the same manner as the wafer carriers 262*a*–262*c*, the first set of wafer relay devices 281*a*–281*d* and the polishing tables 256*a*–256*c* of the polishing station 30 transfer and polish wafers, as described above.

A method of processing wafers in the polishing station 40 can be described with reference to FIG. 14 in the following manner. 1'st, 3'rd, . . . and (2N−1)'th wafers are supplied to the first wafer relay device 281*a* of the first set of wafer relay devices 281*a*–281*d* by the first wafer transport device 150 and then transferred from the first wafer relay device 281*a* through the fourth wafer relay device 281*d* via the first wafer carriers 262*a*–262*c* of the polishing units 251*a*–251*c*. During the transferring, the wafers are polished on the polishing tables 256*a*–256*c* by the first wafer carriers 262*a*–262*c* of the polishing units 251*a*–251*c* in a sequential manner. 2'nd, 4'th, . . . and 2N'th wafers are supplied to the first wafer relay device 281*a*' of the second set of wafer relay devices 281*a*'–281*d*' by the first wafer transport device 150 and then transferred from the first wafer relay device 281*a*' through the fourth wafer relay device 281*d*' via the second wafer carriers 262*a*'–262*c*' of the polishing units 251*a*–251*c*. During the transferring, the wafers are polished on the polishing tables 256*a*–256*c* by the second wafer carriers 262*a*'–262*c*' of the polishing units 251*a*–251*c* in a sequential manner. Thus, two wafers can be simultaneously polished on each of the polishing tables 256*a*–256*c*.

In a general form, the polishing station 40 can have N polishing units 251 and two sets of N+1 wafer relay devices 281, where N is an integer equal to or larger than 2. The first wafer transport device 150 transfers wafers to the first two wafer relay devices 281 and the second wafer transport device 210 removes the wafers from the last two wafer relay devices 281.

The polishing station 40 can be modified such that the first wafer transport device 150 transfer wafers directly to the wafer carriers 262*a* and 262*a*' of the first polishing unit 251*a* by removing the first wafer relay devices 281*a* and 281*a*' from the polishing station 40 of FIG. 14. Wafers are processed in this modified polishing station from the wafer carriers 262*a* and 262*a*' of the first polishing unit 251*a* through the last wafer relay devices 281*d* and 281*d*' in the same manner as wafers are processed in the polishing station 40, which was described above with reference to FIG. 14. In this modified polishing station, the wafer carriers 262*a* and 262*a*' of the first polishing unit 251*a* can be washed by the load-and-unload cups 282*b* and 282*b*', respectively, which can be moved to the wafer carriers 262*a* and 262*a*'.

In a general form, this modified polishing station has N polishing units 251 and two sets of N wafer relay devices 281, where N is an integer equal to or larger than 2. The first wafer transport device 150 transfers wafers to the wafer carriers 262 of the first polishing unit 251 and the second wafer transport device 210 removes the wafers from the last two wafer relay devices 281.

The polishing station 40 can be also modified such that the second wafer transport device 210 transfer wafers directly from the wafer carriers 262*c* and 262*c*' of the last polishing unit 251*c* by removing the last wafer relay devices 281*d* and 281*d*' from the polishing station 40 of FIG. 14. Wafers are processed in this modified polishing station from the first wafer relay devices 281*a* and 281' through the wafer carriers 262*c* and 262*c*' of the third polishing unit 251*c* in the same manner as wafers are processed in the polishing station 40, which was described above with reference to FIG. 14. In this modified polishing station, the wafer carriers 262*c* and 262*c*' of the third polishing unit 251*c* can be washed by the load-and-unload cups 282*c* and 282*c*', respectively, which can be moved to the wafer carriers 262*c* and 262*c*'.

In a general form, this modified polishing station has N polishing units 251 and two sets of N wafer relay devices 281, where N is an integer equal to or larger than 2. The first wafer transport device 150 transfers wafers to the first wafer relay devices 281 and the second wafer transport device 210 removes the wafers from the wafer carriers 262 of the last wafer relay devices 281.

The polishing station 40 can be further modified such that the first and second wafer transport devices 150 and 210 transfer wafers directly to and from the wafer carriers 262 of the first and last polishing units 251*a* and 251*c*, respectively, by removing the first wafer relay devices 281*a* and 281*a*' and the last wafer relay devices 281*d* and 281*d*' from the polishing station 40 of FIG. 14. Wafers are processed in this modified polishing station from the wafer carriers 262*a* and 262*a*' of the first polishing unit 251*a* to the wafer carriers 262*c* and 262*c*' of the third polishing unit 251*c* in the same manner as wafers are processed in the polishing station 40, which was described above with reference to FIG. 14. In this modified polishing station 40, the wafer carriers 262*a* and 262*a*' of the first polishing unit 251*a* can be washed by the load-and-unload cups 282*b* and 282*b*', respectively, which can be moved to the wafer carriers 262*a* and 262*a*'. Furthermore, the wafer carriers 262*c* and 262*c*' of the third polishing unit 251*c* can be washed by the load-and-unload cups 282*c* and 282*c*', respectively, which can be moved to the wafer carriers 262*c* and 262*c*'.

In a general form, this modified polishing station has N polishing units 251 and N−1 wafer relay devices 281, where N is an integer equal to or larger than 2. The first wafer transport device 150 transfers wafers to the wafer carriers 262 of the first polishing unit 251*a* and the second wafer transport device 210 removes the wafers from the wafer carriers 262 of the last polishing unit 251.

Figure 15:
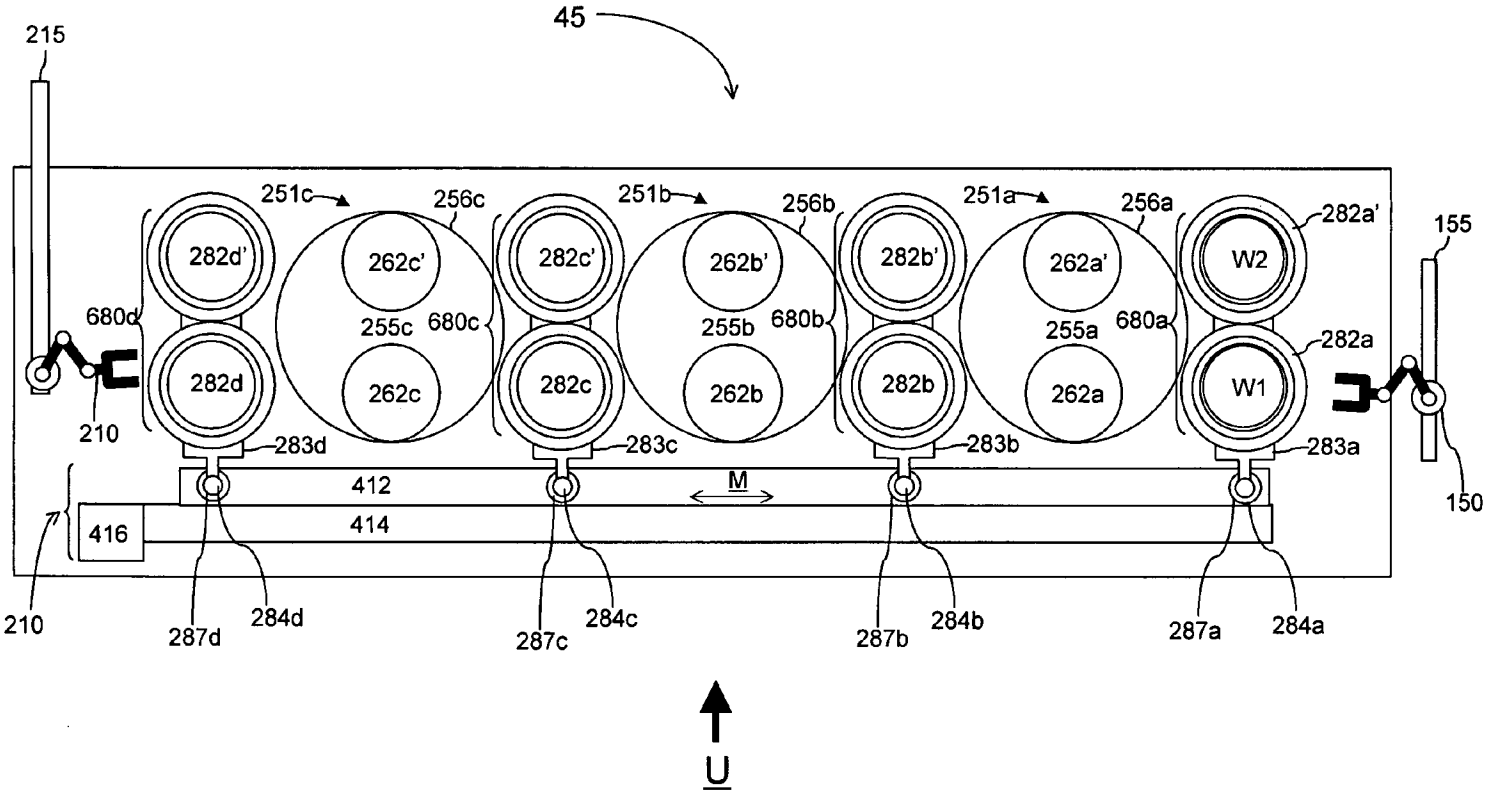

With reference to FIG. 15, a polishing station 45 in accordance with an embodiment of the present invention is described. FIG. 15 shows a top view of the polishing station 45. A side view of the polishing station 45, as viewed in the direction U illustrated in FIG. 15, is similar to the side view of the polishing station 30 illustrated in FIG. 10. The polishing station 45 can be used in the polishing apparatus 10 of FIG. 1 instead of the polishing station 20.

The polishing station 45 can be derived from the polishing station 40 of FIG. 14 by removing the second linear reciprocating mechanism 410' from the polishing station 40 and connecting the load-and-unload cups 282*a*', 282*b*', 282*c*' and 282*d*' to the load-and-unload cups 282*a*, 282*b*, 282*c* and 282*d*, respectively, forming dual wafer relay devices 680*a*–680*d*. Each dual wafer relay device 680 of the polishing station 45 comprises first and second load-and-unload cups 282 and 282', an arm 283, a shaft 284 and a vertical drive mechanism 287. The first and second load-and-unload cups 282 and 282' are connected to the arm 283, which is connected to the shaft 284. The shaft 284 is connected to the vertical drive mechanism 287. The vertical drive mechanisms 287*a*–287*d* of the four dual wafer relay devices 680*a*–680*d* are connected to the linear reciprocating mechanism 410. Vertical motions of the load-and-unload cups 282*a* and 282*a*', 282*b* and 282*b*', 282*c* and 282*c*', and 282*d* and 282*d*' are controlled by the respective vertical drive mechanisms 287*a*, 287*b*, 287*c* and 287*d*. Linear reciprocating motions of the four dual wafer relay devices 680*a*–680*d*, which is illustrated with the arrow M in FIG. 15, are controlled by the linear reciprocating mechanism 410.

A method of processing wafers in the polishing station 45 is described with reference to FIG. 15. First, the first dual wafer relay device 680*a* receives wafers from the first wafer transport device 150 and then transfers them to the wafer carriers 262*a* and 262*a*' of the first polishing unit 251*a* by the linear motion M. After the first dual wafer relay device 680*a* is backed to its parking position, which is located between the first wafer transport device 150 and the first polishing unit 251*a*, the wafer carriers 262*a* and 262*a*' polish the wafers using the polishing pad 255*a* on the polishing table 256*a*.

After the polishing process is completed, the wafer carriers 262*a* and 262*a*' are lifted from the polishing table 256*a* and then the second dual wafer relay device 680*b* transfers the wafers from the wafer carrier 262*a* and 262*a*' to the wafer carrier 262*b* and 262*b*' of the second polishing unit 251*b* by the linear motion M. Next, the second dual wafer relay device 680*b* is moved back to its parking position, which is located between the first and second polishing units 251*a* and 251*b*. Next, the wafer carrier 262*b* and 262*b*' polish the wafers using the polishing pad 255*b* on the second polishing table 256*b*.

After the polishing process is completed, the wafer carrier 262*b* and 262*b*' are lifted from the polishing table 256*b* and then the third dual wafer relay device 680*c* transfers the wafers from the wafer carriers 262*b* and 262*b*' to the wafer carriers 262*c* and 262*c*' by the linear motion M. Next, the third dual wafer relay device 680*c* is moved back to its parking position, which is located between the second and third polishing units 251*b* and 251*c*. Next, the wafer carriers 262*c* and 262*c*' polish the wafers using the polishing pad 255*c* on the third polishing table 256*c*.

After the polishing process is completed, the wafer carriers 262*c* and 262*c*' are lifted from the polishing table 256*c* and then the fourth dual wafer relay device 680*d* transfers the wafers from the wafer carriers 262*c* and 262*c*' to the second wafer transport device 210 by the linear motion M.

In a general form, the polishing station 45 can have N polishing units 251 and N+1 dual wafer relay devices 680, where N is an integer equal to or larger than 2. The first wafer transport device 150 transfers wafers to the first dual wafer relay device 680 and the second wafer transport device 210 removes the wafers from the last dual wafer relay device 680.

The polishing station 45 can be modified such that the first wafer transport device 150 transfer wafers directly to the wafer carriers 262*a* and 262*a*' of the first polishing unit 251*a* by removing the first dual wafer relay device 680*a* from the polishing station 45. Wafers are processed in this modified polishing station from the wafer carriers 262*a* and 262*a*' of the first polishing unit 251*a* through the last dual wafer relay device 680*d* in the same manner as wafers are processed in the polishing station 45, which was described above with reference to FIG. 15. In this modified polishing station, the wafer carriers 262*a* and 262*a*' of the first polishing unit 251*a* can be washed by the dual wafer relay device 680*b*, which can be moved to the wafer carriers 262*a* and 262*a*'.

In a general form, this modified polishing station has N polishing units 251 and N dual wafer relay devices 680, where N is an integer equal to or larger than 2. The first wafer transport device 150 transfers wafers to the wafer carriers 262 of the first polishing unit 251 and the second wafer transport device 210 removes the wafers from the last dual wafer relay device 680.

The polishing station 45 can be also modified such that the second wafer transport device 210 transfer wafers directly from the wafer carriers 262*c* and 262*c*' of the last polishing unit 251*c* by removing the last dual wafer relay device 680*d* from the polishing station 45. Wafers are processed in this modified polishing station from the first dual wafer relay device 680*a* through the wafer carriers 262*c* and 262*c*' of the third polishing unit 251*c* in the same manner as wafers are processed in the polishing station 45, which was described above with reference to FIG. 15. In this modified polishing station, the wafer carriers 262*c* and 262*c*' of the third polishing unit 251*c* can be washed by the dual wafer relay device 680*c*, which can be moved to the wafer carriers 262*c* and 262*c*'.

In a general form, this modified polishing station has N polishing units 251 and N dual wafer relay devices 680, where N is an integer equal to or larger than 2. The first wafer transport device 150 transfers wafers to the first dual wafer relay device 680 and the second wafer transport device 210 removes the wafers from the wafer carriers 262 of the last polishing unit 251.

The polishing station 45 can be further modified such that the first and second wafer transport devices 150 and 210 transfer wafers directly to and from the wafer carriers 262 of the first and last polishing units 251, respectively, by removing the first and last dual wafer relay devices 680*a* and 680*c* from the polishing station 45. Wafers are processed in this modified polishing station from the wafer carriers 262*a* and 262*a*' of the first polishing unit 251*a* to the wafer carriers 262*c* and 262*c*' of the third polishing unit 251*c* in the same manner as wafers are processed in the polishing station 45, which was described above with reference to FIG. 15. In this modified polishing station, the wafer carriers 262*a* and 262*a*' of the first polishing unit 251*a* can be washed by the dual wafer relay device 680*b*, which can be moved to the wafer carriers 262*a* and 262*a*'. Furthermore, the wafer carriers 262*c* and 262*c*' of the third polishing unit 251*c* can be washed by the dual wafer relay device 680*c*, which can be moved to the wafer carriers 262*c* and 262*c*'.

In a general form, this modified polishing station has N polishing units 251 and N−1 dual wafer relay devices 680, where N is an integer equal to or larger than 2. The first wafer transport device 150 transfers wafers to the wafer carriers 262 of the first polishing unit 251 and the second wafer transport device 210 removes the wafers from the wafer carriers 262 of the last polishing unit 251.

Figure 16:
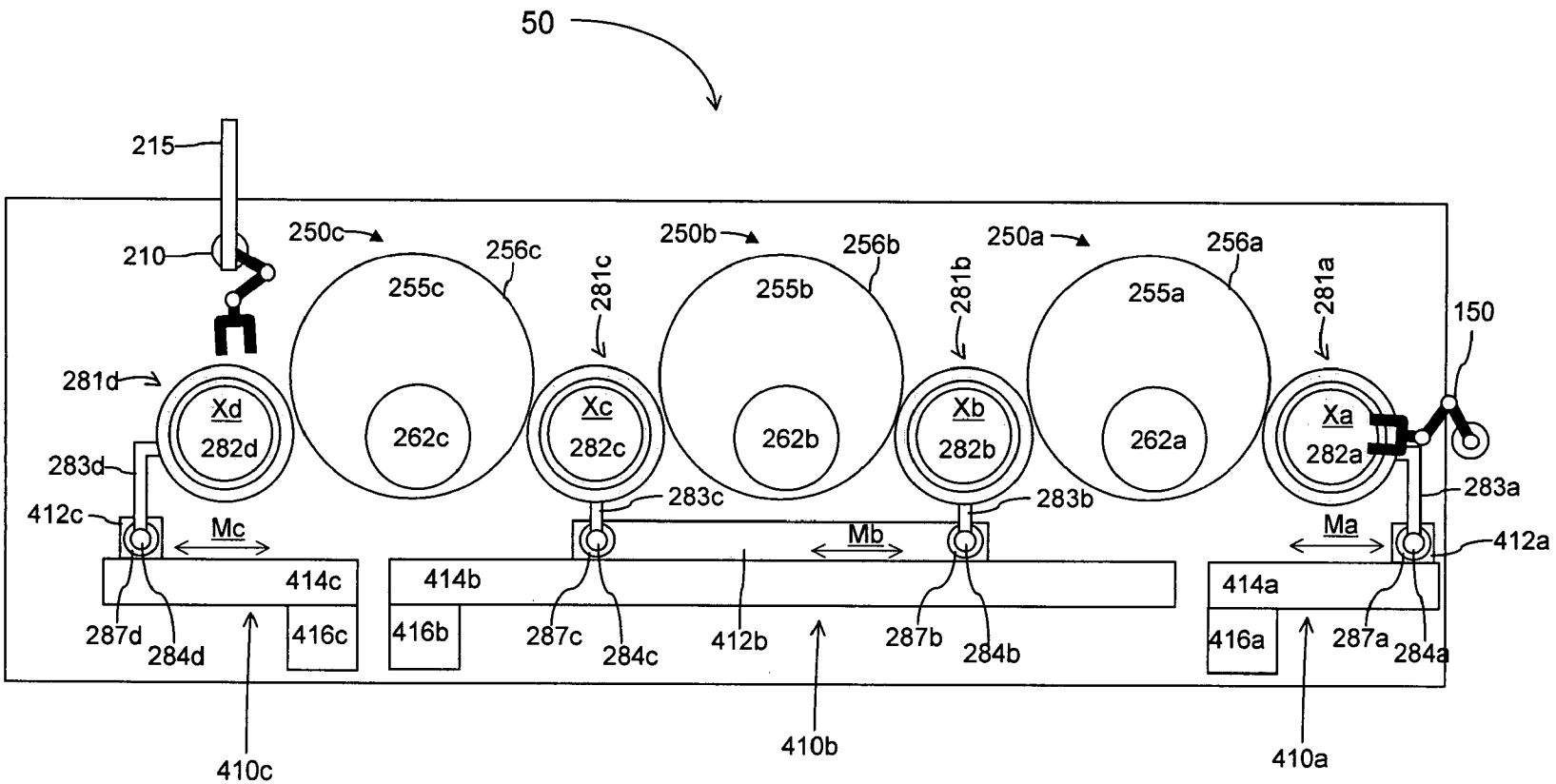

With reference to FIG. 16, a polishing station 50 in accordance with an embodiment of the present invention is described. FIG. 16 is a top view of the polishing station 50. The polishing station 50 can be used in the polishing apparatus 10 of FIG. 1 instead of the polishing station 20.

The polishing station 50 can be derived from the polishing station 30 of FIG. 9 by connecting the first wafer relay device 281*a* of the polishing station 30 to a first linear reciprocating mechanism 410*a*, connecting the second and third wafer relay devices 281*b* and 281*c* of the polishing station 30 to a second linear reciprocating mechanism 410*b* and connecting the fourth wafer relay device 281*d* of the polishing station 30 to a third linear reciprocating mechanism 410*c*.

The first linear reciprocating mechanism 410*a* controls reciprocating motion of the first wafer relay device 281*a* as illustrated with the arrow Ma in FIG. 16. The second linear reciprocating mechanism 410*b* controls reciprocating motions of the second and third wafer relay devices 281*b* and 281*c*, as illustrated with the arrow Mb in FIG. 16. The third linear reciprocating mechanism 410*c* controls reciprocating motion of the fourth wafer relay device 281*d*, as illustrated with the arrow Mc in FIG. 16.

A method of processing wafers in the polishing station 50 is similar to the method of processing wafers in the polishing station 30 of FIG. 9 except that linear reciprocating motions of the first wafer relay device 281*a*, the second and third wafer relay devices 281*b* and 281*c*, and the fourth wafer relay device 281*d* are controlled individually in the polishing station 50.

In a general form, the polishing station 50 can have N polishing units 250 and N+1 wafer relay devices 281, where N is an integer equal to or larger than 2. The first wafer transport device 150 transfers wafers to the first wafer relay device 281 and the second wafer transport device 210 removes the wafers from the last wafer relay device 281.

The polishing station 50 can be modified such that the first wafer transport device 150 transfers wafers directly to the wafer carrier 262*a* of the first polishing unit 250*a* by removing the first wafer relay device 281*a* and the first linear reciprocating mechanism 410*a*. Wafers are processed in this modified polishing station from the wafer carrier 262*a* of the first polishing unit 250*a* through the last wafer relay device 281*d* in the same manner as wafers are processed in the polishing station 50, which was described above with reference to FIG. 16. In this modified polishing station, the wafer carrier 262*a* of the first polishing unit 250*a* can be washed by the wafer relay device 281*b*, which can be moved to the wafer carrier 262*a*.

In a general form, the polishing station 50 can be modified to have N polishing units 250 and N wafer relay devices 281, where N is an integer equal to or larger than 2, such that the first wafer transport device 150 transfers wafers to the wafer carrier of the first polishing unit 250 and the second wafer transport device 210 removes the wafers from the last wafer relay device 281.

The polishing station 50 can be also modified such that the second wafer transport device 210 transfers wafers directly from the wafer carrier 262*c* of the last polishing unit 250*c* by removing the last wafer relay devices 281*c* and the third linear reciprocating mechanism 410*c*. Wafers are processed in this modified polishing station from the first wafer relay device 281*a* through the wafer carrier 262*c* of the third polishing unit 250*c* in the same manner as wafers are processed in the polishing station 50, which was described above with reference to FIG. 16. In this modified polishing station 50, the wafer carrier 262*c* of the third polishing unit 250*c* can be washed by the wafer relay device 281*c*, which can be moved to the wafer carrier 262*c*.

In a general form, the polishing station 50 can be modified to have N polishing unit 250 and N wafer relay devices 281, where N is an integer equal to or larger than 2, such that the first wafer transport device 150 transfers wafers to the first wafer relay device 281 and the second wafer transport device 210 removes the wafers from the wafer carrier 262 of the last polishing unit 250.

The polishing station 50 can be further modified such that the first and second wafer transport devices 150 and 210 transfer wafers directly to and from the wafer carriers 262 of the first and last polishing units 250*a* and 250*c*, respectively, by removing the first and last wafer relay devices 281*a* and 281*c* and the first and third linear reciprocating mechanisms 410*a* and 410*c*. Wafers are processed in this modified polishing station from the wafer carrier 262*a* of the first polishing unit 250*a* to the wafer carrier 262*c* of the third polishing unit 250*c* in the same manner as wafers are processed in the polishing station 50, which was described above with reference to FIG. 16. In this modified polishing station, the wafer carrier 262*a* of the first polishing unit 250*a* can be washed by the wafer relay device 281*b*, which can be moved to the wafer carrier 262*a*. Furthermore, the wafer carrier 262*c* of the third polishing unit 250*c* can be washed by the wafer relay device 281*c*, which can be moved to the wafer carrier 262*c*.

In a general form, the polishing station 50 can be modified to have N polishing unit 250 and N−1 wafer relay device 281, where N is an integer equal to or larger than 2. The first wafer transport device 150 transfers wafers to the wafer carrier 262 of the first polishing unit 250 and the second wafer transport device 210 removes the wafers from the wafer carrier 262 of the last polishing unit 250.

The polishing station 50 of FIG. 16 and its modified embodiments described above can be modified such that each wafer relay device 281 is connected to its own linear reciprocating mechanism 410. In this modified polishing station, each wafer relay device 281 is driven individually by the respective linear reciprocating mechanism 410. This modified polishing station, therefore, comprises the same number of linear reciprocating mechanisms 410 as the number of wafer relay devices 281.

Methods of processing wafers in these modified polishing stations are similar to the methods of processing wafers in the polishing station 30, 35(*a*), 35(*b*) and 35(*c*) of FIGS. 9, 11, 12 and 13 except that linear reciprocating motions of each wafer relay device 281 are controlled individually.

Figure 17:
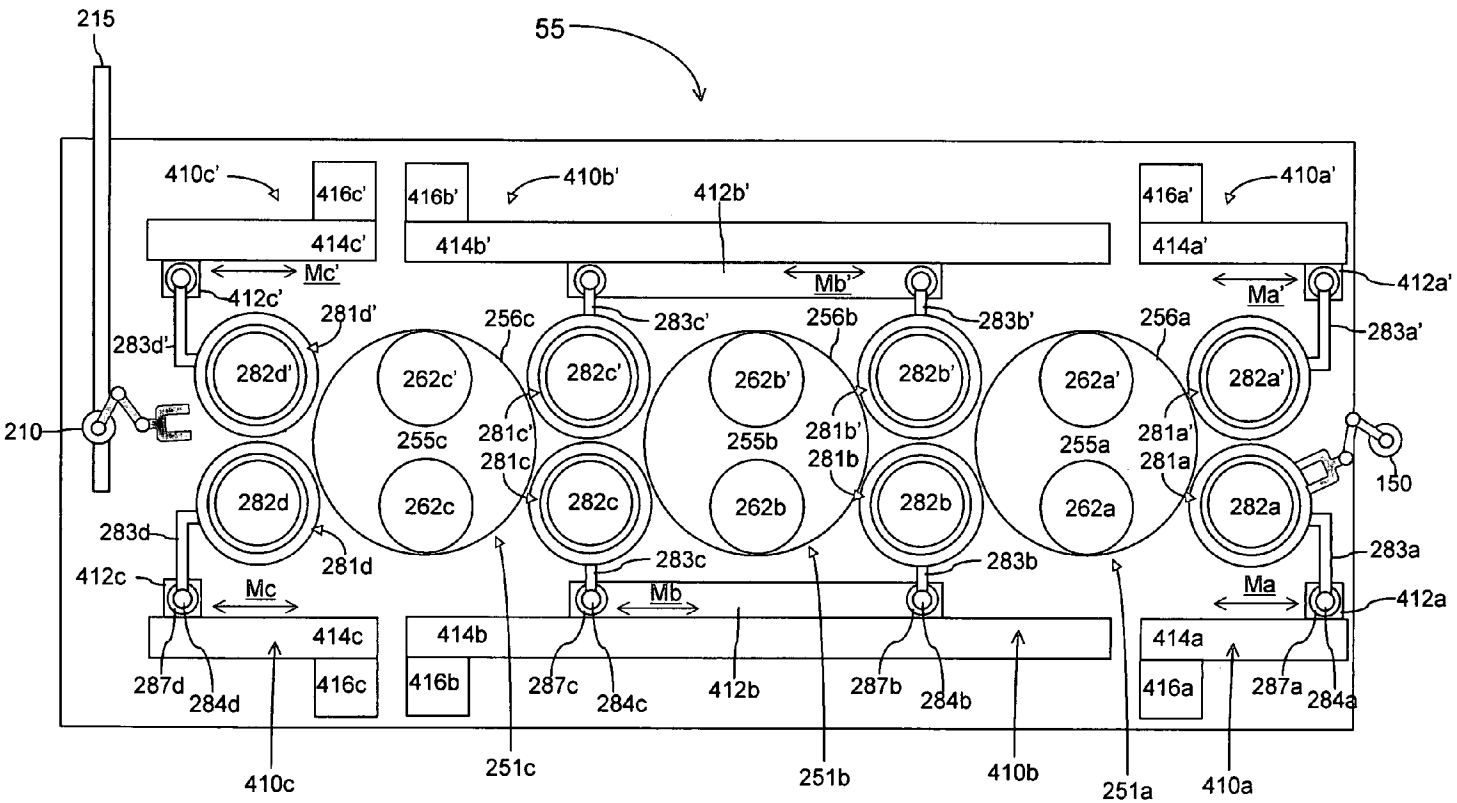

With reference to FIG. 17, a polishing station 55 in accordance with another embodiment of the present invention is described. FIG. 17 is a top view of the polishing station 55. The polishing station 55 can be used in the polishing apparatus 10 of FIG. 1 instead of the polishing station 20.

Configuration of the polishing station 55 is similar to the polishing station 50 of FIG. 16 except that the polishing station 50 further comprises the second set of four wafer relay devices 281*a*'–281*d*' and the second set of three linear reciprocating mechanisms 410*a*'–410*c*' over the first set of four wafer relay devices 281*a*–281*d* and the first set of three linear reciprocating mechanisms 410*a*–410*c* of the polishing station 50 of FIG. 16. Another difference is that the polishing station 55 comprises the polishing units 251*a*, 251*b* and 251*c* instead of the polishing units 250*a*, 250*b* and 250*c*. Each polishing unit 251 comprises a polishing table 256, and first and second wafer carriers 262 and 262'. Although not shown, each polishing unit 251 may also include a pad conditioner 258.

The second set of wafer relay devices 281*a*'–281*d*' are connected to the second set of three linear reciprocating mechanisms 410*a*'–410*c*' in the same manner as the first set of wafer relay devices 281*a*–281*d* are connected to the first set of three linear reciprocating mechanisms 410*a*–410*c* in the polishing station 55 of FIG. 16. The second set of three linear reciprocating mechanisms 410*a*'–410*c*' control reciprocating motions Ma', Mb' and Mc' of the second set of wafer relay devices 281*a*'–281*d*' in the same manner as the first set of three linear reciprocating mechanisms 410*a*–410*c* control the reciprocating motions Ma, Mb and Mc of the first set of wafer relay devices 281*a*–281*d*, as described above with reference to FIG. 16.

The second set of wafer relay devices 281*a*'–281*d*' and the second wafer carriers 262*a*'–262*c*' of the polishing units 251*a*–251*c* transfer and polish wafers in the same manner as the first set of wafer relay devices 281*a*–281*d* and the first wafer carriers 262*a*–262*c* of the polishing units 251*a*–251*c*, as described above with reference to FIG. 16.

A method of processing wafers in the polishing station 55 is similar to the method of processing wafers in the polishing station 40 of FIG. 14 except that linear reciprocating motions of the first wafer relay device 281*a*, the second and third wafer relay devices 281*b* and 281*c*, the fourth wafer relay device 281*d*, the first wafer relay device 281*a*', the second and third wafer relay devices 281*b*' and 281*c*', and the fourth wafer relay device 281*d*' are controlled individually in the polishing station 55.

In a general form, the polishing station 55 can have N polishing units 251 and 2*(N+1) wafer relay devices 281, where N is an integer equal to or larger than 2. The first wafer transport device 150 transfers wafers to the first two wafer relay devices 281 and the second wafer transport device 210 removes the wafers from the last two wafer relay devices 281.

The polishing station 55 can be modified such that the first wafer transport device 150 transfer wafers directly to the wafer carriers 262*a* and 262*a*' of the first polishing unit 251*a* by removing the first wafer relay devices 281*a* and 281*a*' and the first linear reciprocating mechanisms 410*a* and 410*a*'. Wafers are processed in this modified polishing station from the wafer carriers 262*a* and 262*a*' of the first polishing unit 251*a* through the last wafer relay devices 281*d* and 281*d*' in the same manner as wafers are processed in the polishing station 55. In this modified polishing station, the wafer carriers 262*a* and 262*a*' of the first polishing unit 251*a* can be washed by the load-and-unload cups 282*b* and 282*b*', respectively, which can be moved to the wafer carriers 262*a* and 262*a'*.

In a general form, the polishing station 55 can be modified to have N polishing unit 251 and 2*N wafer relay devices 281, where N is an integer equal to or larger than 2, such that the first wafer transport device 150 transfers wafers to the two wafer carriers 262 of the first polishing unit 251 and the second wafer transport device 210 removes the wafers from the last two wafer relay devices 281.

The polishing station 55 can be also modified such that the second wafer transport device 210 removes wafers directly from the wafer carriers 262*c* and 262*c*' of the last polishing unit 251*c* by removing the last wafer relay devices 281*d* and 281*d*' and the third linear reciprocating mechanisms 410*c* and 410*c*', respectively. Wafers are processed in this modified polishing station from the first wafer relay devices 281*a* and 281' through the wafer carriers 262*c* and 262*c*' of the third polishing unit 251*c* in the same manner as wafers are processed in the polishing station 55, which was described above with reference to FIG. 17. In this modified polishing station, the wafer carriers 262*c* and 262*c*' of the third polishing unit 251*c* can be washed by the load-and-unload cups 282*c* and 282*c*', respectively, which can be moved to the wafer carriers 262*c* and 262*c'*.

In a general form, the polishing station 55 can be modified to have N polishing units 251 and 2*N wafer relay devices 281, where N is an integer equal to or larger than 2, such that the first wafer transport device 150 transfers wafers to the first wafer relay devices 281*a* and 281*a*' and the second wafer transport device 210 removes the wafers from the wafer carriers 262 of the last polishing unit 251.

The polishing station 55 can be further modified such that the first and second wafer transport devices 150 and 210 transfer wafers directly to and from the wafer carriers 262 of the first polishing unit 251*a* and the last polishing units 251*c*, respectively, by removing the first wafer relay devices 281*a* and 281*a*', the last wafer relay devices 281*d* and 281*d*', and the first and last linear reciprocating mechanisms 410*a*, 410*a*', 410*c* and 410*c*'.

In a general form, the polishing station 55 can be modified to have N polishing units 251 and 2*(N−1) wafer relay devices 281, where N is an integer equal to or larger than 2. The first wafer transport device 150 transfers wafers to the wafer carriers 262 of the first polishing unit 251 and the second wafer transport device 210 removes the wafers from the wafer carriers 262 of the last polishing unit 251. In this modified polishing station, the wafer carriers 262*a* and 262*a*' of the first polishing unit 251*a* can be washed by the load-and-unload cups 282*b* and 282*b*', respectively, which can be moved to the wafer carriers 262*a* and 262*a*'. Furthermore, the wafer carriers 262*c* and 262*c*' of the third polishing unit 251*c* can be washed by the load-and-unload cups 282*c* and 282*c*', respectively, which can be moved to the wafer carriers 262*c* and 262*c*'.

The polishing station 55 of FIG. 17 and its modified embodiments described above can be modified such that each wafer relay device 281 is connected to its own linear reciprocating mechanism 410. In these modified polishing stations, each wafer relay device 281 is driven individually by the respective linear reciprocating mechanism 410. This modified polishing station, therefore, comprises the same number of the linear reciprocating mechanisms 410 as the number of the wafer relay devices 281.

Methods of processing wafers in these modified polishing stations are similar to the method of processing wafers in the polishing station 55 of FIG. 17 except that linear reciprocating motions of each wafer relay device 281 are controlled individually.

Figure 18:
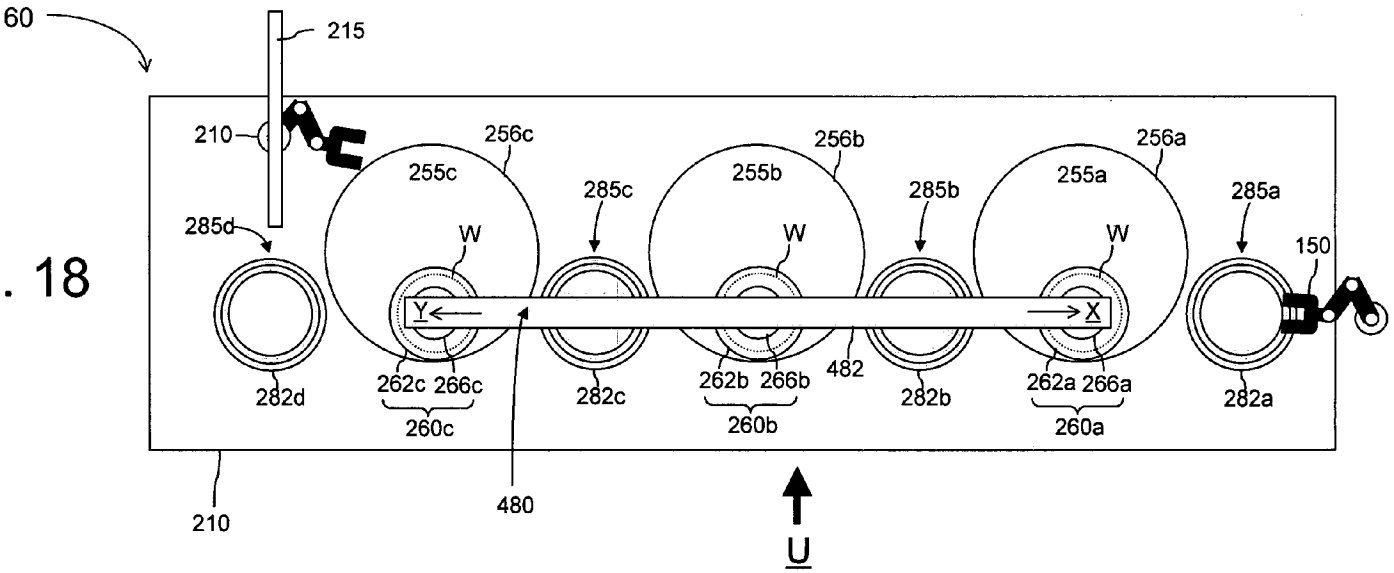
FIGS. 18 and 19 are a top view and a side view of a polishing station, respectively, which can be used in the polishing apparatus of FIG. 1, in accordance with another embodiment of the invention.
Figure 19:
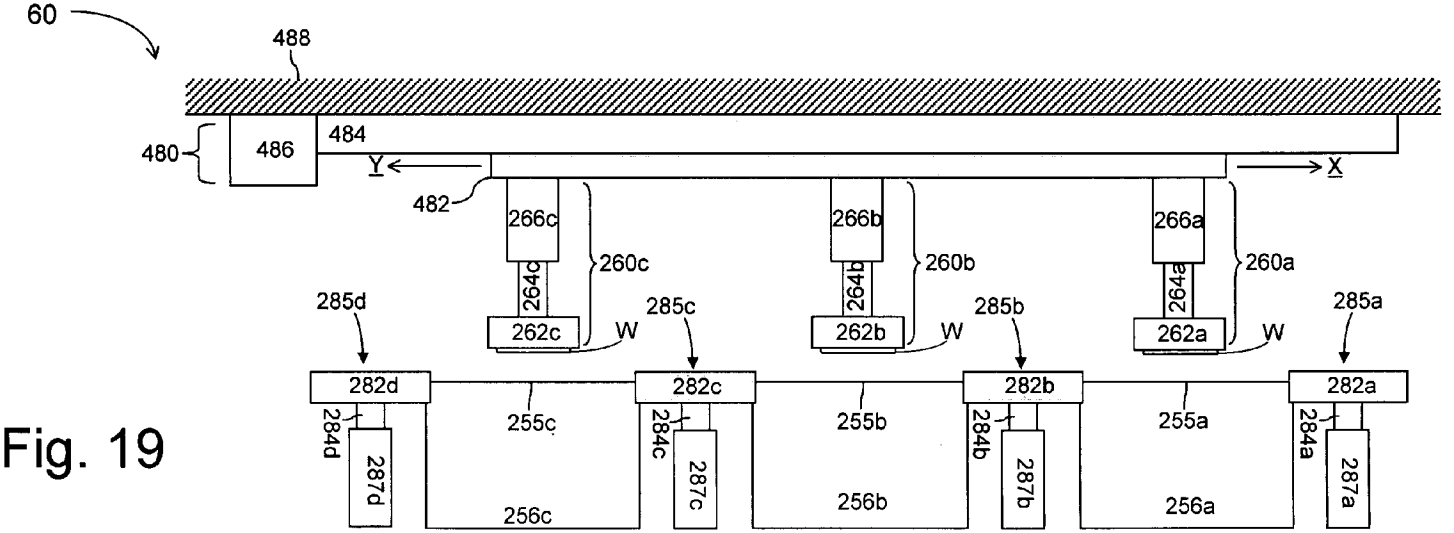

With reference to FIGS. 18 and 19, a polishing station 60 in accordance with another embodiment of the present invention is described. The polishing station 60 can be used in the polishing apparatus 10 instead of the polishing station 20. FIG. 18 shows a top view of the polishing station 60. FIG. 19 is a side view of the polishing station 60, as viewed in the U direction illustrated in FIG. 18.

The polishing station 60 comprises a set of four wafer transfer stations 285*a*–285*d*, three polishing tables 256*a*–256*c*, three wafer carrier assemblies 260*a*–260*c* and a wafer conveying device 480. The region of the polishing station 60 adjacent to the first wafer transport device 150 is an input region of the polishing station to receive wafers into the polishing station. The region of the polishing station 60 adjacent to the second wafer transport device 210 is an output region of the polishing station to output polished wafers from the polishing station. Preferably, the input region and the output region of the polishing station 60 are at opposite ends of the polishing station. The wafer transfer stations 285*a*–285*d* are equally spaced in a linear manner such that one polishing table 256 is situated between two adjacent wafer transfer stations 285. Each wafer transfer station 285 comprises a load-and-unload cup 282, a shaft 284 and a vertical drive mechanism 287, as illustrated in FIG. 19. The load-and-unload cup 282 is mounted on the shaft 284, which is connected to the vertical drive mechanism 287. Therefore, the load-and-unload cup 282 can move vertically by the vertical drive mechanism 287. The load-and-unload cups 282 can wash the wafer carriers 262 by spraying D.I. water when the wafer carriers 262 are positioned on the load-and-unload cups 282.

The polishing tables 256*a*–256*c* are also arranged in a linear manner such that one polishing table 256 is situated between two adjacent wafer transfer stations 285. The first, second and third wafer carriers 262*a*, 262*b* and 262*c* polish wafers using polishing pads 255*a*–255*c* on the first, second and third polishing tables 256*a*–256*c*, respectively.

Figure 20A:
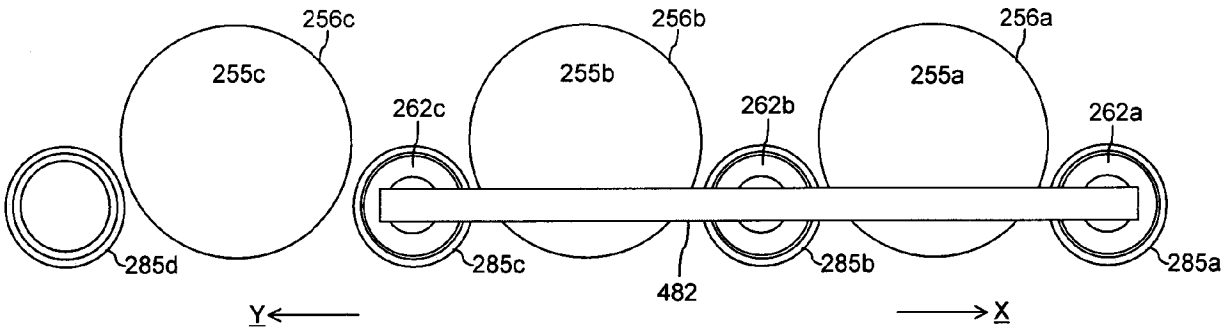
FIGS. 20(*a*) and (*b*) are top views of the polishing station of FIG. 18, illustrating wafer loading and unloading processes, respectively.
Figure 20B:
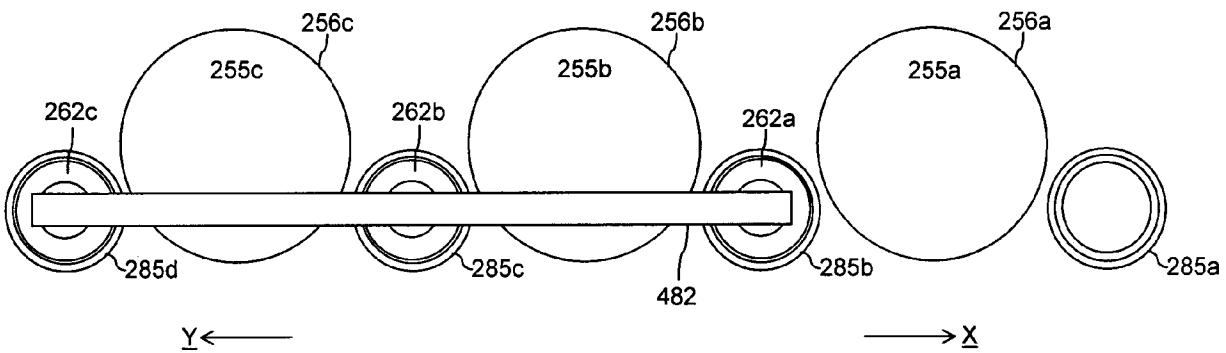
Figure 21A:
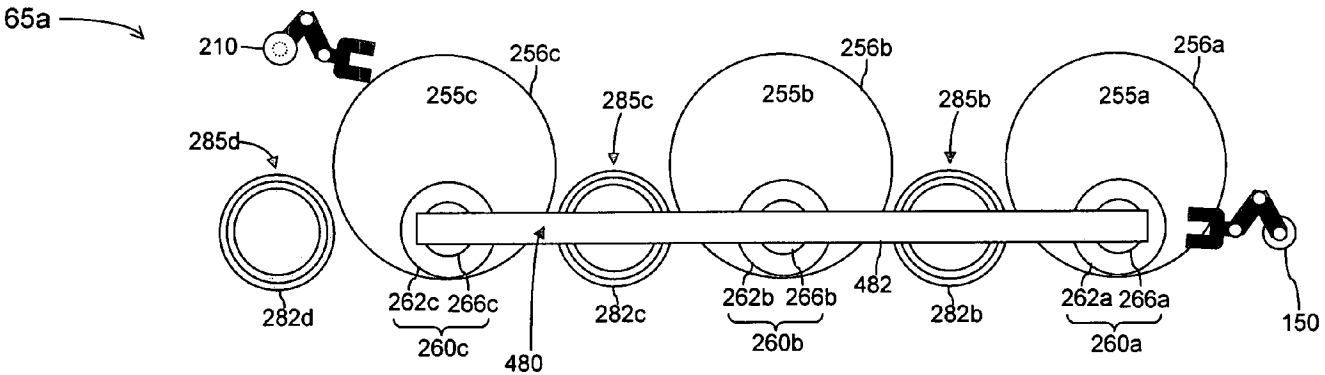
FIGS. 21(*a*)–(*c*) are top views of polishing stations, which can be used in the polishing apparatus of FIG. 1, in accordance with other embodiments of the invention.
Figure 21B:
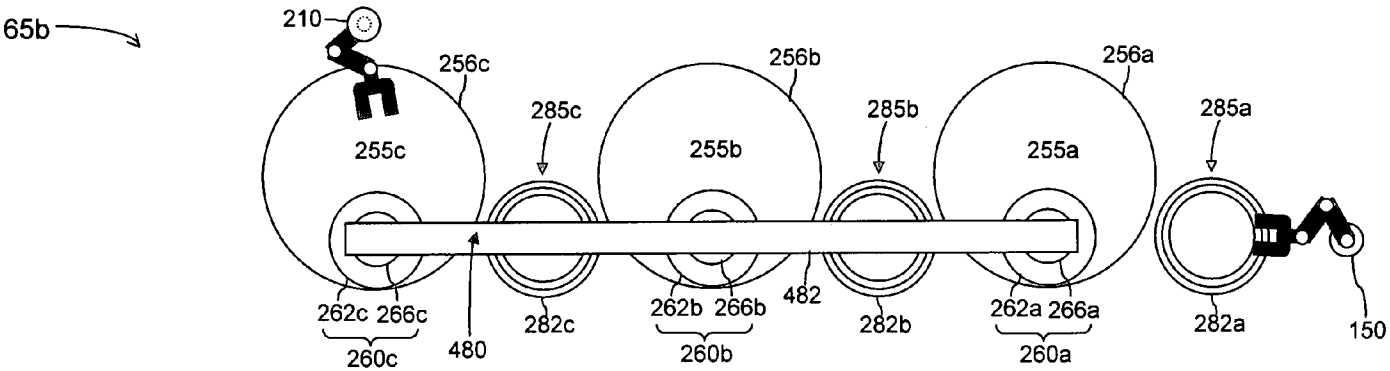
Figure 21C:
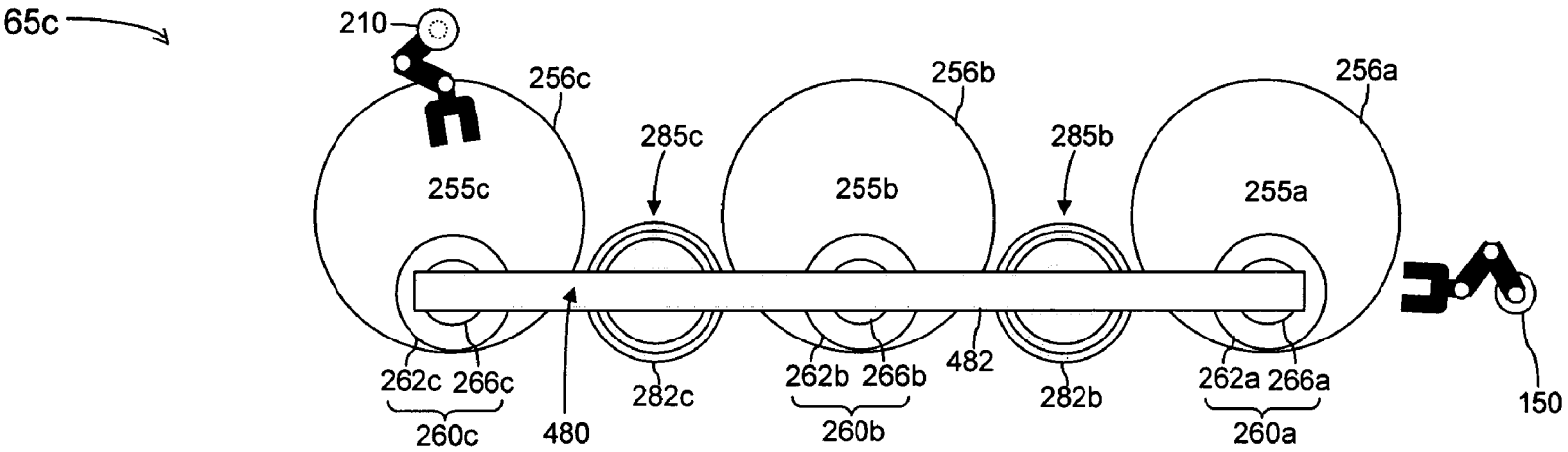

The wafer conveying device 480 comprises a conveyer 482, a conveying track 484 and a reciprocating drive mechanism 486. The three wafer carrier assemblies 260*a*–260*c* are mounted to the conveyer 482 such that the wafer carriers 262 are equally spaced. The distance between the neighboring two wafer carriers 262 is set to be same as the distance between the neighboring two wafer transfer stations 285 such that the wafer carriers 262*a*–262*c* can be positioned simultaneously on the wafer transfer stations 285*a*–285*c* or 285*b*–285*d*. The conveyer 482 is mounted on the conveying track 484, which is connected to the reciprocating drive mechanism 486. The reciprocating drive mechanism 486 moves the wafer carrier assemblies 260*a*–260*c* back and forth in a linear manner by reciprocating the conveyer 482 along the conveying track 484. The forward and backward linear motions are designated as X and Y, respectively, as illustrated in FIGS. 20 and 21. The conveying track 484 is mounted to a top housing 488 of the polishing station 60.

A method of processing wafers in the polishing station 60 is described with reference to FIGS. 18, 20(*a*) and 20(*b*). FIGS. 20(*a*) and 20(*b*) are top views of the polishing station 60 where wafer carriers 262 are positioned in wafer loading positions and wafer unloading positions, respectively. FIG. 20(*a*) illustrates a wafer loading process. FIG. 20(*b*) illustrates a wafer unloading process. First, the wafer carriers 262*a*–262*c* are temporarily positioned over the polishing tables 256*a*, 256*b* and 256*c*, respectively, as illustrated in FIG. 18. The first wafer is supplied to the first wafer transfer station 285*a* by the first wafer transport device 150.

Next, the wafer carriers 262*a*, 262*b* and 262*c* are transferred to respective wafer loading positions that are located over the wafer transfer stations 285*a*–285*c*, respectively, by the forward linear motion X of the conveyer 482, as illustrated in FIG. 20(*a*). The first wafer is loaded from the first wafer transfer station 285*a* onto the first wafer carrier 262*a*.

Next, the wafer carriers 262*a*–262*c* are transferred to the respective wafer polishing positions over the polishing tables 256*a*–256*c*, respectively, by the backward linear motion Y of the conveyer 482, as illustrated in FIG. 18. The first wafer carrier 262*a* polishes the first wafer using the polishing pad 255*a* on the first polishing table 256*a*. After the polishing process of the first wafer is completed, the first wafer carrier 262*a* is lifted from the polishing table 256*a*.

Next, the wafer carriers 262*a*–262*c* are transferred to the respective wafer unloading positions that are located over the wafer transfer stations 285*b*–285*d*, respectively, by the backward linear motion Y of the conveyer 482, as illustrated in FIG. 20(*b*). The first wafer is unloaded from the first wafer carrier 262*a* to the second wafer transfer station 285*b*.

Next, the wafer carriers 262*a*–262*c* are transferred again to the respective wafer loading positions by the forward linear motion X of the conveyer 482, as illustrated in FIG. 20(*a*). The first wafer is loaded from the second wafer transfer station 285*b* onto the second wafer carrier 262*b*.

Next, the wafer carriers 262*a*–262*c* are transferred to the respective wafer polishing positions again by the backward linear motion Y of the conveyer 482, as illustrated in FIG.

18. The second wafer carrier 262*b* polishes the first wafer using the polishing pad 255*b* on the second polishing table 256*b*. After the polishing process of the first wafer is completed, the second wafer carrier 262*b* is lifted from the polishing tables 256*b*.

Next, the wafer carriers 262*a*–262*c* are transferred to the respective wafer unloading positions again by the backward linear motion Y of the conveyer 482, as illustrated in FIG. 20(*b*). The first wafer is unloaded from the second wafer carrier 262*b* to the third wafer transfer station 285*c*.

Next, the wafer carriers 262*a*–262*c* are transferred to the respective wafer loading positions again by the forward linear motion X of the conveyer 482, as illustrated in FIG. 20(*a*). The first wafer is loaded from the third wafer transfer station 285*c* onto the third wafer carrier 262*c*.

Next, the wafer carriers 262*a*–262*c* are transferred to the respective wafer polishing positions by the backward linear motion Y of the conveyer 482, as illustrated in FIG. 18. The third wafer carrier 262*c* polishes the first wafer by using the polishing pad 255*c* on the third polishing table 256*c*. After the polishing process of the first wafer is completed, the third wafer carrier 262*c* is lifted from the polishing table 256*c*.

Next, the wafer carriers 262*a*–262*c* are transferred to the respective wafer unloading positions again by the backward linear motion Y of the conveyer 482, as illustrated in FIG. 20(*b*). The first wafer is unloaded from the third wafer carrier 262*c* to the fourth wafer transfer stations 285*d*.

Next, the wafer carriers 262*a*–262*c* are transferred to the respective wafer loading positions again by the forward linear motion X of the conveyer 482, as illustrated in FIG. 20(*a*). The first wafer is removed from the fourth wafer transfer station 285*d* by the second wafer transport device 210. In this fashion, wafers can be sequentially polished on the polishing tables 256*a*–256*c* one after another.

In a general form, the polishing station 60 comprises N polishing tables 256, N+1 wafer transfer stations 285, a wafer conveying device 480 and N wafer carriers 262, where N is an integer equal to or larger than 2. The first wafer transport device 150 transfers wafers to be polished to the first wafer transfer station 285 of the N+1 wafer transfer stations 285 and the second wafer transport device 210 transfers polished wafers from the last wafer transfer station 285 of the N+1 wafer transfer stations 285.

With reference to FIGS. 21(*a*), 21(*b*) and 21(*c*), polishing stations 65*a*, 65*b* and 65*c* in accordance with other embodiments of the present invention are described. Any of these polishing stations can be used in the polishing apparatus 10 of FIG. 1 instead of the polishing station 20. FIG. 21(*a*), 21(*b*) and 21(*c*) are top views of the polishing stations 65*a*, 65*b* and 65*c*, respectively.

The polishing station 65*a* of FIG. 21(*a*) can be derived from the polishing station 60 by removing the first wafer transfer station 285*a*. In this polishing station 65*a*, the first wafer transport device 150 transfers wafers directly to the first wafer carrier 262*a*. Wafers are processed in the polishing station 65*a* from the first wafer carrier 262*a* through the last wafer transfer station 285*d* in the same manner as wafers are processed in the polishing station 60, which was described above. In the polishing station 65*a*, the first wafer carrier 262*a* can be washed at the wafer transfer station 285*b* that is located between the first and second polishing tables 256*a* and 256*b*.

The polishing station 65*b* of FIG. 21(*b*) can be derived from the polishing station 60 by removing the last wafer transfer station 285*d*. Therefore, the second wafer transport device 210 transfers wafers directly from the wafer carrier 262*c*. Wafers are processed in the polishing station 65*b* from the first wafer transfer station 285*a* through the last wafer carrier 262*c* in the same manner as wafers are processed in the polishing station 60, which was described above. In the polishing station 65*b*, the third wafer carrier 262*c* can be washed at the wafer transfer station 285*c* that is located between the second and third polishing tables 256*b* and 256*c*.

The polishing station 65*c* of FIG. 21(*c*) can be derived from the polishing station 60 by removing the first and last wafer transfer stations 285*a* and 285*d*. In this polishing station 65*c*, the first wafer transport device 150 loads wafers directly onto the first wafer carrier 262*a* and the second wafer transport device 210 removes wafers directly from the last wafer carrier 262*c*. Wafers are processed in the polishing station 65*c* from the first wafer carrier 262*a* through the last wafer carrier 262*c* in the same manner as wafers are in the polishing station 60, which was described above. In the polishing station 65*c*, the first wafer carrier 262*a* can be washed at the wafer transfer station 285*b* that is located between the first polishing table 256*a* and the second polishing table 256*b*. Furthermore, the third wafer carrier 262*c* can be washed at the wafer transfer station 285*c* that is located between the second polishing table 256*b* and the third polishing table 256*c*.

In a general form, the polishing stations 65*a* and 65*b* can have N polishing tables 256, N wafer carriers 262 and N wafer transfer stations 285, where N is an integer equal to or larger than 2. The polishing station 65*c* has N polishing tables 256, N wafer carriers 262 and N−1 wafer transfer stations 285. In the polishing stations 65*a* and 65*c*, the first wafer carrier 262 receives wafers directly from the first wafer transport device 150. In the polishing stations 65*b* and 65*c*, the last wafer carrier 262 unloads wafers directly to the second wafer transport device 210.

Figure 22:
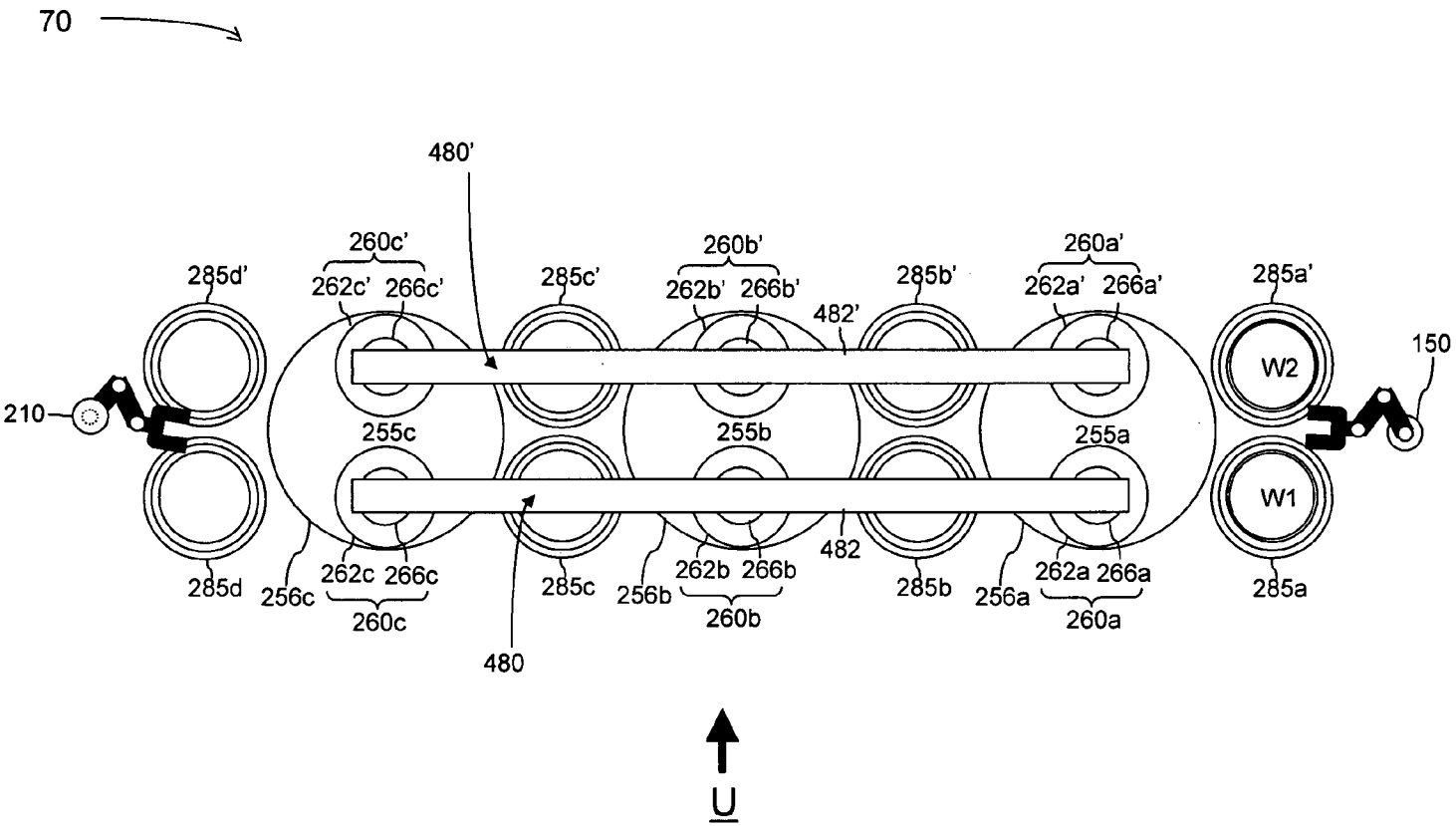
FIG. 22 is a top view of a polishing station, which can be used in the polishing apparatus of FIG. 1, in accordance with another embodiment of the invention.

With reference to FIG. 22, a polishing station 70 in accordance with another embodiment of the present invention is described. FIG. 22 is a top view of the polishing station 70. A side view of the polishing station 70, as viewed in the direction U illustrated in FIG. 22, is similar to the side view of the polishing station 60 illustrated in FIG. 19. The polishing station 70 can be used in the polishing apparatus 10 of FIG. 1 instead of the polishing station 20. The polishing station 70 is modified from the polishing station 60 illustrated in FIG. 18 by adding a second wafer conveying device 480', a second set of four wafer transfer stations 285*a*'–285*d*', and a second set of three wafer carrier assemblies 260*a*'–260*c*' to the polishing station 60.

The second set of wafer transfer stations 285*a*'–285*d*' are arranged in the same manner as the first set of wafer transfer stations 285*a*–285*d* are arranged relatively to the polishing tables 256*a*, 256*b* and 256*c*. The second set of three wafer carriers 262*a*'–262*c*' can move in a reciprocating manner by the second wafer conveying device 480' similar to the way the first set of three wafer carriers 262*a*–262*c* can move in a reciprocating manner by the first wafer conveying device 480. The second wafer conveying device 480' is arranged in a parallel manner to the first wafer conveying device 480 such that the second set of three wafer carriers 262*a*'–262*c*' can polish wafers on the first, second and third polishing tables 256*a*–256*c*, respectively. The second wafer conveying device 480' transfers wafers in the same manner as the first wafer conveying device 480. The first and second conveying devices 480 and 480' can be operated individually or collectively.

In the individual manner, first and second wafers W1 and W2 to be polished are supplied to the first two wafer transfer stations 285*a* and 285*a*' of the first and second sets of wafer transfer stations 285, respectively, by the first wafer transport device 150, as illustrated in FIG. 22. Next, the first wafer W1 is transferred from the first wafer transfer station 285*a* to the first wafer carrier 262*a* and then polished on the polishing tables 256 according to the sequence described above with reference to FIGS. 18, 20(*a*) and 20(*b*). After the first wafer W1 is transferred from the first wafer transfer station 285*a*, the second wafer W2 is transferred from the first wafer transfer station 285*a*' to the first wafer carrier 262*a*' and then polished on the polishing tables 256 according to the same sequence described above with reference to FIGS. 18, 20(*a*) and 20(*b*). 3'rd, 5 'th, . . . and (2N−1)'th wafers are processed in the same manner as the first wafer W1. 4'th, 6'th, . . . and 2N'th wafers are processed in the same manner as the second wafer W2.

In the collective manner, the first and second wafers W1 and W2 are simultaneously transferred from the first two wafer transfer stations 285*a* and 285*a*' to the first wafer carriers 262*a* and 262*a*', respectively, and then simultaneously polished on the polishing tables 256 according to the sequence described above with reference to FIGS. 18, 20(*a*) and 20(*b*).

In the polishing station 70 of FIG. 22, the conveyers 482 and 482' of the first and second wafer conveying devices 480 and 480' can be connected using a connector (not shown) such that their reciprocating motions are controlled collectively by a single reciprocating drive mechanism.

In a general form, the polishing station 70 comprises N polishing tables 256, two sets of N wafer carriers 262, two sets of N+1 wafer transfer stations 285 and at least one wafer conveying device 480, where N is an integer equal to or larger than 2. The first wafer transport device 150 transfers wafers to the first two wafer transfer stations 285 and the second wafer transport device 210 removes the wafers from the last two wafer transfer stations 285.

The polishing station 70 of FIG. 22 can be modified such that the first wafer transport device 150 transfer wafers directly to the first wafer carriers 262*a* and 262*a*' by removing the first two wafer transfer stations 285*a* and 285*a*' from the polishing station 70. Wafers are processed in this modified polishing station from the first two wafer carriers 262*a* and 262*a*' through the last two wafer transfer stations 285*d* and 285*d*' in the same manner as wafers are processed in the polishing station 70, which was described above with reference to FIG. 22. In this modified polishing station, the first two wafer carriers 262*a* and 262*a*' can be washed at the wafer transfer stations 285*b* and 285*b*' that are located between the first polishing table 256*a* and the second polishing table 256*b*.

In a general form, this modified polishing station comprises N polishing tables 256, two sets of N wafer carriers 262, two sets of N wafer transfer stations 285 and at least one wafer conveying device 480, where N is an integer equal to or larger than 2. The first wafer transport device 150 transfers wafers to the first two wafer carriers 262 and the second wafer transport device 210 removes the wafers from the last two wafer transfer stations 285.

The polishing station 70 of FIG. 22 can be also modified such that the second wafer transport device 210 transfers wafers directly from the last wafer carriers 262*c* and 262*c*' by removing the last wafer transfer stations 285*d* and 285*d*'. Wafers are processed in this modified polishing station from the first two wafer transfer stations 285*a* and 285*a*' through the third two wafer carriers 262*c* and 262*c*' in the same manner as wafers are processed in the polishing station 70, which was described above with reference to FIG. 22. In this modified polishing station, the third wafer carriers 262*c* and 262*c*' can be washed at the wafer transfer stations 285*c* and 285*c*' that are located between the second and third polishing tables 256*b* and 256*c*.

In a general form, this modified polishing station comprises N polishing tables 256, two sets of N wafer carriers 262, two sets of N wafer transfer stations 285 and at least one wafer conveying device 480, where N is an integer equal to or larger than 2. The first wafer transport device 150 transfers wafers to the first two wafer transfer stations 285 and the second wafer transport device 210 removes the wafers from the last two wafer carriers 262.

The polishing station 70 of FIG. 22 can be further modified such that the first wafer transport device 150 transfers wafers directly to the first two wafer carriers 262*a* and 262*a*' and the second wafer transport device 210 removes the wafers directly from the last two wafer carriers 262*c* and 262*c*' by removing the first two and the last two wafer transfer stations 285*a*, 285*a*', 285*d* and 285*d*'. Wafers are processed in this modified polishing station from the first two wafer carriers 262*a* and 262*a*' through the third two wafer carriers 262*c* and 262*c*' in the same manner as wafers are processed in the polishing station 70, which was described above with reference to FIG. 22. In this modified polishing station, the first wafer carriers 262*a* and 262*a*' can be washed at the wafer transfer stations 285*b* and 285*b*' that are located between the first and second polishing tables 256*a* and 256*b*. Furthermore, the third wafer carriers 262*c* and 262*c*' can be washed at the wafer transfer stations 285*c* and 285*c*' that are located between the second and third polishing tables 256*b* and 256*c*.

In a general form, this modified polishing station comprises N polishing tables 256, two sets of N wafer carriers 262, two sets of (N−1) wafer transfer stations 285 and at least one wafer conveying device 480, where N is an integer equal to or larger than 2. The first wafer transport device 150 transfers wafers to the first two wafer carriers 262 and the second wafer transport device 210 removes the wafers from the last two wafer carriers 262.

Figure 23:
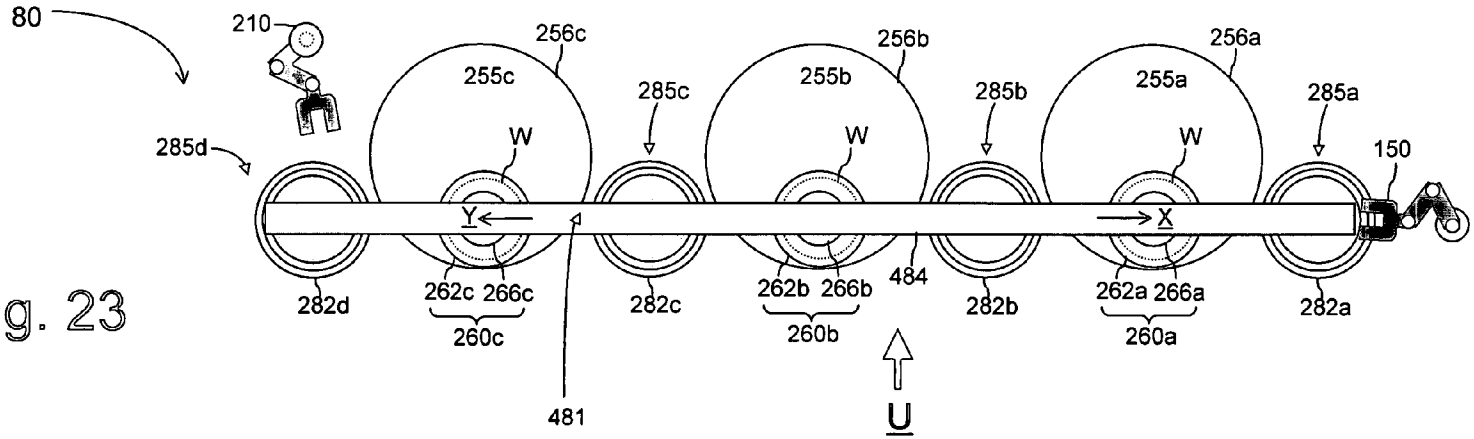
FIGS. 23 and 24 are a top view and a side view of a polishing station, which can be used in the polishing apparatus of FIG. 1, in accordance with another embodiment of the invention.
Figure 24:
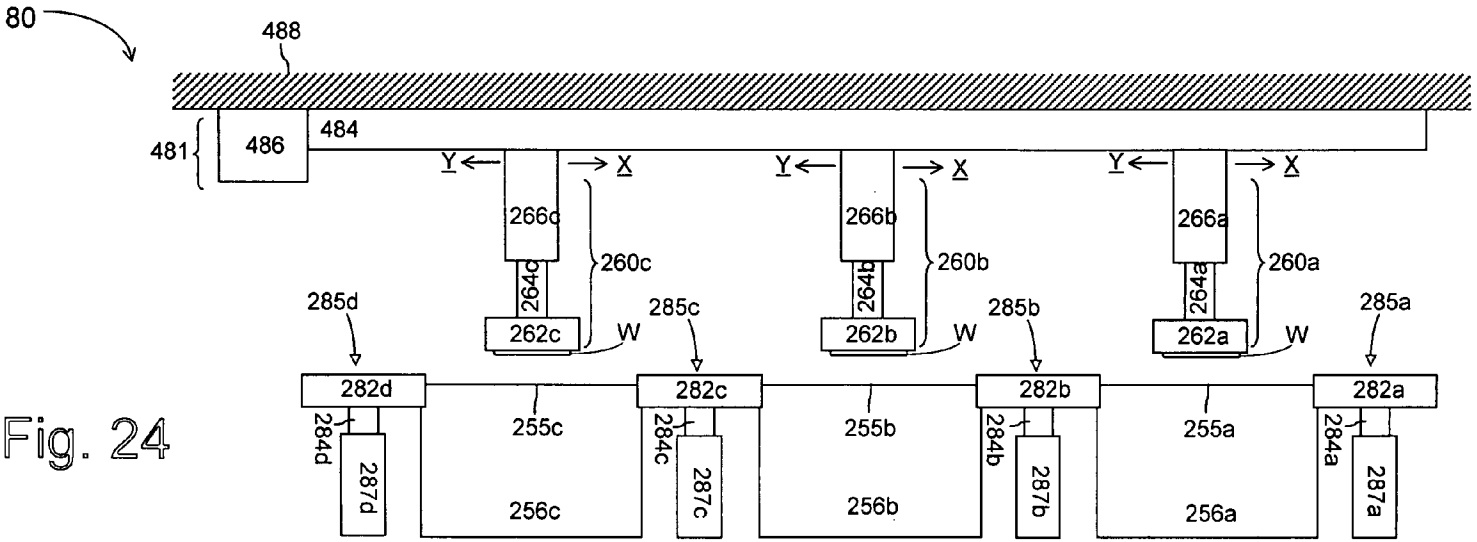

With reference to FIGS. 23 and 24, a polishing station 80 in accordance with another embodiment of the present invention is described. The polishing station 80 can be used in the polishing apparatus 10 of FIG. 1 instead of the polishing station 20. FIG. 23 is a top view of the polishing station 80. FIG. 24 is a side view of the polishing station 80, as viewed in the direction U illustrated in FIG. 23. The polishing station 80 is similar to the polishing station 60 described with reference to FIGS. 18 and 19 except that each wafer carrier assembly 260 can move between adjacent two wafer transfer stations 285 individually by a wafer conveying device 481.

The wafer conveying device 481 comprises a conveying track 484 and a reciprocating drive mechanism 486, as illustrated in FIG. 24. The three wafer carrier assemblies 260 are mounted on the conveying track 484, which is connected to the reciprocating drive mechanism 486. The reciprocating drive mechanism 486 moves the wafer carrier assemblies 260 back and forth in a linear manner along the conveying track 484. The forward and backward linear motions are designated as X and Y, respectively, as illustrated in FIGS. 23 and 24. The conveying track 484 is mounted to a top housing 488 of the polishing station 80.

A method of processing wafers in the polishing station 80 is described with reference to FIG. 23. First, a first wafer is supplied to the first wafer transfer station 285*a* by the first wafer transport device 150 and then the first wafer carrier 262*a* is transferred to the first wafer transfer station 285*a* by its forward linear motion X along the conveying track 484. Next, the first wafer is loaded from the first wafer transfer station 285*a* onto the first wafer carrier 262*a* and then the first wafer carrier 262*a* is transferred to the first polishing table 256*a* by its backward linear motion Y. Next, the first wafer carrier 262*a* polishes the first wafer using the polishing pad 255*a* on the first polishing table 256*a*.

Next, after the polishing process of the first wafer is completed, the first wafer carrier 262*a* is lifted from the polishing table 256*a* and then the first wafer carrier 262*a* is transferred to the second wafer transfer station 285*b* by the backward linear motion Y along the conveying track 484. Next, the first wafer W1 is unloaded from the first wafer carrier 262*a* to the second wafer transfer station 285*b*. Next, the first wafer carrier 262*a* is transferred to the first wafer transfer station 285*a* to pick the next wafer to be polished and then the second wafer carrier 262*b* is transferred to the second wafer transfer station 285*b* by its forward linear motions X along the conveying track 484.

Next, the first wafer is loaded from the second wafer transfer station 285*b* onto the second wafer carrier 262*b* and then the second wafer carrier 262*b* is transferred to the second polishing table 256*b* by its backward linear motions Y along the conveying track 484. Next, the second wafer carrier 262*b* polishes the first wafer using the polishing pad 255 on the second polishing table 256*b*.

Next, after the polishing process of the first wafer is completed, the second wafer carrier 262*b* is lifted from the second polishing table 256*b* and then transferred to the third wafer transfer station 285*c* by its backward linear motion Y along the conveying track 484. Next, the first wafer is unloaded from the second wafer carrier 262*b* to the third wafer transfer station 285*c*.

Next, the second wafer carrier 262*b* is transferred to the second wafer transfer station 285*b* to pick the next wafer and then the third wafer carrier 262*c* is transferred to the third wafer transfer station 285*c* by their forward linear motions X along the conveying track 484. Next, the first wafer is loaded from the third wafer transfer station 285*c* onto the third wafer carrier 262*c* and then the third wafer carrier 262*c* is transferred to the third polishing table 256*c* by its backward linear motion Y along the conveying track 484. Next, the third wafer carrier 262*c* polishes the first wafer using the polishing pad 255*c* on the third polishing table 256*c*.

Next, after the polishing process is completed, the third wafer carrier 262*c* is lifted from the polishing table 256*c* and then the third wafer carrier 262*c* is transferred to the fourth wafer transfer station 285*d* by its backward linear motion Y along the conveying track 484. Next, the first wafer is unloaded from the third wafer carrier 262*c* to the fourth wafer transfer station 285*d* and then the third wafer carrier is transferred to the third wafer transfer station 285*c* to pick the next wafer. Next, the first wafer is removed from the fourth wafer transfer station 285*d* by the second wafer transfer device 210. In this fashion, wafers can be sequentially polished on the polishing tables 256*a*–256*c* one after another.

In a general form, the polishing station 80 comprises N polishing tables 256, N wafer carriers 262, N+1 wafer transfer stations 285 and a wafer conveying device 481, where N is an integer equal to or larger than 2. The first wafer transport device 150 transfers wafers to the first wafer transfer station 285 and the second wafer transport device 210 removes the wafers from the last wafer transfer station 285.

Figure 25A:
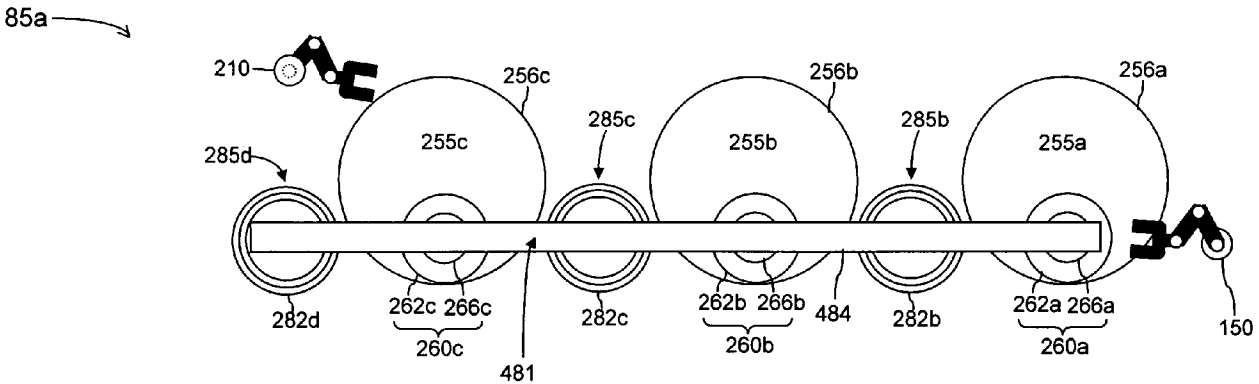
FIGS. 25(*a*)–(*c*) are top views of polishing stations, which can be used in the polishing apparatus of FIG. 1, in accordance with other embodiments of the invention.
Figure 25B:
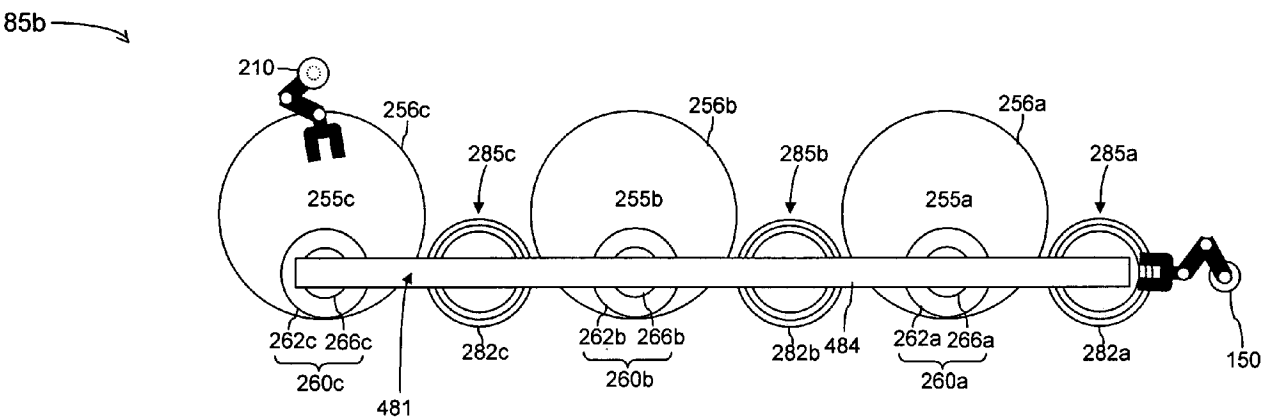
Figure 25C:
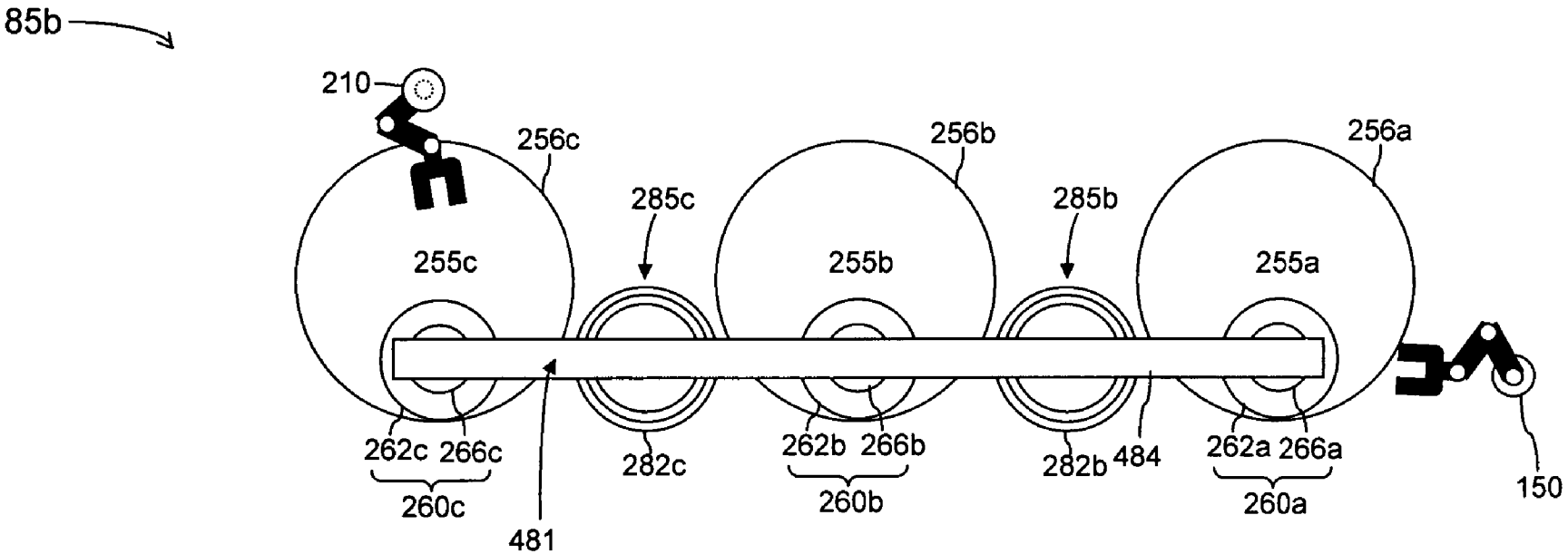

With reference to FIGS. 25(*a*)–25(*c*), polishing stations 85*a*–85*c* in accordance with other embodiments of the present invention are described. Any of these polishing stations can be used in the polishing apparatus 10 of FIG. 1 instead of the polishing station 20. FIGS. 25(*a*)–25(*c*) are top views of the polishing stations 85*a*–85*c*, respectively.

The polishing station 85*a* of FIG. 25(*a*) can be derived from the polishing station 80 of FIG. 23 by removing the first wafer transfer station 285*a*. In the polishing station 85*a*, the first wafer transport device 150 transfers wafers directly to the first wafer carrier 262*a*. Wafers are processed in the polishing station 85*a* from the first wafer carrier 262*a* through the last wafer transfer station 285*d* in the same manner as wafers are processed in the polishing station 80, which was described above with reference to FIG. 23. In the polishing station 85*a*, the first wafer carrier 262*a* can be washed at the wafer transfer station 285*b* that is located between the first polishing table 256*a* and the second polishing table 256*b*.

In a general form, the polishing station 85*a* can comprise N polishing tables 256, N wafer carriers 262, N wafer transfer stations 285 and a wafer conveying device 481, where N is an integer equal to or larger than 2. The first wafer transport device 150 transfers wafers to the first wafer carrier 262 and the second wafer transport device 210 removes the wafers from the last wafer transfer station 285.

The polishing station 85*b* of FIG. 25(*b*) can be derived from the polishing station 80 of FIG. 23 by removing the last wafer transfer station 285*d*. In the polishing station 85*b*, the second wafer transport device 210 removes wafers directly from the third wafer carrier 262*c*. Wafers are processed in the polishing station 85*b* from the first wafer transfer station 285*a* through the third wafer carrier 262*c* in the same manner as wafers are processed in the polishing station 80, which was described above with reference to FIG. 23. In the polishing station 85*b*, the third wafer carrier 262*c* can be washed at the wafer transfer station 285*c* that is located between the second and third polishing tables 256*b* and 256*c*.

In a general form, the polishing station 85*b* can comprise N polishing tables 256, N wafer carriers 262, N wafer transfer stations 285 and a wafer conveying device 481, where N is an integer equal to or larger than 2. The first wafer transport device 150 transfers wafers to the first wafer transfer station 285 and the second wafer transport device 210 removes the wafers from the last wafer carrier 262.

The polishing station 85*c* of FIG. 25(*c*) can be derived from the polishing station 80 of FIG. 23 by removing the first and last wafer transfer stations 285*a* and 285*d*. In the polishing station 85*c*, the first wafer transport device 150 transfers wafers directly to the first wafer carrier 262*a* and the second wafer transport device 210 removes the wafers directly from the third wafer carrier 262*c*. Wafers are processed in the polishing station 85*c* from the first wafer carrier 262*a* through the third wafer carrier 262*c* in the same manner as wafers are processed in the polishing station 80, which was described above with reference to FIG. 23. In the polishing station 85*c*, the first wafer carrier 262*a* can be washed at the wafer transfer station 285*b* that is located between the first and second polishing tables 256*a* and 256*b*. Furthermore, the third wafer carrier 262*c* can be washed at the wafer transfer station 285*c* that is located between the second and third polishing tables 256*b* and 256*c*.

In a general form, the modified polishing station 85*c* can comprise N polishing tables 256, N wafer carriers 262, N−1 wafer transfer stations 285 and a wafer conveying device 481, where N is an integer equal to or larger than 2. The first wafer transport device 150 transfers wafers to the first wafer carrier 262 and the second wafer transport device 210 removes the wafers from the last wafer carrier 262.

Figure 26:
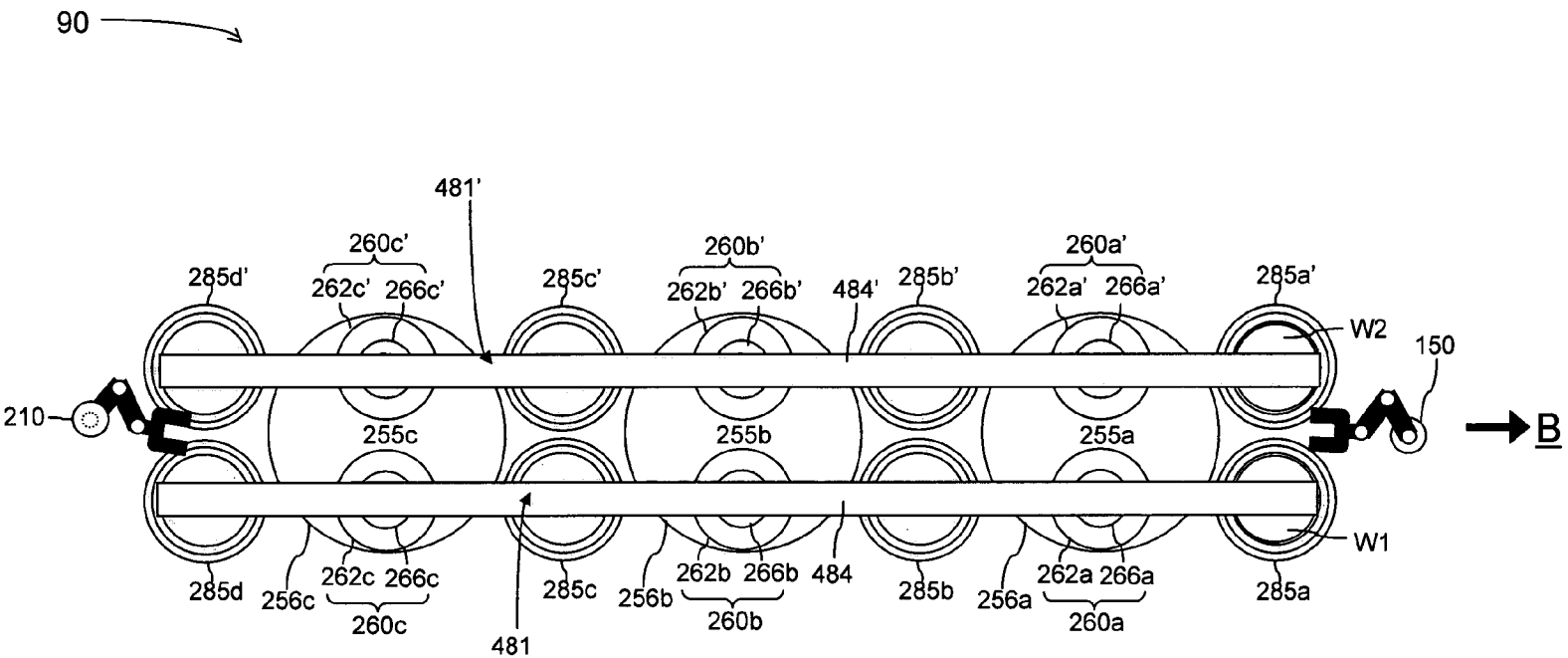
FIG. 26 is a top view of a polishing station, which can be used in the polishing apparatus of FIG. 1, in accordance with another embodiment of the invention.

With reference to FIG. 26, a polishing station 90 in accordance with another embodiment of the present invention is described. The polishing station 90 can be used in the polishing apparatus 10 of FIG. 1 instead of the polishing station 20. FIG. 26 is a top view of the polishing station 90. The polishing station 90 is similar to the polishing station 70 described with reference to FIG. 22 except that each wafer carrier assembly 260 can move between two adjacent wafer transfer stations 285 individually by wafer conveying devices 481 and 481'.

The first and second sets of three wafer carrier assemblies 260*a*–260*c* and 260'*a*–260'*c* are mounted on the conveying tracks 484 and 484' of the first and second wafer conveying devices 481 and 481', respectively. The reciprocating drive mechanism 486 (not shown) of the first wafer conveying device 481 moves each of the three wafer carrier assemblies 260*a*–260*c* individually back and forth in a linear manner. Similarly, the reciprocating drive mechanism 486' (not shown) of the second wafer conveying device 481' moves each of the three wafer carrier assemblies 260*a*'–260*c*' individually back and forth in a linear manner.

A method of processing wafers in the polishing station 90 is similar to the method of processing wafers in the polishing stations 80, which was described above with reference to FIG. 23. Wafers can be processed using the four wafer transfer station 285*a*'–285*d*', the three wafer carriers 262*a*'–262*c*' and the three polishing tables 256*a*–256*c* in the same manner as wafers are processed in the polishing station 80 using the four wafer transfer station 285*a*–285*d*, the three wafer carriers 262*a*–262*c* and the three polishing tables 256*a*–256*c*, as described above.

In a general form, this polishing station 90 comprises N polishing tables 256, two sets of N wafer carriers 262, two sets of (N+1) wafer transfer stations 285 and two wafer conveying devices 481, where N is an integer equal to or larger than 2. The first wafer transport device 150 transfers wafers to the first two wafer transfer stations 285 and the second wafer transport device 210 removes the wafers from the last two wafer transfer stations 285.

The polishing station 90 of FIG. 26 can be modified such that the first wafer transport device 150 transfer wafers directly to the first two wafer carriers 262*a* and 262*a*' by removing the first two wafer transfer stations 285*a* and 285*a*' from the polishing station 90. Wafers are processed in this modified polishing station from the first two wafer carriers 262*a* and 262*a*' through the last two wafer transfer stations 285*d* and 285*d*' in the same manner as wafers are processed in the polishing station 90. In this modified polishing station, the first two wafer carriers 262*a* and 262*a*' can be washed at the wafer transfer stations 285*b* and 285*b*', respectively, that are located between the first polishing table 256*a* and the second polishing table 256*b*.

In a general form, this modified polishing station comprises N polishing tables 256, two sets of N wafer carriers 262, two sets of N wafer transfer stations 285 and two wafer conveying devices 481, where N is an integer equal to or larger than 2. The first wafer transport device 150 transfers wafers to the first two wafer carriers 262 and the second wafer transport device 210 removes the wafers from the last two wafer transfer stations 285.

The polishing station 90 of FIG. 26 can be also modified such that the second wafer transport device 210 transfers wafers directly from the last wafer carriers 262*c* and 262*c*' by removing the last wafer transfer stations 285*d* and 285*b*'. Wafers are processed in this modified polishing station from the first two wafer transfer stations 285*a* and 285*a*' through the last two wafer carriers 262*c* and 262*c*' in the same manner as wafers are processed in the polishing station 90. In this modified polishing station, the third wafer carriers 262*c* and 262*c*' can be washed at the wafer transfer stations 285*c* and 285*c*' that are located between the second and third polishing tables 256*b* and 256*c*.

In a general form, this modified polishing station comprises N polishing tables 256, two sets of N wafer carriers 262, two sets of N wafer transfer stations 285 and two wafer conveying devices 481, where N is an integer equal to or larger than 2. The first wafer transport device 150 transfers wafers to the first two wafer transfer stations 285 and the second wafer transport device 210 removes the wafers from the last two wafer carriers 262.

The polishing station 90 of FIG. 26 can be further modified such that the first wafer transport device 150 transfers wafers to directly to the first two wafer carriers 262*a* and 262*a*' and the second wafer transport device 210 removes the wafers directly from the last two wafer carriers 262*c* and 262*c*' by removing the first two and the last two wafer transfer stations 285*a*, 285*a*', 285*d* and 285*d*'. Wafers are processed in this modified polishing station from the first two wafer carriers 262*a* and 262*a*' through the last two wafer carriers 262*c* and 262*c*' in the same manner as wafers are processed in the polishing station 90. In this modified polishing station, the first wafer carriers 262*a* and 262*a*' can be washed at the wafer transfer stations 285*b* and 285*b*' that are located between the first and second polishing tables 256*a* and 256*b*. Furthermore, the third wafer carriers 262*c* and 262*c*' can be washed at the wafer transfer stations 285*c* and 285*c*' that are located between the second and third polishing tables 256*b* and 256*c*.

In a general form, this modified polishing station comprises N polishing tables 256, two sets of N wafer carriers 262, two sets of (N−1) wafer transfer stations 285 and two wafer conveying devices 481, where N is an integer equal to or larger than 2. The first wafer transport device 150 transfers wafers to the first two wafer carriers 262 and the second wafer transport device 210 removes the wafers from the last two wafer carriers 262.

Figure 27:
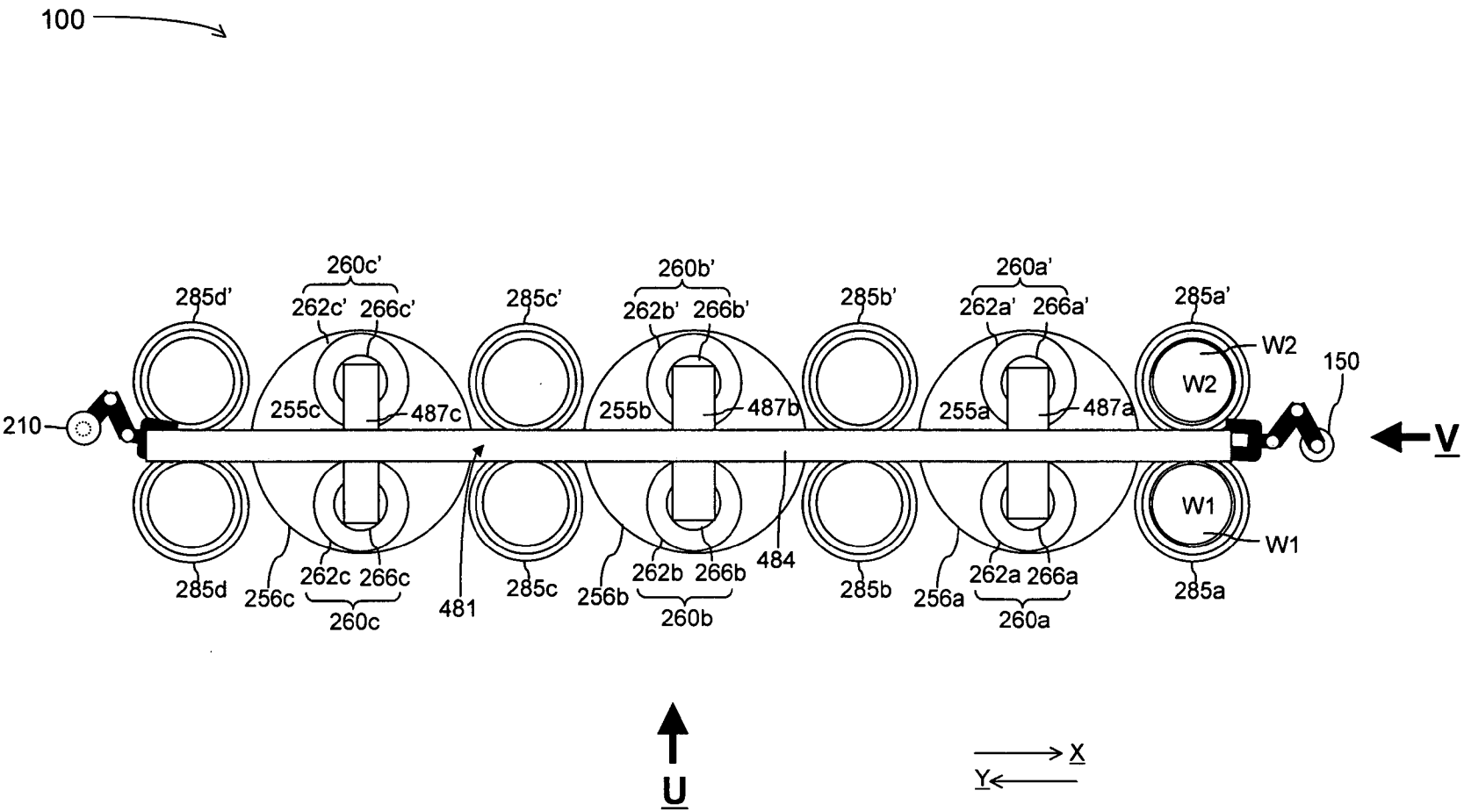
FIGS. 27 and 28 are a top view and a side view of a polishing station, respectively, which can be used in the polishing apparatus of FIG. 1, in accordance with another embodiment of the invention.
Figure 28:
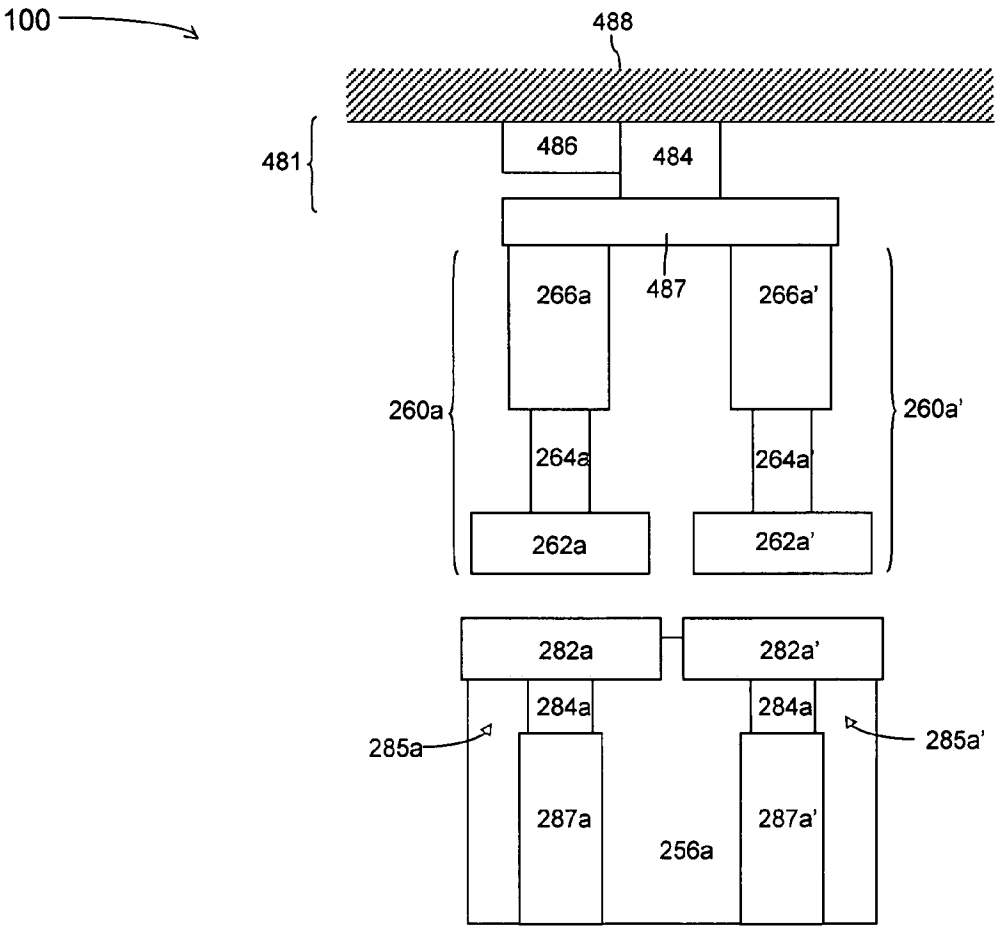

With reference to FIGS. 27 and 28, a polishing station 100 in accordance with another embodiment of the present invention is described. The polishing station 100 can be used in the polishing apparatus 10 of FIG. 1 instead of the polishing station 20. FIG. 27 is a top view of the polishing station 100. FIG. 28 is a side view of the polishing station 100, as viewed in the direction V illustrated in FIG. 27. The polishing station 100 is similar to the polishing station 90 described with reference to FIG. 26 except that first, second and third two wafer carrier assemblies 260*a* and 260*a*', 260*b* and 260*b*', and 260*c* and 260*c*' are connected to each other by respective connectors 487. The connectors 487 are mounted on the conveying track 484 of the wafer conveying device 481 of the polishing station 100, as illustrated in FIG. 28. Reciprocating linear motions X and Y of the connectors 487 are controlled by the reciprocating drive mechanism 486.

The first wafer carriers 262*a* and 262*a*' are transferred together between the first wafer transfer stations 285*a* and 285*a*', the first polishing table 256*a* and the second wafer transfer stations 285*b* and 285*b*' by reciprocating the first connector 487*a* connected to the wafer carrier assemblies 260*a* and 260*a*' along the conveying track 484. Similarly, the second wafer carriers 262*b* and 262*b*' are transferred together between the second wafer transfer stations 285*b* and 285*b*', the second polishing table 256*b* and the third wafer transfer stations 285*c* and 285*c*' by reciprocating the second connector 487*b* connected to the wafer carrier assemblies 260*b* and 260*b*' along the conveying track 484. The third wafer carriers 262*c* and 262*c*' are also transferred together between the third wafer transfer stations 285*c* and 285*c*', the third polishing table 256*c* and the fourth wafer transfer stations 285*d* and 285*d*' by reciprocating the third connector 487*c* connected to the wafer carrier assemblies 260*c* and 260*c*' along the conveying track 484.

A method of processing wafers in the polishing station 100 is similar to the method of processing wafers in the polishing station 80, which was described above with reference to FIG. 23 except that each pair of wafer carriers connected to each other by the respective connector 487 is moved together by the reciprocating linear motions X and Y. Another difference is that two wafers can be polished on one polishing table 256 in the polishing station 100.

In a general form, the polishing station 100 comprises N polishing tables 256, two sets of N wafer carriers 262, two sets of N+1 wafer transfer stations 285 and one wafer conveying device 481, where N is an integer equal to or larger than 2. The first wafer transport device 150 transfers wafers to the first two wafer transfer stations 285 and the second wafer transport device 210 removes the wafers from the last two wafer transfer stations 285.

The polishing station 100 of FIG. 27 can be modified such that the first wafer transport device 150 transfers wafers directly to the wafer carriers 262*a* and 262*a*' by removing the first two wafer transfer stations 285*a* and 285*a*' from the polishing station 100. Wafers are processed in this modified polishing station from the first two wafer carriers 262*a* and 262*a*' through the last two wafer transfer stations 285*d* and 285*d*' in the same manner as wafers are processed in the polishing station 100. In this modified polishing station, the wafer carriers 262*a* and 262*a*' can be washed at the wafer transfer stations 285*b* and 285*b*' that are located between the first polishing table 256*a* and the second polishing table 256*b*.

In a general form, this modified polishing station comprises N polishing tables 256, two sets of N wafer carriers 262, two sets of N wafer transfer stations 285 and one wafer conveying device 481, where N is an integer equal to or larger than 2. The first wafer transport device 150 transfers wafers to the first two wafer carriers 262 and the second wafer transport device 210 removes the wafers from the last two wafer transfer stations 285.

The polishing station 100 of FIG. 27 can be also modified such that the second wafer transport device 210 transfers wafers directly from the last wafer carriers 262*c* and 262*c*' by removing the last wafer transfer stations 285*d* and 285*d*'. Wafers are processed in this modified polishing station from the first two wafer transfer stations 285*a* and 285*a*' through the last two wafer carriers 262*c* and 262*c*' in the same manner as wafers are processed in the polishing station 100. In this polishing station, the third wafer carriers 262*c* and 262*c*' can be washed at the wafer transfer stations 285*c* and 285*c*' that are located between the second and third polishing tables 256*b* and 256*c*.

In a general form, this modified polishing station comprises N polishing tables 256, two sets of N wafer carriers 262, two sets of N wafer transfer stations 285 and one wafer conveying device 481, where N is an integer equal to or larger than 2. The first wafer transport device 150 transfers wafers to the first two wafer transfer stations 285 and the second wafer transport device 210 removes the wafers from the last two wafer carriers 262.

The polishing station 100 of FIG. 27 can be further modified such that the first wafer transport device 150 transfers wafers directly to the first two wafer carriers 262*a* and 262*a*' and the second wafer transport device 210 removes the wafers directly from the last two wafer carriers 262*c* and 262*c*' by removing the first two and the last two wafer transfer stations 285*a*, 285*a*', 285*d* and 285*d*'. Wafers are processed in this modified polishing station from the first two wafer carriers 262*a* and 262*a*' through the last two wafer carriers 262*c* and 262*c*' in the same manner as wafers are processed in the polishing station 100. In this modified polishing station, the first wafer carriers 262*a* and 262*a*' can be washed at the wafer transfer stations 285*b* and 285*b*' that are located between the first and second polishing tables 256*a* and 256*b*. Furthermore, the third wafer carriers 262*c* and 262*c*' can be washed at the wafer transfer stations 285*c* and 285*c*' that are located between the second and third polishing tables 256*b* and 256*c*.

In a general form, this modified polishing station comprises N polishing table 256, two sets of N wafer carriers 262, two sets of (N−1) wafer transfer stations 285 and one wafer conveying device 481, where N is an integer equal to or larger than 2. The first wafer transport device 150 transfers wafers to the first two wafer carriers 262 and the second wafer transport device 210 removes the wafers from the last two wafer carriers 262.

Figure 29:
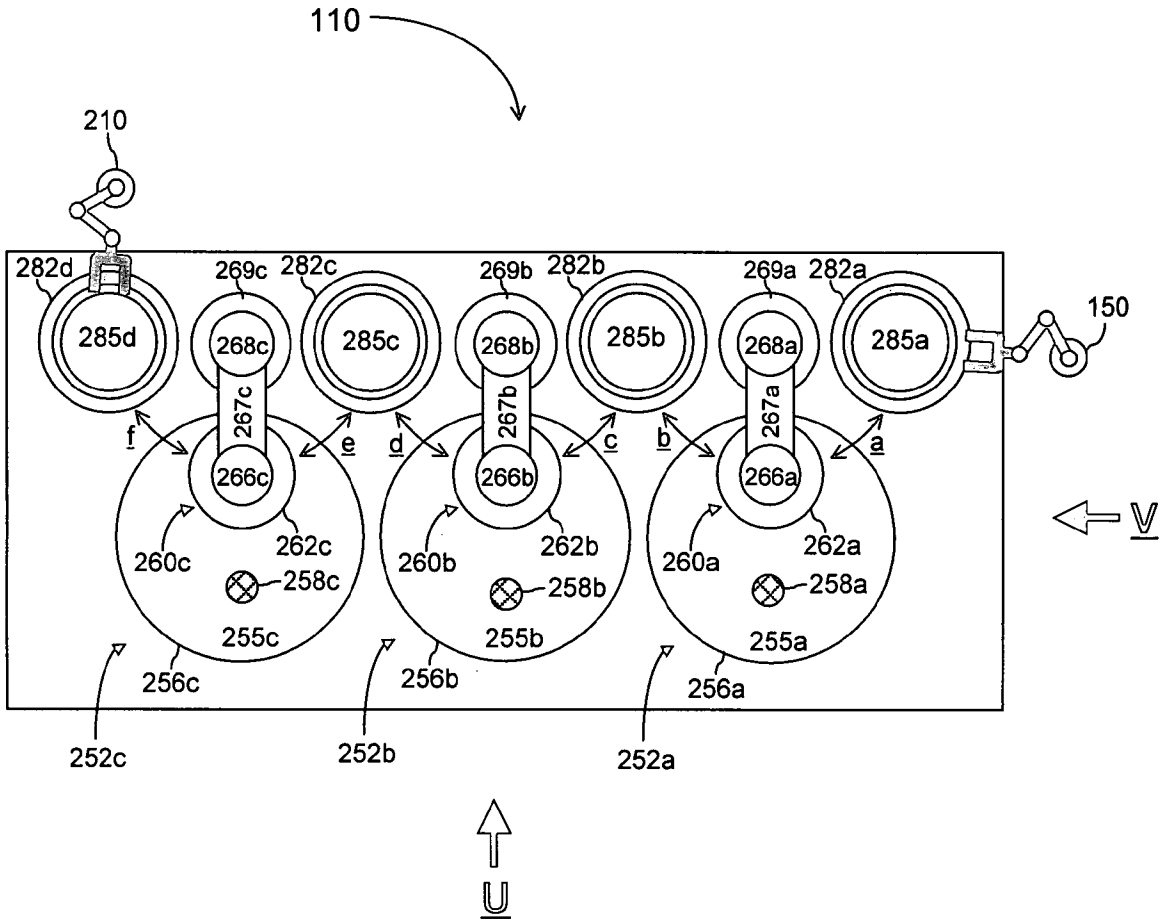
FIG. 29 is a top view of a polishing station, which can be used in the polishing apparatus of FIG. 1, in accordance with another embodiment of the invention.
Figure 30B:
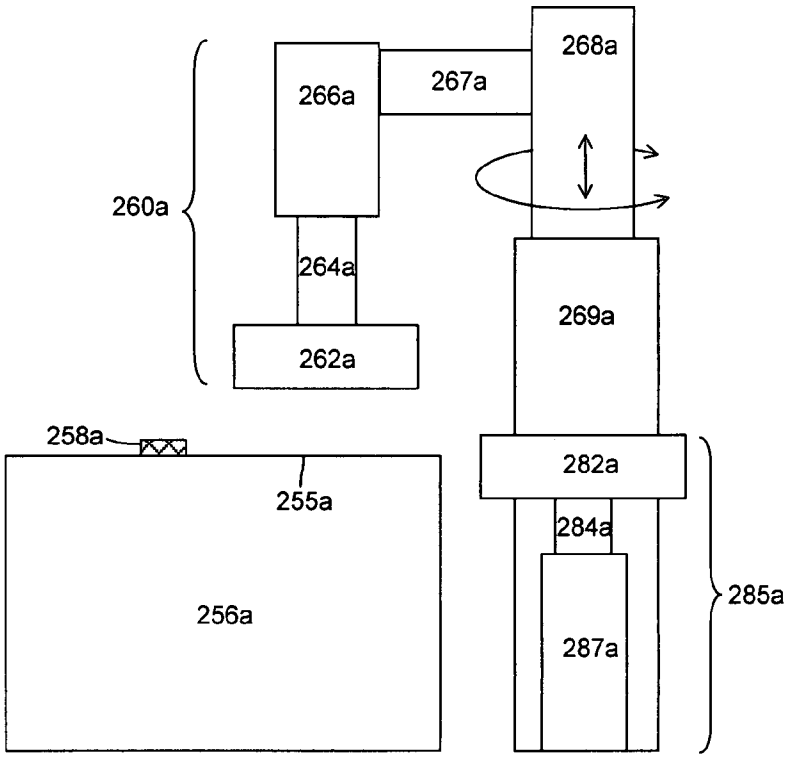
FIGS. 30(*a*) and (*b*) are side views of a polishing unit used in the polishing station of FIG. 29.
Figure 30A:
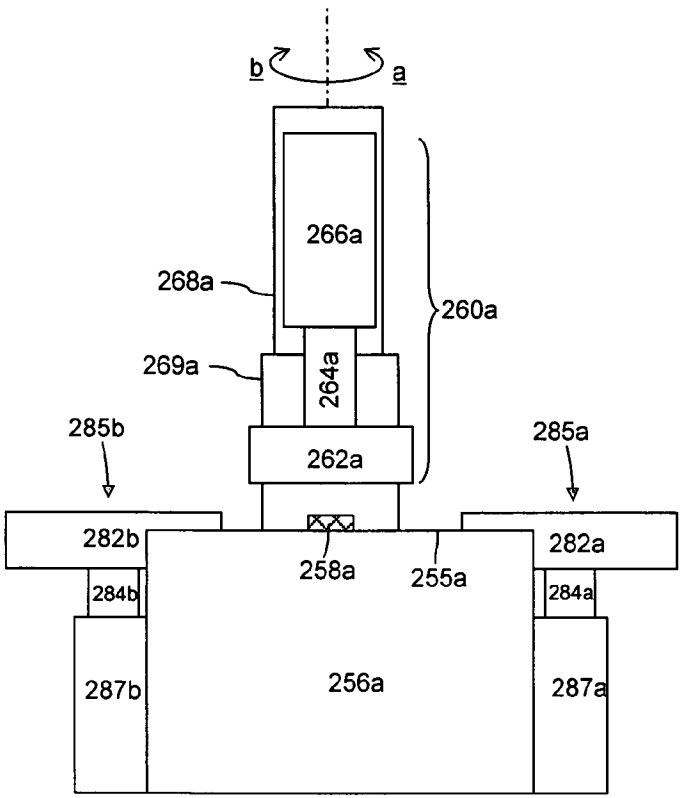

With reference to FIGS. 29, 30(*a*) and 30(*b*), a polishing station 110 in accordance with another embodiment of the present invention is described. The polishing station 110 can be used in the polishing apparatus 10 of FIG. 1 instead of the polishing station 20. FIG. 29 is a top view of the polishing station 110. FIG. 30(*a*) is a side view of a polishing unit 252 of the polishing station 110, as viewed in the direction U illustrated in FIG. 29. FIG. 30(*b*) is a side view of the polishing unit 252, as viewed in the direction V illustrated in FIG. 29.

The polishing station 110 comprises a first polishing unit 252*a*, a second polishing unit 252*b*, a third polishing unit 252*c*, a first wafer transfer station 285*a*, a second wafer transfer station 285*b*, a third wafer transfer station 285*c*, and a fourth wafer transfer station 285*d*.

Each polishing unit 252 comprises a polishing table 256, a wafer carrier assembly 260. Each polishing unit 252 may further comprise a pad conditioner 258. Each polishing unit 252 further comprises a pivoting arm 267, a pivoting shaft 268 and a pivoting-and-vertical drive mechanism 269. The pivoting arm 267 connects the wafer carrier assembly 260 to the pivoting shaft 268, which is connected to the pivoting-and-vertical drive mechanism 269. Therefore, a wafer carrier 262 of the wafer carrier assembly 260 can be moved in pivoting and vertical manners by the pivoting-and-vertical drive mechanism 269.

The four wafer transfer stations 285*a*–285*d* and the wafer carriers 262*a*–262*c* are arranged such that wafers can be transferred from the first wafer transfer station 285*a* through the last wafer transfer station 285*d* by the wafer carriers 262*a*–262*c* in the following manner. First, the wafer carrier 262*a* of the first polishing unit 252*a* transfers a first wafer from the first wafer transfer station 285*a* to the second wafer transfer station 285*b* by its pivoting motions a and b, as illustrated in FIG. 30. Next, the wafer carrier 262*b* of the second polishing unit 252*b* similarly transfers the first wafer from the second wafer transfer station 285*b* to the third wafer transfer station 285*c* by its pivoting motions c and d. Next, the wafer carrier 262*c* of the third polishing unit 252*c* similarly transfers the first wafer from the third wafer transfer station 285*c* to the fourth wafer transfer station 285*d* by its pivoting motions e and f. The first wafer transport device 150 supplies wafers to the first wafer transfer station 285*a* and the second wafer transport device 210 removes wafers from the fourth wafer transfer station 285*d*.

Pivoting motions of the wafer carriers 262 may be controlled individually. It is preferred, however, that the pivoting motions of the wafer carriers 262 are synchronized such that the wafer carriers 262 cannot be pivoted to the same wafer transfer station 285 at the same time.

A method of processing wafers in the polishing station 110 is similar to the method of processing wafers in the polishing stations 80, as described above with reference to FIG. 23 except that each wafer carrier 262 in the polishing station 110 transfers wafers between two adjacent wafer transfer stations 285 by its respective pivoting motion while each wafer carrier 262 in polishing station 80 transfers wafers between two adjacent wafer transfer stations 285 by its respective linear motions. Simultaneous pivoting motion of the wafer carriers 262*a* toward a same direction is also preferred because the simultaneous motion can increase the throughput of the polishing station 110 by making it possible for the wafer carriers 262 to be loaded with next wafers as soon as the wafers on the wafer carriers 262 are unloaded from the wafer carriers 262.

In a general form, the polishing station 110 comprises N polishing units 252 and N+1 wafer transfer stations 285, where N is an integer equal to or larger than 2. The first wafer transport device 150 transfers wafers to the first wafer transfer station 285 and the second wafer transport device 210 removes the wafers from the last wafer transfer station 285.

The polishing station 110 of FIG. 29 can be modified such that the first wafer transport device 150 transfer wafers directly to the wafer carrier 262*a* of the first polishing unit 252*a* by removing the first wafer transfer station 285*a* from the polishing station 110. Wafers are processed in this modified polishing station from the wafer carrier 262*a* of the first polishing unit 252*a* through the last wafer transfer station 285*d* in the same manner as wafers are processed in the polishing station 110. In this modified polishing station, the wafer carrier 262*a* of the first polishing unit 252*a* can be washed at the wafer transfers station 285*b* that is located between the first polishing unit 252*a* and the second polishing unit 252*b*.

In a general form, this modified polishing station comprises N polishing units 252 and N wafer transfer stations 285, where N is an integer equal to or larger than 2. The first wafer transport device 150 transfers wafers to the wafer carrier 262 of the first polishing unit 252 and the second wafer transport device 210 removes the wafers from the last wafer transfer station 285.

The polishing station 110 of FIG. 29 can be also modified such that the second wafer transport device 210 transfers wafers directly from the wafer carrier 262*c* of the third polishing unit 252*c* by removing the last wafer transfer station 285*d*. Wafers are processed in this modified polishing station from the first wafer transfer station 285*a* through the wafer carrier 262*c* of the third polishing unit 252*c* in the same manner as wafers are processed in the polishing station 110. In this modified polishing station, the third wafer carrier 262*c* can be washed at the wafer transfer station 285*c* that is located between the second and third polishing tables 256*b* and 256*c*.

In a general form, this modified polishing station comprises N polishing units 252 and N wafer transfer stations 285, where N is an integer equal to or larger than 2. The first wafer transport device 150 transfers wafers to the first wafer transfer station 285 and the second wafer transport device 210 removes the wafers from the wafer carrier 262 of the last polishing unit 252.

The polishing station 110 of FIG. 29 can be further modified such that the first wafer transport device 150 transfers wafers directly to the wafer carrier 262 of the first polishing unit 252*a* and the second wafer transport device 210 removes the wafers directly from the wafer carrier 262*c* of the third polishing unit 252*c* by removing the first and last wafer transfer stations 285*a* and 285*d*. Wafers are processed in this modified polishing station from the wafer carrier 262*a* of the first polishing unit 252*a* through the wafer carrier 262*c* of the third polishing unit 252*c* in the same manner as wafers are processed in the polishing station 110. In this modified polishing station, the first wafer carrier 262*a* can be washed at the wafer transfer station 285*b* that is located between the first and second polishing tables 256*a* and 256*b*. Furthermore, the third wafer carrier 262*c* can be washed at the wafer transfer station 285*c* that is located between the second and third polishing tables 256*b* and 256*c*.

In a general form, this modified polishing station comprises N polishing units 252 and N−1 wafer transfer stations 285, where N is an integer equal to or larger than 2. The first wafer transport device 150 transfers wafers to the wafer carrier 262 of the first polishing unit 252 and the second wafer transport device 210 removes the wafers from the wafer carrier 262 of the last polishing unit 252.

Figure 31:
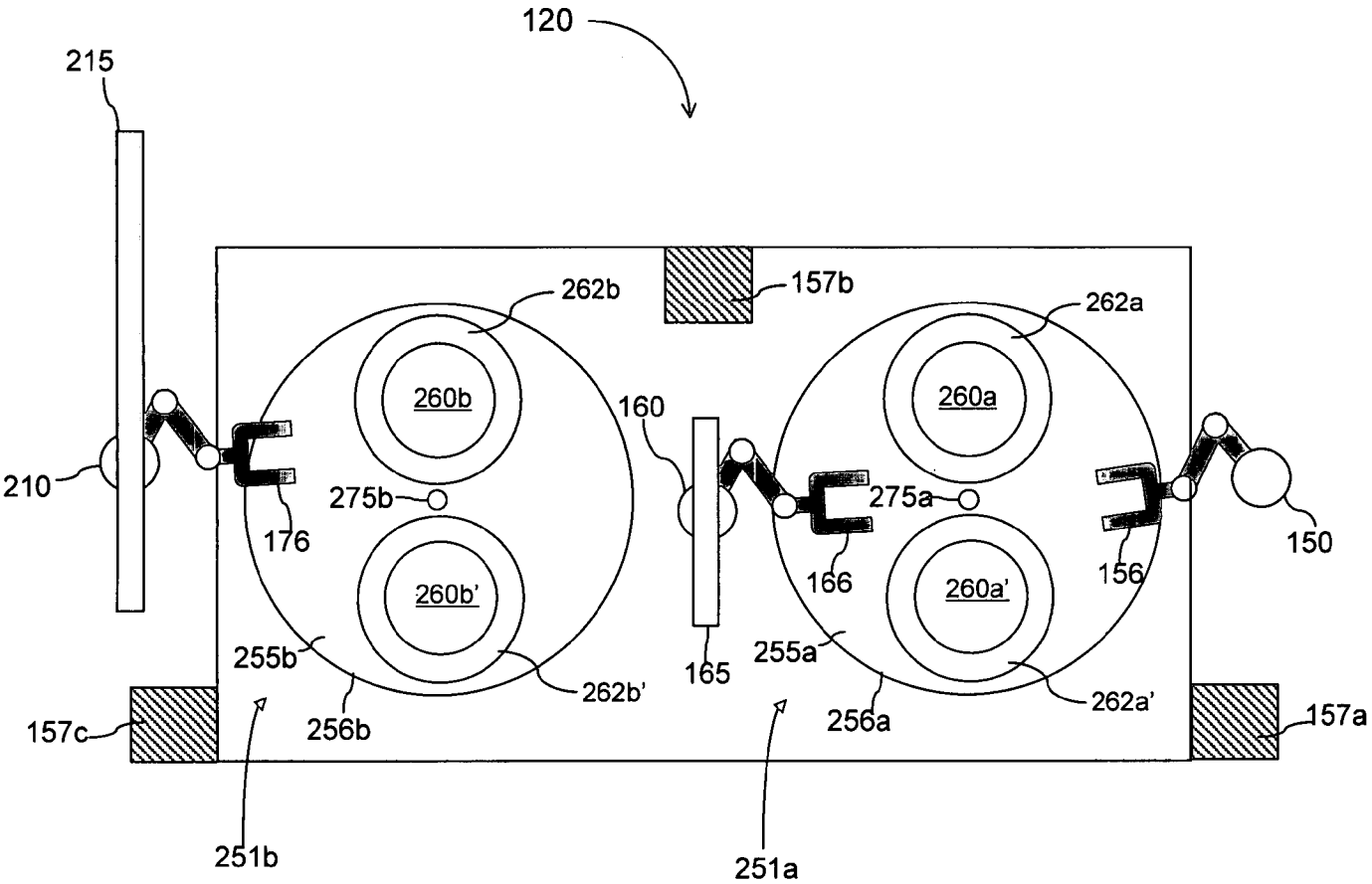
FIGS. 31 and 32 are a top view and a side view of a polishing station, respectively, which can be used in the polishing apparatus of FIG. 1, in accordance with another embodiment of the invention.

With reference to FIG. 31, a polishing station 120 in accordance with another embodiment of the present invention is described. The polishing station 120 can be used in the polishing apparatus 10 of FIG. 1 instead of the polishing station 20. FIG. 31 is a top view of the polishing station 120.

The polishing station 120 comprises a first polishing unit 251*a*, a second polishing unit 251*b* and a wafer transport device 160. The wafer transport device 160 is positioned between the first and second polishing units 251*a* and 251*b* and transfers wafers from the wafer carriers 262*a* and 262*b*' of the first polishing unit 251*a* to the wafer carriers 262*b* and 262*b*' of the second polishing unit 251*b*. The side of the polishing station 120 adjacent to the first wafer transport device 150 is an input end of the polishing station to receive wafers into the polishing station. The side of the polishing station 120 adjacent to the second wafer transport device 210 is an output end of the polishing station to output polished wafers from the polishing station. Preferably, the input end and the output end of the polishing station 120 are at opposite sides of the polishing station.

The wafer transport device 160 may be mounted on a linear track 165 such that the wafer transport device 160 can move in a linear manner on the linear track 165. As an example, the wafer transport device 160 may comprise a robotic arm to handle a wafer for transfer. The wafer transport device 160 may be further configured to comprise dual robotic arms such that the wafer transport device can handle two wafers at a time.

The polishing station 120 may further comprise washing stations 157*a*–157*c*, as illustrated in FIG. 31. When wafer holding portions 156, 166 and 176 of the wafer transport devices 150, 160 and 210 need to be cleaned, the wafer holding portions 156, 166 and 176 are sent to the washing stations 157*a*–157*c*, respectively, to be cleaned.

Each washing station 157 comprises first multiple nozzles to spray or jet D.I. water or cleaning chemicals such as KOH to wash the wafer holding portion of one of the wafer transport devices 150, 160 and 210. Each washing station 157 may further comprise second multiple nozzles to jet gases such as nitrogen to remove slurry particles adhered to the wafer holding portion of one of the wafer transport device 150, 160 and 210.

Figure 32:
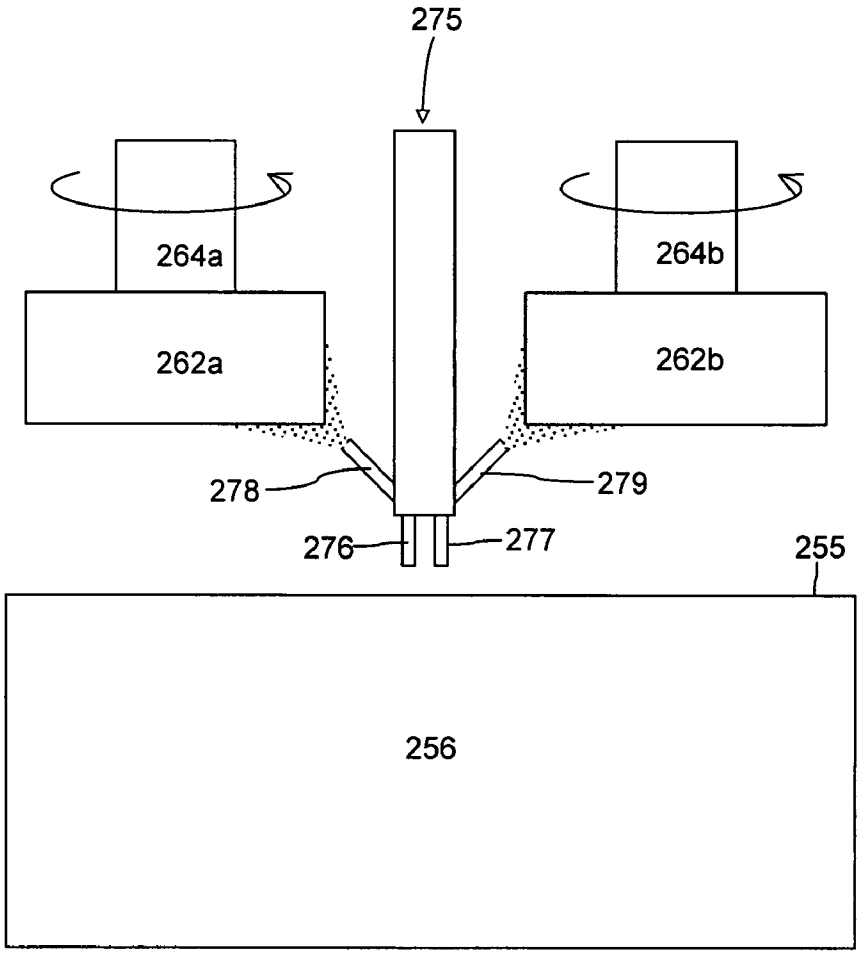

Each polishing unit 251 used in the polishing station 120 may comprise a central fluid assembly 275 to provide fluid channels for slurry and D.I. wafer. With reference to FIG. 32, which is a schematic drawing of the polishing unit 251*a*, the central fluid assembly is described in detail. The central fluid assembly 275 comprises a first fluid nozzle 276, a second fluid nozzle 277 to supply slurry and D.I. water, respectively, to the associated polishing table 256. The central fluid assembly 275 may further comprise a first nozzle 278 and a second nozzle 279 to jet D.I. water to the wafer carriers 262*a* and 262*b*, respectively. Each central fluid assembly 275 is preferably installed over the center of the polishing table 256 of the respective polishing unit 251.

A method of processing wafers in the polishing station 120 is described with reference to FIG. 31. First, a first wafer is transferred to the first wafer carrier 262*a* of the first polishing unit 251*a* by the first wafer transport device 150 and then the first wafer carrier 262*a* polishes the first wafer using the polishing pad 255*a* on the polishing table 256*a*. Next, a second wafer is transferred to the second wafer carrier 262*a*' of the first polishing unit 251*a* by the first wafer transport device 150 and the second wafer carrier 262*b* polishes the second wafer using the polishing pad 255*a* on the polishing table 256*a*.

Next, after the polishing process of the first wafer is completed, the first wafer carrier 262*a* is lifted from the polishing table 256*a* to its wafer load-and-unload position and then the wafer transport device 160 transfers the first wafer to the first wafer carrier 262*b* of the second polishing unit 251*b*. The first wafer carrier 262*b* of the second polishing unit 251*b* then polishes the first wafer using the polishing pad 255*b* on the polishing table 256*b*.

Next, after the polishing process of the second wafer in the first polishing unit 251*a* is completed, the second wafer carrier 262*a*' of the first polishing unit 251*a* is lifted from the polishing table 256*a* to its wafer load-and-unload position and then the wafer transport device 160 transfers the second wafer from the second wafer carrier 262*a*' of the first polishing unit 251*a* to the second wafer carrier 262*b*' of the second polishing unit 251*b*. The second wafer carrier 262*b*' of the second polishing unit 251*b* polishes the second wafer using the polishing pad 255*b* on the polishing table 256*b* of the second polishing unit 251*b*.

Next, after the polishing processes of the first and second wafers in the second polishing unit 251*b* are completed, the first and second wafer carriers 262*b* and 262*b*' of the second polishing unit 251*b* are lifted from the polishing table 256*b* to their respective wafer load-and-unload positions and then the second wafer transport device 210 removes the first and second wafers from the first and second wafer carriers 262*b* and 262*b*' and then send the wafers to the next destination in the polishing apparatus 10.

In a general form, the polishing station 120 can comprise N polishing units 251 and N−1 wafer transport devices 160, where N is an integer equal to or larger than 1. Each wafer transport device 160 is positioned between two neighboring polishing units 251 and transfers wafers from two wafer carriers 262 of one polishing unit 251 to two wafer carriers 262 of the other polishing unit 251. The first wafer transport device 150 transfers wafers to be polished to the wafer carriers 262 of the first polishing unit and the second wafer transport device 210 transfers polished wafers from the wafer carriers 262 of the last polishing unit 251.

Figure 33:
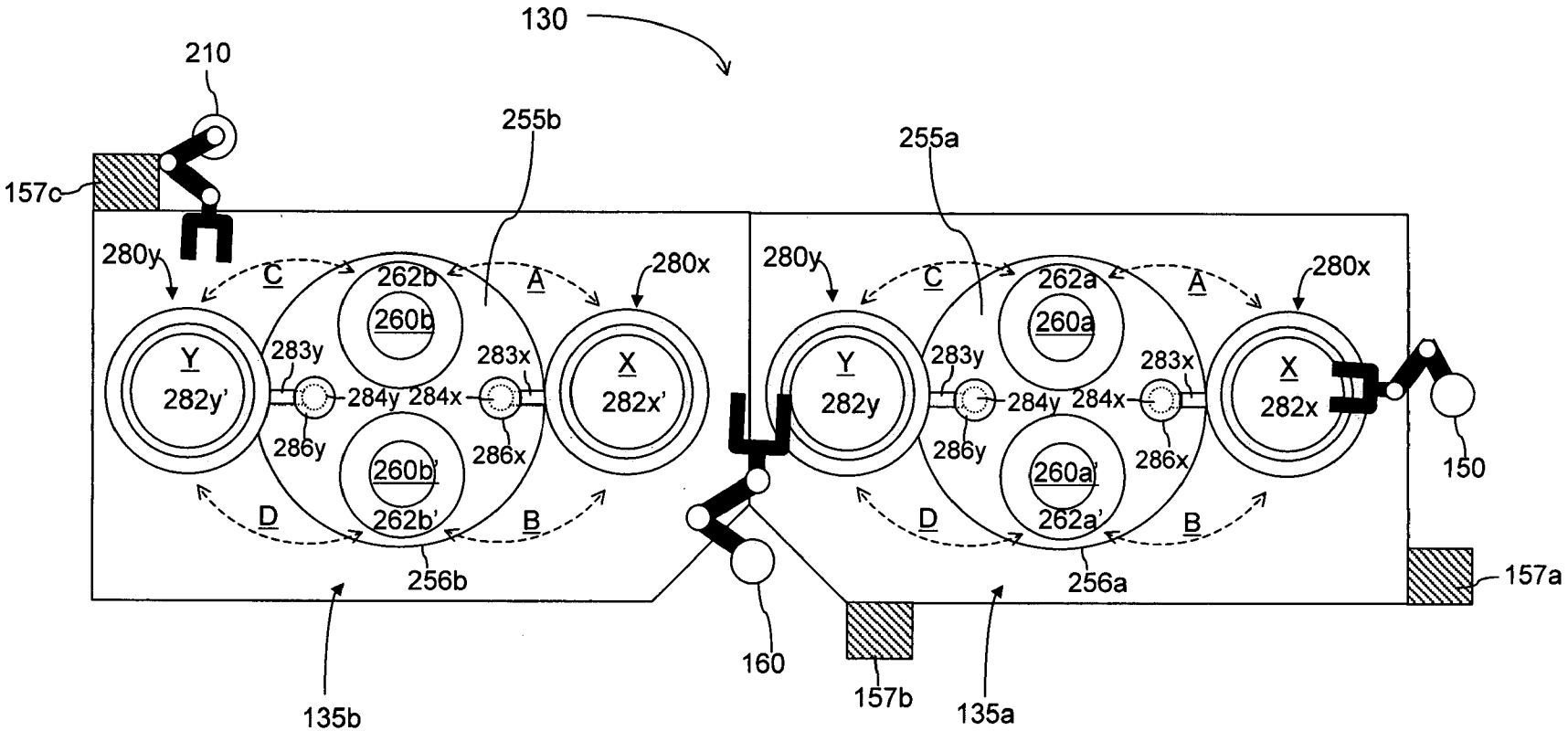
FIG. 33 is a top view of a polishing station, which can be used in the polishing apparatus of FIG. 1, in accordance with another embodiment of the invention.
Figure 34A:
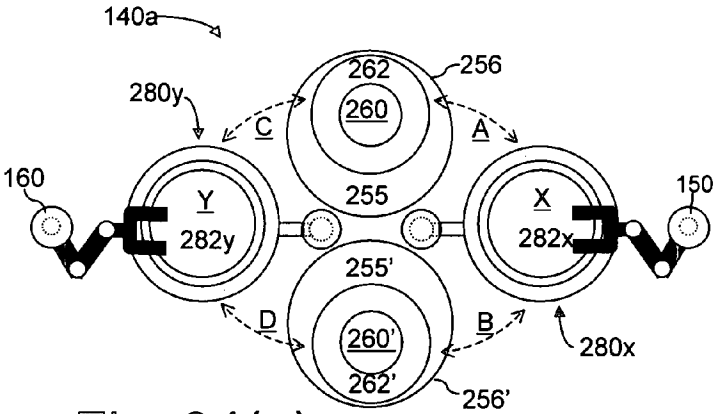
FIGS. 34(*a*)–(*c*) are top views of polishing units that can be used in the polishing station of FIG. 33.
Figure 34B:
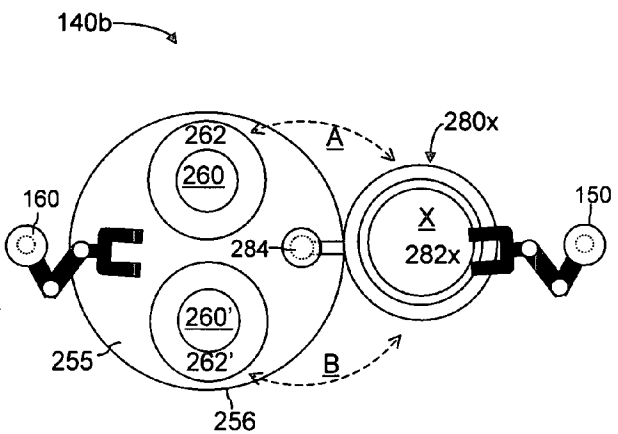
Figure 34C:
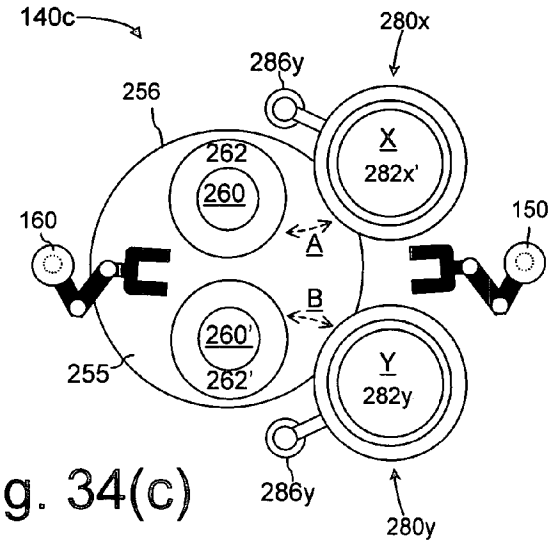

With reference to FIG. 33, a polishing station 130 in accordance with an embodiment of the present invention is described. The polishing station 130 can be used in the polishing apparatus 10 of FIG. 1 instead of the polishing station 20. FIG. 34 is a top view of the polishing station 130.

The polishing station 130 comprises a first polishing unit 135*a*, a second polishing unit 135*b* and the wafer transport device 160. The wafer transport device 160 is positioned between the first and second polishing units 135*a* and 135*b* and transfers wafers from first polishing unit 135*a* to the second polishing unit 135*b*.

Each polishing unit 135 comprises a polishing table 256, two wafer carriers 262 and two wafer relay devices 280*x* and 280*y*. The two wafer carriers 262 are positioned over the polishing table 256. The first wafer relay device 280*x* is positioned on the right side of the wafer carriers and 280*y* and the second wafer relay device 280*y* is positioned on the left side of the wafer carriers.

The pivoting shafts 284, and therefore pivoting axes, of the load-and-unload cups 282 are preferably positioned over the polishing table 256. To position the pivoting shafts 284 over the polishing table 256, the pivoting-and-vertical drive mechanisms 286 are preferably mounted to the same top housing (not shown) to which the wafer carrier assemblies 260 are mounted.

The load-and-unload cups 282*x* and 282*y* of each polishing station illustrated in FIG. 33 are positioned at their respective parking positions X and Y. The load-and-unload cup 282*x* of the first wafer relay device 280*x* can be pivoted to wafer load-and-unload positions of the two wafer carriers 262*a* and 262*a*' or 262*b* and 262' by the respective pivoting motions A and B. The load-and-unload cup 282*y* of the second wafer relay device 280*y* can be pivoted to the wafer load-and-unload positions of the two wafer carriers 262*a* and 262*a*' or 262*b* and 262*b*' by the respective pivoting motions C and D.

A method of processing wafers in the polishing station 130 is described with reference to FIG. 33. First, a first wafer is supplied to the first load-and-unload cup 282*x* of the first polishing unit 135*a* at the parking position X by the first wafer transport device 150. Next, the first load-and-unload cup 282*x* transfers the wafer to the first wafer carrier 262*a* of the first polishing unit 135*a* by its pivoting motion A. Next, the first load-and-unload cup 282*x* is pivoted back to the parking position X and then the first wafer carrier 262*a* polishes the first wafer W1 using the polishing pad 255*a* on the polishing table 256*a*.

Next, a second wafer is supplied to the first load-and-unload cup 282*x* by the first wafer transport device 150 and the first load-and-unload cup 282*x* transfers the second wafer to the second wafer carrier 262*a*' by its pivoting motion B. Next, the first load-and-unload cup 282*x* is pivoted back to the parking position X and then the second wafer carrier 262*a*' polishes the second wafer W2 on the polishing pad 255*a* on the polishing table 256*a*.

Next, after the polishing process of the first wafer is completed, the first wafer carrier 262*a* is lifted from the polishing table 256*a* and then the second load-and-unload cup 282*y* removes the first wafer from the first wafer carrier 262*a* by its pivoting motion C. Next, the second load-and-unload cup 282*y* of the first polishing unit 135*a* is pivoted back to its parking position Y and then the first wafer is transferred from the second load-and-unload cup 282*y* of the first polishing unit 135*a* to the first load-and-unload cup 282*x*' of the second polishing unit 135*b* by the wafer transport device 160.

Next, the first load-and-unload cup 282$x'$ transfers the wafer to the first wafer carrier 262$b$ of the second polishing unit 135$b$ by its pivoting motion A. Next, the first load-and-unload cup 282$x'$ is pivoted back to the parking position X and then the first wafer carrier 262$b$ polishes the first wafer using the polishing pad 255$b$ on the polishing table 256$b$.

Next, after the polishing process of the second wafer is completed, the second wafer carrier 262$a'$ is lifted from the polishing table 256$a$ and then the second load-and-unload cup 282$y$ removes the second wafer from the second wafer carrier 262$a'$ by its pivoting motion D. Next, the second load-and-unload cup 282$y$ of the first polishing unit 135$a$ is pivoted back to its parking position Y and then the second wafer is transferred from the second load-and-unload cup 282$y$ of the first polishing unit 135$a$ to the first load-and-unload cup 282$x'$ of the second polishing unit 135$b$ by the wafer transport device 160.

Next, the first load-and-unload cup 282$x'$ transfers the second wafer to the second wafer carrier 262$b'$ of the second polishing unit 135$b$ by its pivoting motion B. Next, the first load-and-unload cup 282$x'$ is pivoted back to the parking position X and then the second wafer carrier 262$b'$ polishes the first wafer using the polishing pad 255$b$ on the polishing table 256$b$.

Next, after the polishing process of the first wafer is completed, the first wafer carrier 262$b$ is lifted from the polishing table 256$b$ and then the second load-and-unload cup 282$y'$ removes the first wafer from the first wafer carrier 262$b$ by its pivoting motion C. Next, the second load-and-unload cup 282$y$ of the second polishing unit 135$b$ is pivoted back to its parking position Y and then the first wafer is removed from the second load-and-unload cup 282$y$ of the second polishing unit 135$b$ by the wafer transport device 210.

Next, after the polishing process of the second wafer is completed, the second wafer carrier 262$b'$ is lifted from the polishing table 256$b$ and then the second load-and-unload cup 282$y'$ removes the second wafer from the second wafer carrier 262$b'$ by its pivoting motion D. Next, the second load-and-unload cup 282$y$ of the second polishing unit 135$b$ is pivoted back to its parking position Y and then the second wafer is removed from the second load-and-unload cup 282$y$ of the second polishing unit 135$b$ by the wafer transport device 210.

In a general form, the polishing station 130 can comprise N polishing units 135 and N−1 wafer transport devices 160, where N is an integer equal to or larger than 1. Each wafer transport device 160 is positioned between two neighboring polishing units 135 and transfers wafers from the wafer relay device 280$y$ of one polishing unit 135 to the wafer relay device 280$x$ of the other polishing unit 135. The first wafer transport device 150 transfers wafers to be polished to the wafer relay device 280$x$ of the first polishing unit 135 and the second wafer transport device 210 removes polished wafers from the wafer relay device 280$y$ of the last polishing unit 135.

With reference to FIGS. 34($a$)–34($c$), polishing units 140$a$–140$c$ in accordance with other embodiments of the present invention are described. These polishing units 140$a$–140$c$ can be used in the polishing station 130 of FIG. 33 instead of the polishing unit 135. FIGS. 34($a$)–34($c$) are top views of the polishing units 140$a$–140$c$, respectively.

The polishing unit 140$a$ of FIG. 34($a$) is similar to the polishing unit 135 of FIG. 33 except that it comprises two polishing tables 256$a$ and 256$b$ such that each of two wafer carriers 262 and 262' can polish wafers using the polishing pad 255 on the respective polishing table 256. A method of processing wafers in the polishing station 130 having the polishing units 140$a$ is similar to the method of processing wafers in the polishing station 130 having the polishing units 135 described with reference to FIG. 33 except that each wafer carrier 262 polishes a wafer using the polishing pad 255 on the respective polishing table 256 in the polishing station 140$a$.

The polishing unit 140$b$ of FIG. 34($b$) can be derived from the polishing unit 135 of FIG. 33($a$) by removing the wafer relay device 280$y$ from the polishing unit 140$a$. The polishing unit 140$b$ can be positioned in the polishing station 130 such that the wafer relay device 280 is positioned next to the first wafer transport device 150. In this configuration, wafers are supplied to the wafer relay device 280 by the first wafer transport device 150 and then loaded onto the two wafer carriers 262 and 262' by the wafer relay device 280. Polished wafers are removed from the wafer carriers 262 and 262' by the wafer transport device 160 and then transferred to the second polishing unit 140$b$ included in the polishing station 130.

In an alternative configuration, the polishing unit 140$b$ may include just the wafer relay device 280$y$, rather than just the wafer relay device 280$x$. In this alternative configuration, wafers are supplied directly to the two wafer carriers 262 and 262' by the first wafer transport device 150. Polished wafers are individually removed from the wafer carriers 262 and 262' by the wafer relay device 280$y$. Since the wafer relay device 280$y$ is located between the wafer carriers 262 and 262' and the wafer transport device 160, the polished wafers are then transferred from the wafer relay device 280$y$ to the second polishing unit 140$b$ included in the polishing station 130 by the wafer transport device 160.

The polishing unit 140$c$ of FIG. 34($c$) can be derived from the polishing unit 135 by positioning the two wafer relay devices 280$x$ and 280$y$ on the same side of the two wafer carriers 262 and 262'. In the illustrated configuration, the two wafer relay devices 280$x$ and 280$y$ are both positioned on the right side of the two wafer carriers 262 and 262'. The polishing unit 140$c$ can be positioned in the polishing station 130 such that the wafer relay devices 280$x$ and 280$y$ are positioned next to the first wafer transport device 150. In this configuration, wafers are supplied to the wafer relay devices 280$x$ and 280$y$ by the first wafer transport device 150 and then loaded onto the two wafer carriers 262 and 262' by the wafer relay devices 280$x$ and 280$y$, respectively. Polished wafers are removed from the wafer carriers 262 and 262' by the wafer transport device 160 and then transferred to the second polishing unit 140$c$ included in the polishing station 130.

In an alternative configuration, the two wafer relay devices 280$x$ and 280$y$ are both positioned on the left side of the two wafer carriers 262 and 262'. In this alternative configuration, wafers are supplied directly to the two wafer carriers 262 and 262' by the first wafer transport device 150. Polished wafers are removed from the wafer carriers 262 and 262' by the wafer relay devices 280$x$ and 280$y$, respectively. Since the wafer relay devices 280$x$ and 280$y$ are located between the wafer carriers 262 and 262' and the wafer transport device 160, the polished wafers are then transferred from the wafer relay devices 280$x$ and 280$y$ to the second polishing unit 140$c$ included in the polishing station 130 by the wafer transport device 160.

The polishing units 140$b$ and 140$c$ can be modified to have two polishing tables 256 such that the two wafer carriers 262 and 262' polish wafers on the respective polishing tables 256.

Figure 35:
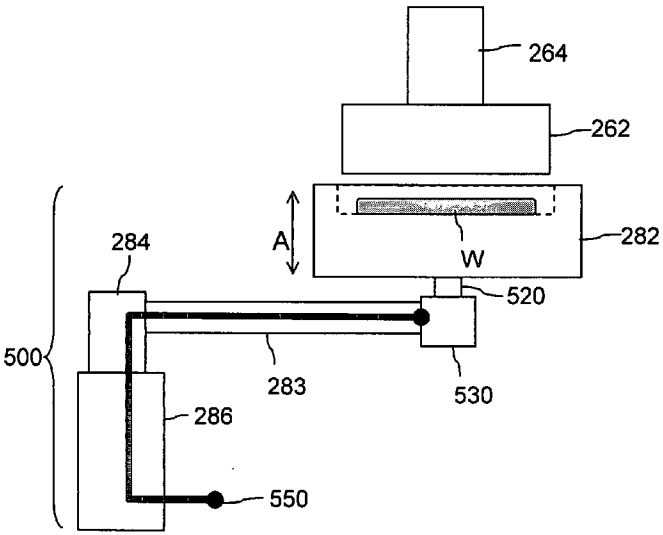
FIG. 35 is a schematic drawing of a wafer relay device in accordance with an embodiment of the present invention.

With reference to FIG. 35, a wafer relay device 500 in accordance with an embodiment of the present invention is described. FIG. 35 is a schematic drawing of the wafer relay devices 500. The wafer relay device 500 comprises the load-and-unload cup 282 described with reference to FIGS. 3(*a*) and 3(*b*), an ascending and descending device 520 such as a shaft, a cup ascending and descending mechanism 530, a pivoting arm 283, a pivoting shaft 284 and a cup drive mechanism 286. The cup ascending and descending mechanism 530 is connected to a fluid channel 550 and operated by a fluid supplied through the fluid channel 550. Nitrogen gas is one example of the fluid that can be used. Any type of load-and-unload cup that can accommodate a semiconductor wafer to be loaded onto a wafer carrier 262 can be used in the wafer relay device 500.

The load-and-unload cup 282 is connected to the ascending and descending device 520, which is connected to the cup ascending and descending mechanism 530. The cup ascending and descending mechanism 530 is mounted to the pivoting arm 283. The pivoting arm 283 is connected to the pivoting shaft 284 and the pivoting shaft 284 is connected to the cup drive mechanism 286. The cup drive mechanism 286 controls pivoting motion of the load-and-unload cup 282 through the pivoting shaft 284, the pivoting arm 283, the cup ascending and descending mechanism 530 and the ascending and descending device 520.

In order to load and unload a wafer W onto and from the wafer carrier 262, the load-and-unload cup 282 is pivoted toward the wafer carrier 262. The load-and-unload cup 282 is then moved upward toward the wafer carrier 262 by the vertical motion of the ascending and descending device 520. The wafer carrier 262 then receives the wafer from the load-and-unload cup 282. During this loading process, the load-and-unload cup 282 receives a vertical action force from the wafer carrier 262. In order to absorb this action force, the cup ascending and descending mechanism 530 can be designed to have an action force sensing mechanism (not shown) and an action force absorbing mechanism (not shown) such as an air cushioning mechanism. The action force absorbing mechanism can absorb the action force acting on the load-and-unload cup 282.

The wafer relay device 500 can use an air bladder as the ascending and descending device 520. The air bladder can ascend and descend the load-and-unload cup 282 by inflating and deflating the air bladder using the fluid supplied through the fluid channel 550.

Figure 36:
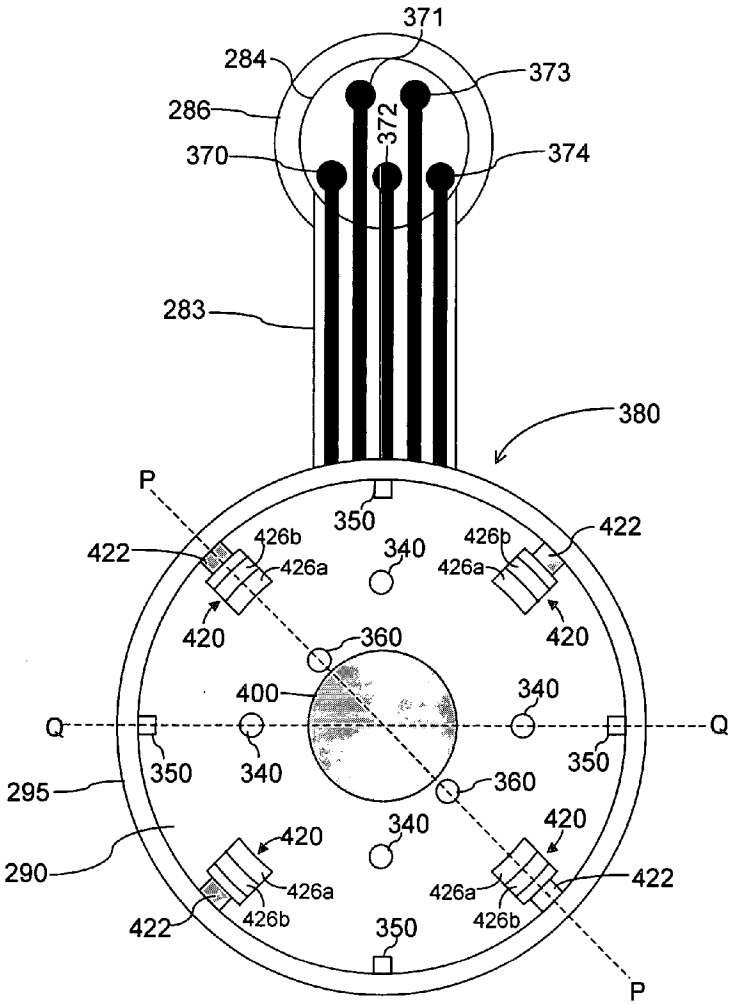
FIG. 36 is a top view of the wafer relay device of FIG. 35.
Figure 37A:
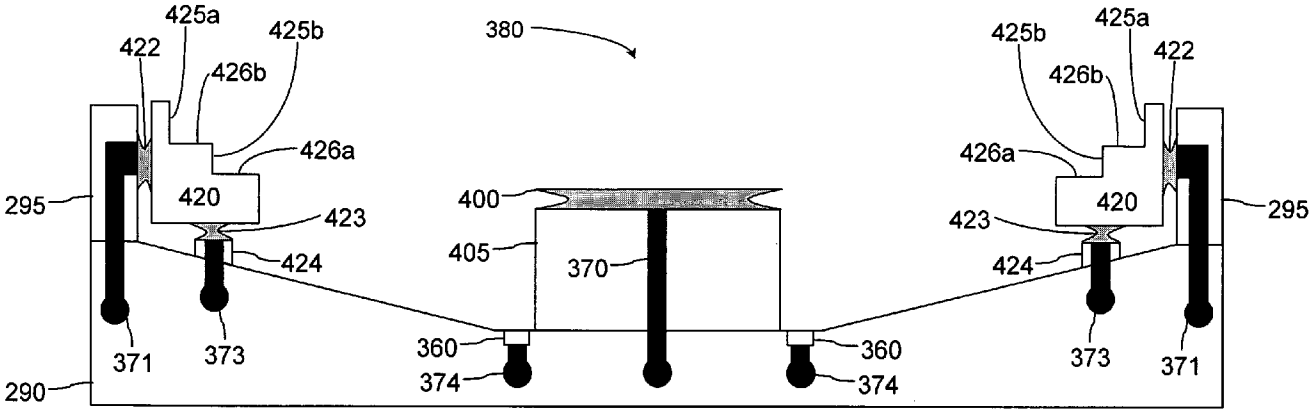
FIGS. 37(*a*) and (*b*) are cross-sectional views of a load-and-unload cup used in the wafer relay device of FIG. 35.
Figure 37B:
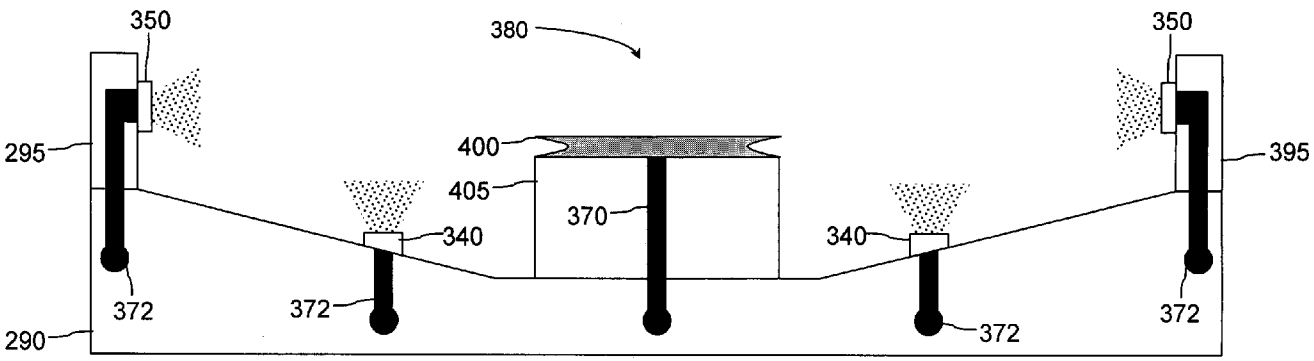
Figure 38A:
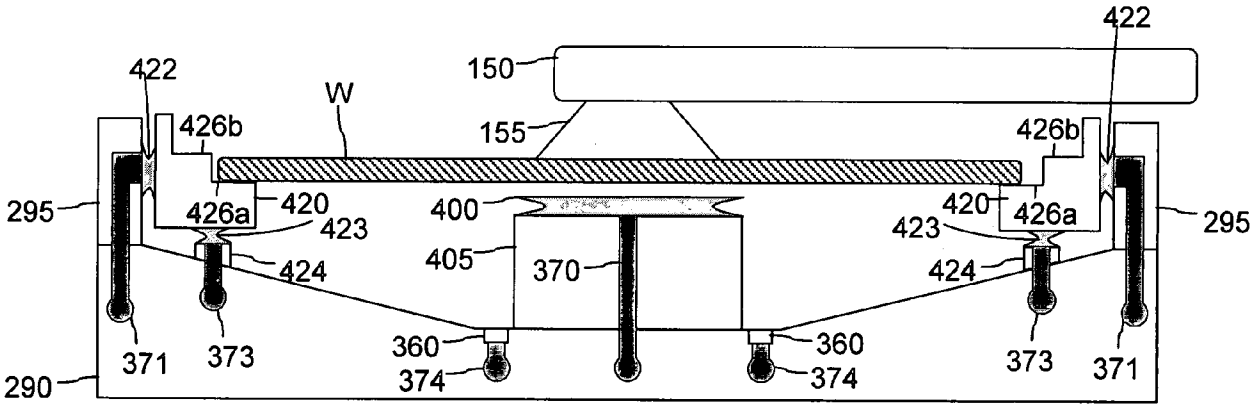
FIGS. 38(*a*)–(*f*) are sequential cross-sectional views of the load-and-unload cup of the wafer relay device of FIG. 35, illustrating a process for loading a wafer onto a wafer carrier.
Figure 38B:
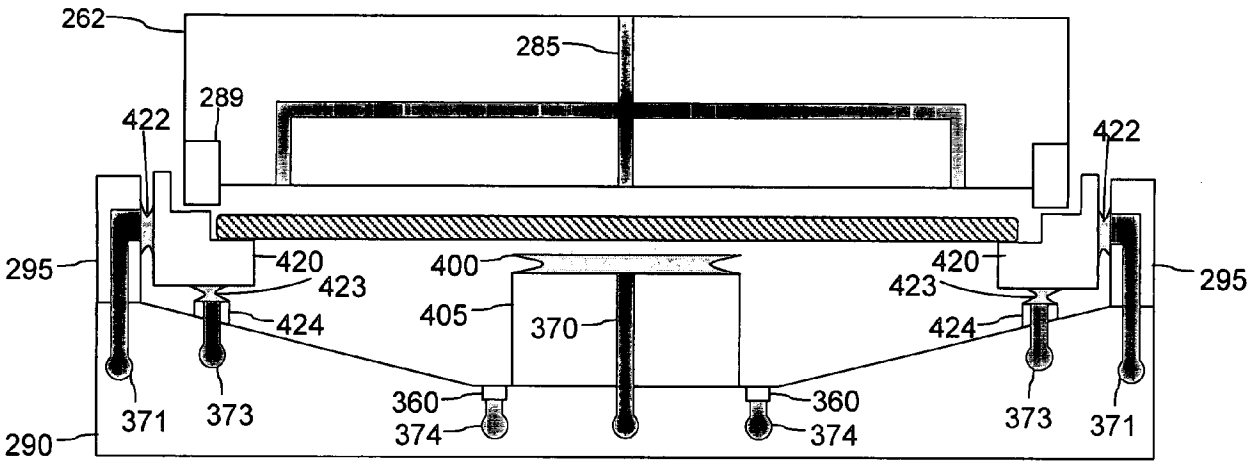
Figure 38C:
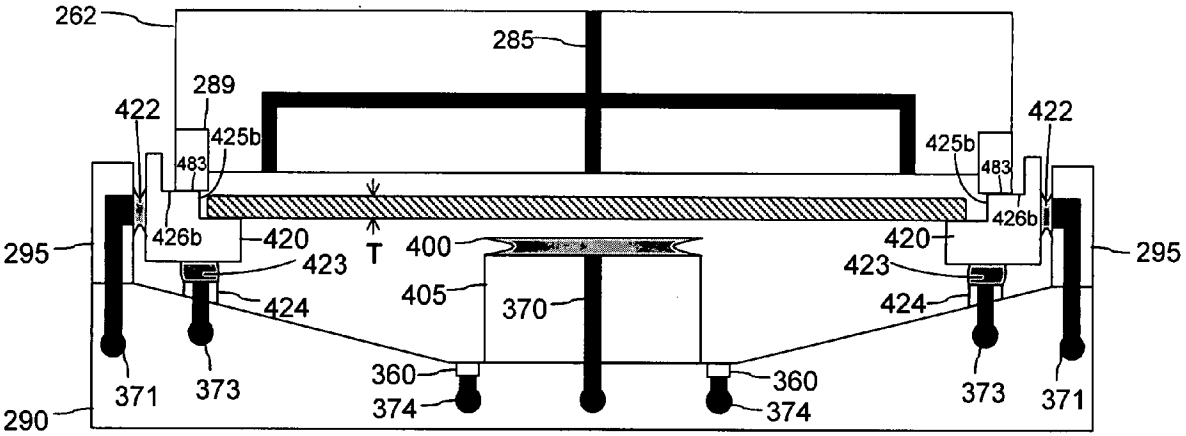
Figure 38D:
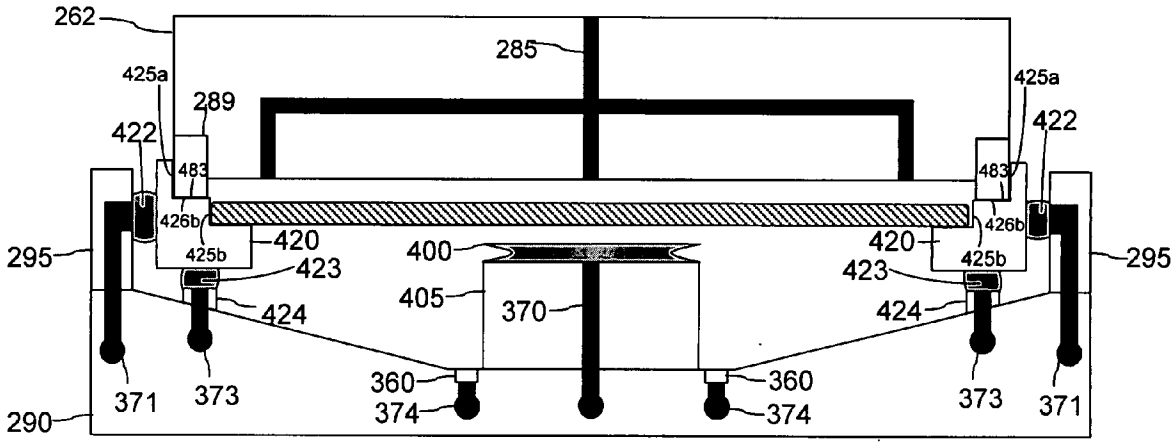
Figure 38E:
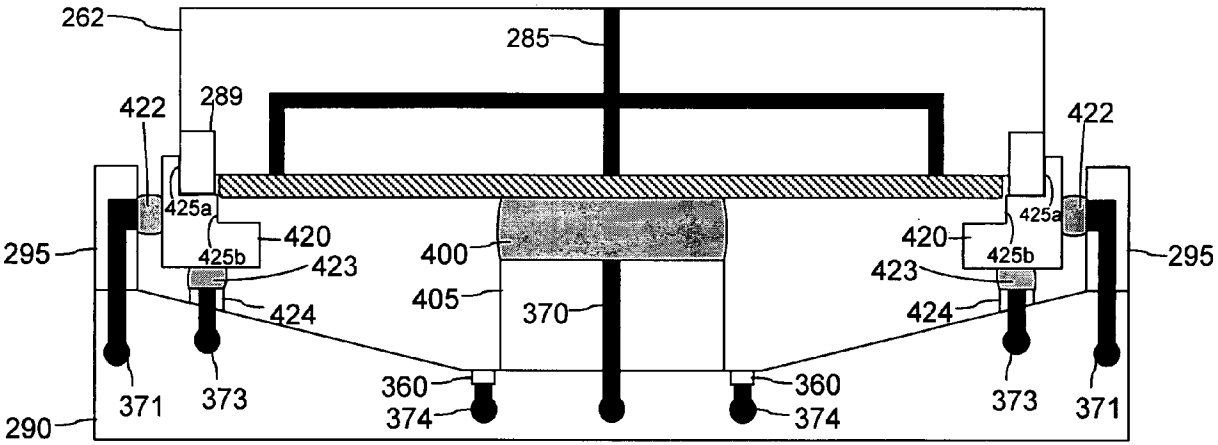
Figure 38F:
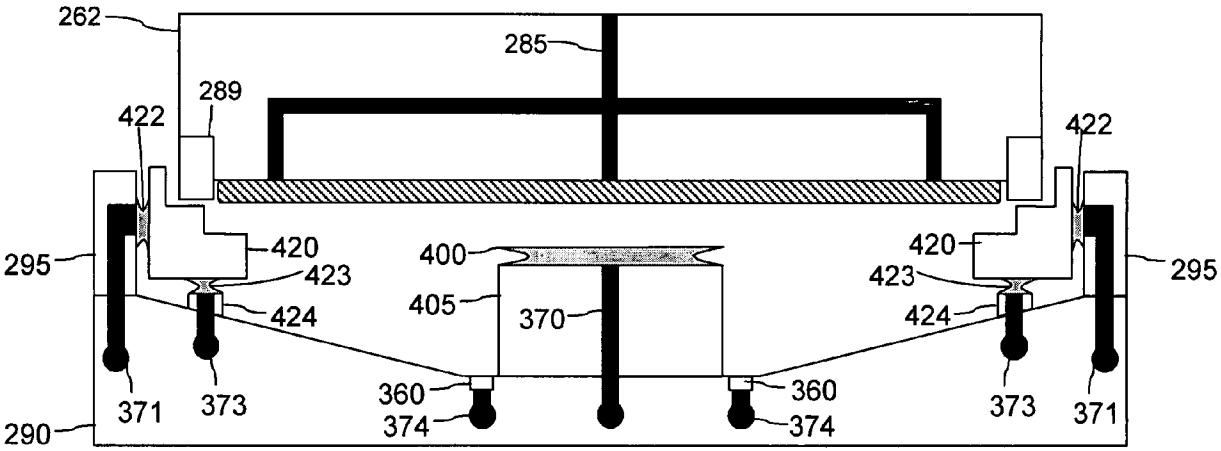
Figure 39:
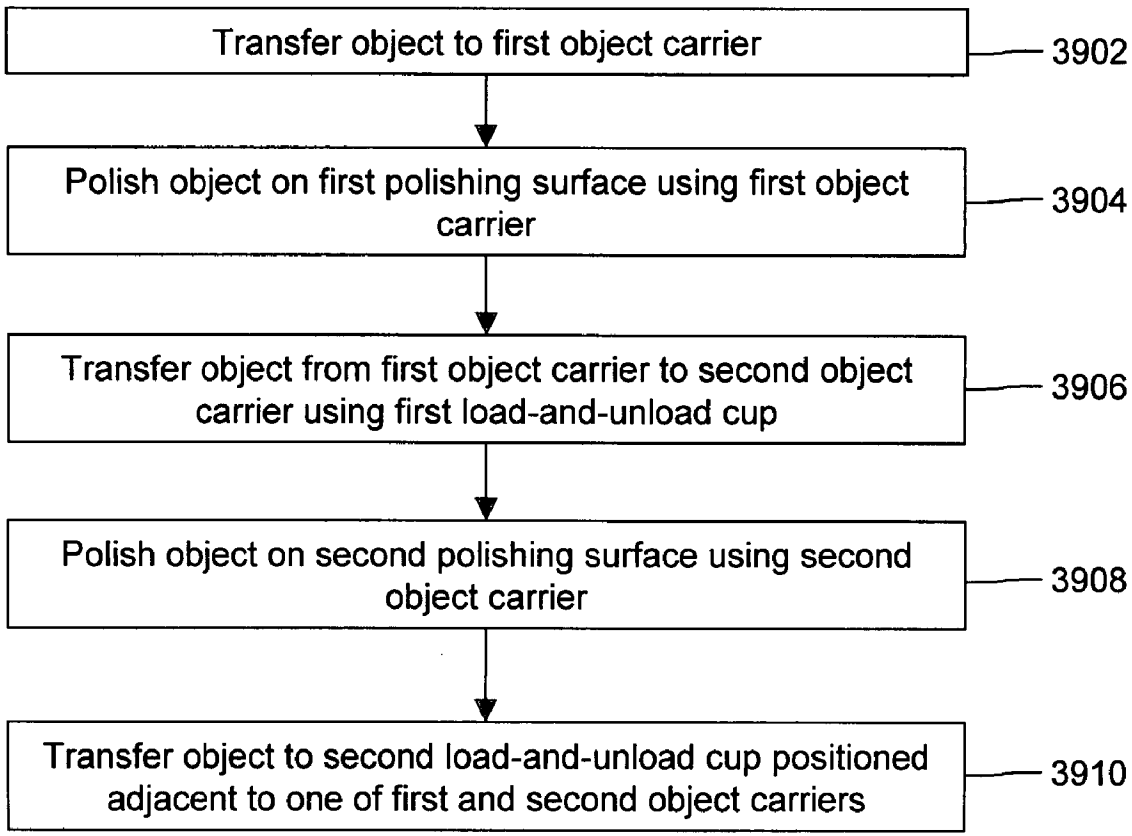
FIG. 39 is a flow diagram of a method for polishing objects in accordance with an embodiment of the invention.

With reference to FIGS. 36, 37(*a*) and 37(*b*), a load-and-unload cup 380 in accordance with another embodiment of the present invention is described. The load-and-unload cup 380 can be used in the wafer relay device 280 of FIG. 1, the wafer relay device 281 of FIG. 9, the dual cup wafer relay device 680 of FIG. 19 and the wafer transfer station 285 of FIG. 18 instead of the load-and-unload cup 282. FIG. 36 is a top view of the load-and-unload cup 380. FIGS. 39(*a*) and 39(*b*) are cross sectional views of the load-and-unload cup 380 illustrated in FIG. 36 along the lines PP and QQ, respectively.

The load-and-unload cup 380 is connected to the pivoting shaft 284 by the pivoting arm 283. It is also possible to connect the load-and-unload cup 380 directly to the pivoting shaft 284 without the pivoting arm 283. The pivoting shaft 284 is connected to the cup drive mechanism 286. The cup drive mechanism 286 controls pivoting and vertical motions of the load-and-unload cup 380 through the pivoting shaft 284 and the pivoting arm 283.

The load-and-unload cup 380 comprises a cup base 290, a cup ring 295, a wafer bladder 400, a wafer bladder holder 405, multiple aligners 420, multiple radial bladders 422, multiple vertical bladders 423, multiple vertical bladder holders 424, first multiple nozzles 340, second multiple nozzles 350, multiple drains 360, a first fluid channel 370, a second fluid channel 371, a third fluid channel 372, a fourth fluid channel 373 and a fifth fluid channel 374. The fluid channels 370, 371, 372 and 273 can be connected to fluid sources (not shown) through the pivoting arm 283 and the pivoting shaft 284, as illustrated in FIG. 36. The cup base 290 and the cup ring 295 can be viewed together as a wafer supporting structure.

The wafer bladder 400 is mounted to the wafer bladder holder 405, which is mounted on a top surface of the cup base 290, as illustrated in FIGS. 37(*a*) and 37(*b*). The wafer bladder 400 is inflated and deflated by supplying a fluid into the bladder 400 and removing the fluid from the bladder through the first fluid channel 370. Nitrogen gas can be used as the fluid to inflate and deflate the wafer bladder 400.

Each radial bladder 422 connects one of the aligners 420 to the cup ring 295, which is mounted on the cup base 290. Each radial bladder 422 is inflated and deflated by supplying a fluid into the radial bladder 422 and removing the fluid from the radial bladder 422 through the second fluid channel 371. Nitrogen gas can be used as the fluid to inflate and deflate the radial bladders 422.

Each vertical bladder 423 connects one of the aligners 420 to the vertical bladder holder 424. Each vertical bladder 423 is inflated and deflated by supplying a fluid into the vertical bladder 423 and removing the fluid from the vertical bladder 423 through the fourth fluid channel 373. Nitrogen gas can be used as the fluid to inflate and deflate the vertical bladders 423

Each aligner 420 comprises a first vertical surface 425*a*, a second vertical surface 425*b*, a first horizontal surface 426*a* and a second horizontal surface 426*b*, as illustrated in FIG. 37(*a*). A wafer is positioned on the first horizontal surfaces 426*a* of the aligners 420. The horizontal surfaces 426*a* and 426*b* can be moved upward and downward by inflating and deflating the vertical bladders 423, respectively. The vertical surfaces 425*a* and 425*b* can be moved inward and outward by inflating and deflating the radial bladders 422, respectively.

The first multiple nozzles 340 and the drains 360 are mounted on the top surface of the cup base 290 and the second multiple nozzles 350 are mounted to the cup ring 295, as illustrated in FIGS. 37(*a*) and 37(*b*). The first and the second multiple nozzles 340 and 350 are connected to the third fluid channel 372 and spray DI water supplied through the third fluid channel 372. Used DI wafer is drained through the fifth fluid channel 374, which is connected to the drain 360.

With reference to FIGS. 38(*a*)–38(*f*), a method of loading a wafer W onto the wafer carrier 262 from the load-and-unload cup 380 and unloading the wafer W from the wafer carrier 262 onto the load-and-unload cup 380 is described. FIG. 38(*a*)–38(*f*) are sequential cross sectional views of the load-and-unload cup 380. In FIG. 38(*a*), the aligners 420 are positioned at outward and downward positions by deflating the vertical and radial bladders 422 and 423. The wafer W is then transferred to the load-and-unload cup 380 and placed on the first horizontal surfaces 426*a* of the aligners 420 by the wafer transport device 150.

Next, as shown in FIG. 38(*b*), the load-and-unload cup 380 is transferred to the wafer load-and-unload position below the wafer carrier 262. The wafer carrier 262 comprises a retainer ring 289 to confine the wafer during a polishing process. Next, as shown in FIG. 38(*c*), the aligners 420 are moved upward by inflating the vertical bladders 423 until the second horizontal surfaces 426*b* of the aligners 420 touch the bottom surface 483 of the retainer ring 289. Preferably, the height of the second vertical surface 425*b* of the aligner 420 is designed to be larger than the thickness of the wafer W.

Next, as shown in FIG. 38(*d*), the aligners 420 are moved inward by inflating the radial bladders 422 until the first vertical surfaces 425*a* of the aligners 420 touch the outer surface of the retainer ring 289 of the wafer carrier 262. While the aligners 420 are moved inward, the second vertical surfaces 425*b* of some of the aligners 420 touch the wafer and move the wafer inward. When the inward movements of the aligners 420 are stopped by the output surface of the retainer ring 289, the wafer is automatically aligned horizontally such that the wafer can be safely loaded onto the wafer carrier 262 within the retainer ring 289. To achieve this automatic alignment of the wafer, the width of the second horizontal surface 426*b* of the aligner 420 should be larger than the width of the bottom surface 483 of the retainer ring 289.

Rather than moving the aligners 420 upward and then inward, the aligners can be moved first inward and then upward. It is also possible to move the aligners 420 inward and upward at the same time.

Next, as shown in FIG. 38(*e*), the wafer is transferred (raised) to the wafer carrier 262 by inflating the wafer bladder 400. The wafer carrier 262 receives the wafer using a vacuum supplied through vacuum channels 285. Next, as shown in FIG. 38(*f*), after the wafer is received by the wafer carrier 262, the wafer bladder 400 is deflated and the aligners 420 are moved outward and downward by deflating the radial and vertical bladders 422 and 423.

To unload the wafer from the wafer carrier 262 onto the load-and-unload cup 380, the load-and-unload cup 380 is positioned below the wafer carrier 262 and the aligners 420 are moved upward and inward, as described with reference to FIG. 38(*b*)–38(*d*) such that the load-and-unload cup 380 is aligned to the wafer carrier 262. Then the wafer is unloaded from the wafer carrier 262 to the first horizontal surfaces 426*a* of the aligners 420. It is also possible to unload the wafer to the wafer bladder 400 after the wafer bladder 400 is inflated, as illustrated in FIG. 38(*e*). Before or after unloading the wafer to the load-and-unload cup 380, the wafer carrier 262 and the wafer can be washed by D.I. water sprayed from the first and second multiple nozzles 340 and 350 of the load-and-unload cup 380.

A method for polishing objects, such as semiconductor wafers, in accordance with an embodiment of the invention is described with reference to a flow diagram of FIG. 39. At block 3902, an object is transferred to a first object carrier positioned over a first polishing surface. Next, at block 3904, the object is polished on the first polishing surface using the first object carrier. Next, at block 3906, the object is transferred from the first object carrier to a second object carrier positioned over a second polishing surface using a first load-and-unload cup. The transferring of the object from the first object carrier to the second object carrier includes pivoting the load-and-unload cup about a pivoting axis. Next, at block 3908, the object is polished on the second polishing surface using the second object carrier. Next, at block 3910, the object is transferred to a second load-and-unload cup positioned adjacent to one of the first and second object carriers to load the object onto the first object carrier or unload the object from the second object carrier.

Figure 40:
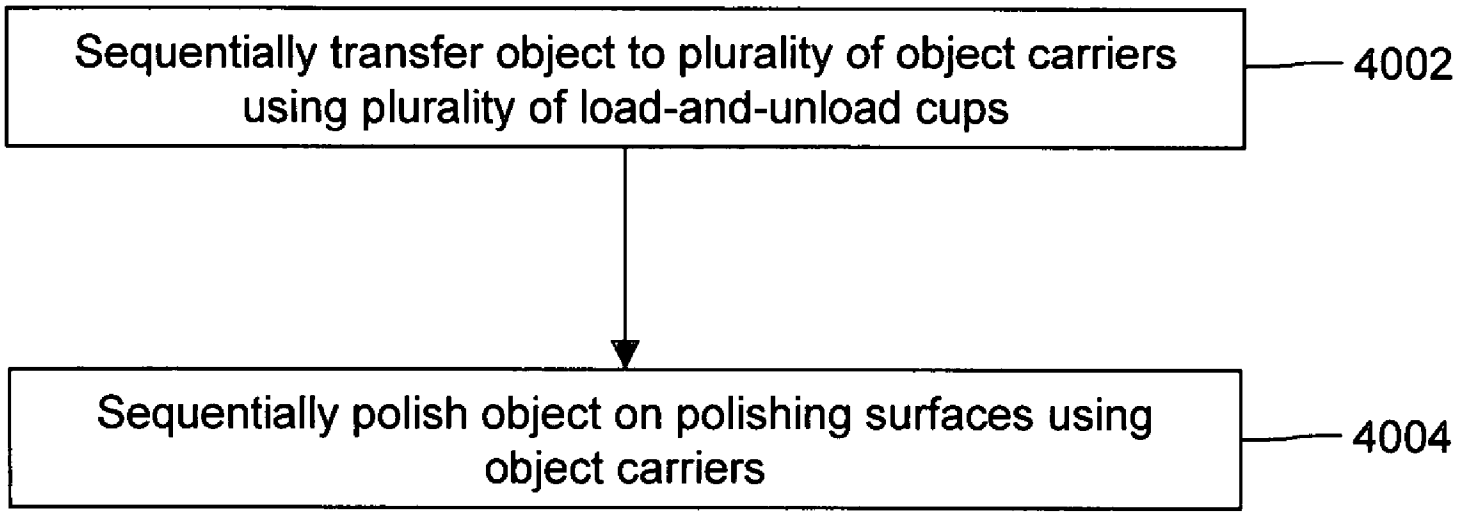
FIG. 40 is a flow diagram of a method for polishing objects in accordance with another embodiment of the invention.

A method for polishing objects in accordance with another embodiment of the invention is described with reference to a flow diagram of FIG. 40. At block 4002, an object is sequentially transferred to a plurality of object carriers positioned over a plurality of polishing surfaces using a plurality of load-and-unload cups. The sequentially transferring the object between object carriers includes pivoting each of the load-and-unload cups about a pivoting axis to transfer the object between two adjacent object carriers of the object carriers. Next, at block 4004, the object is sequentially polished on the polishing surfaces using the object carriers.

Figure 41:
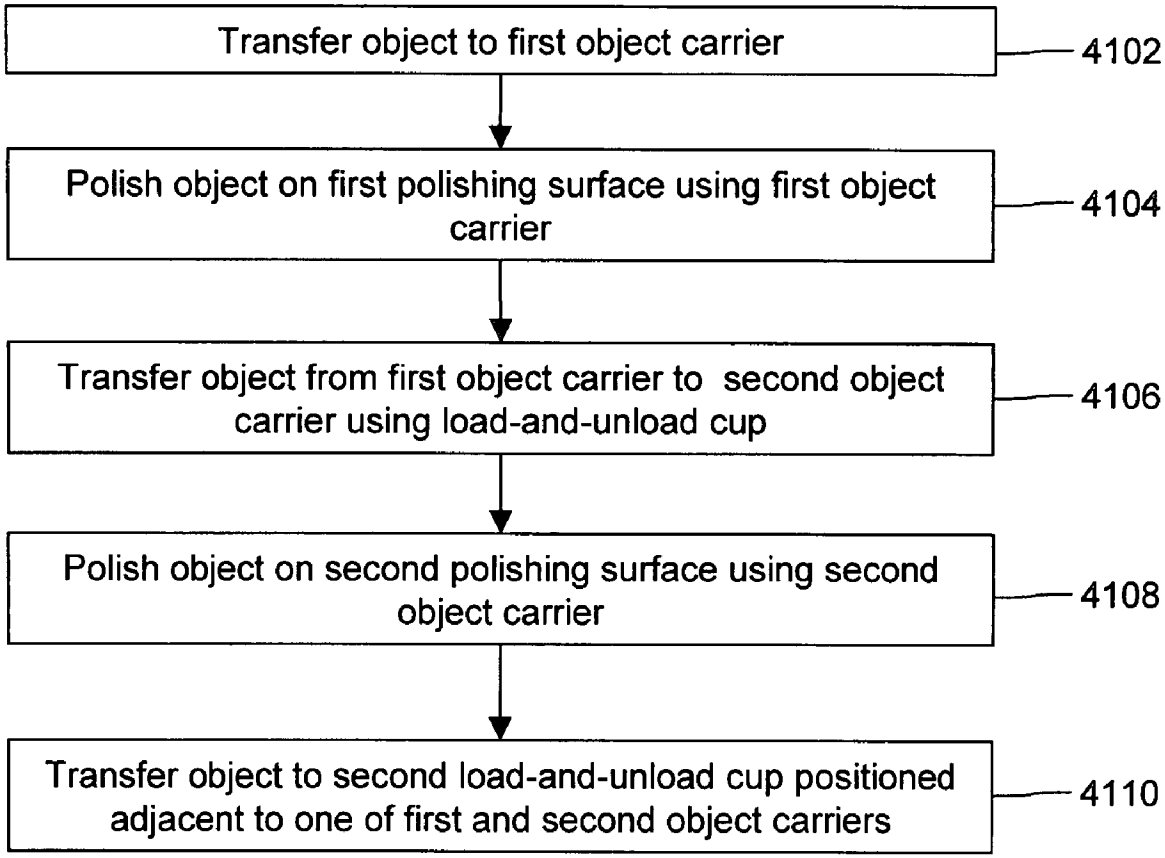
FIG. 41 is a flow diagram of a method for polishing objects in accordance with another embodiment of the invention.

A method for polishing objects in accordance with another embodiment of the invention is described with reference to a flow diagram of FIG. 41. At block 4102, an object is transferred to a first object carrier positioned over a first polishing surface. Next, at block 4104, the object is polished on the first polishing surface using the first object carrier. Next, at block 4106, the object is transferred from the first object carrier to a second object carrier positioned over a second polishing surface using a load-and-unload cup. The transferring of the object from the first object carrier includes linearly displacing the load-and-unload cup from the first object carrier to the second object carrier. Next, at block 4108, the object is polished on the second polishing surface using the second object carrier.

Figure 42:
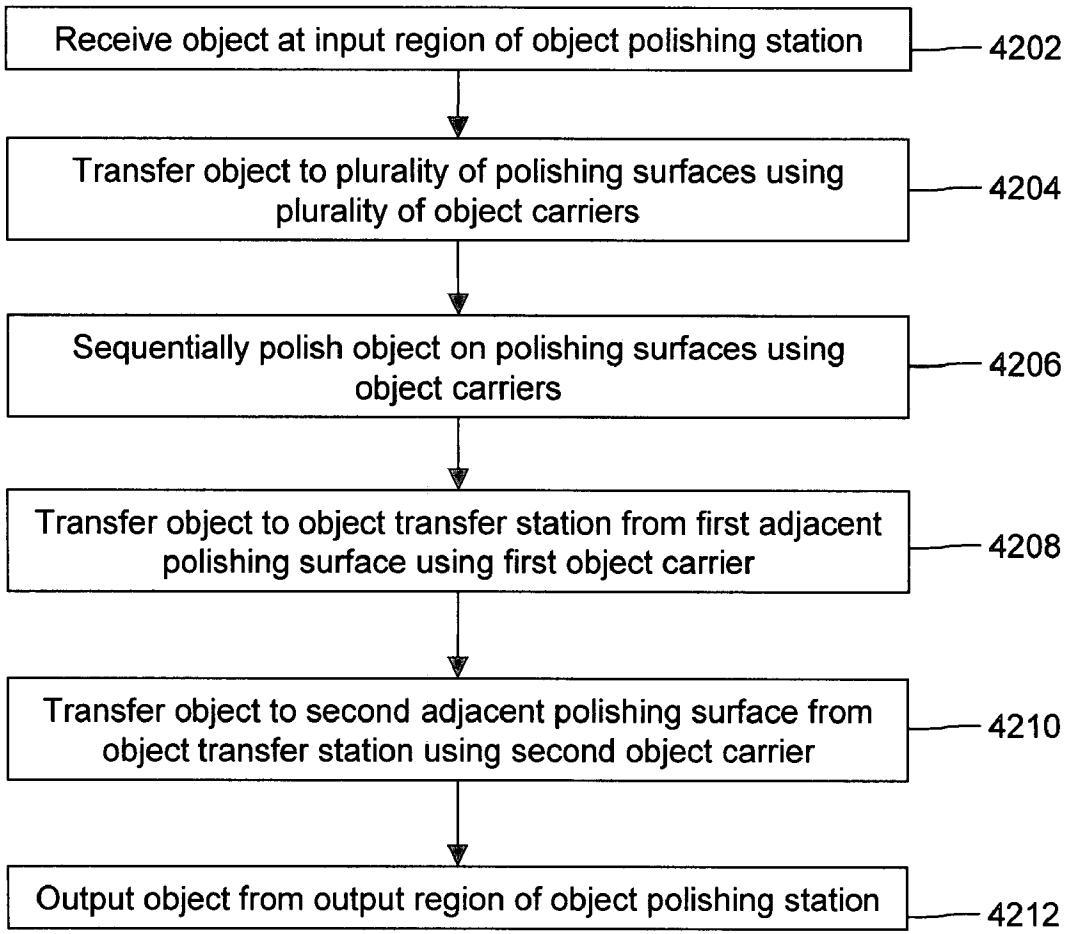
FIG. 42 is a flow diagram of a method for polishing objects in accordance with another embodiment of the invention.

A method for polishing objects in accordance with another embodiment of the invention is described with reference to a flow diagram of FIG. 42. At block 4202, an object is received at an input region of an object polishing station. Next, at block 4204, the object is sequentially transferred to a plurality of polishing surfaces of the object polishing station using a plurality of object carriers of the object polishing station. Next, at block 4206, the object is sequentially polished on the polishing surfaces using the object carriers. Next, at block 4208, the object is transferred to an object transfer station of the object polishing station from a first adjacent polishing surface of the polishing surfaces using a first object carrier of the object carriers. Next, at block 4210, the object is transferred from the object transfer station to a second adjacent polishing surface of the polishing surfaces using a second object carrier of the object carriers. Next, at block 4212, the object is output from an output region of the object polishing station after the object has been polished on the polishing surfaces.

Figure 43:
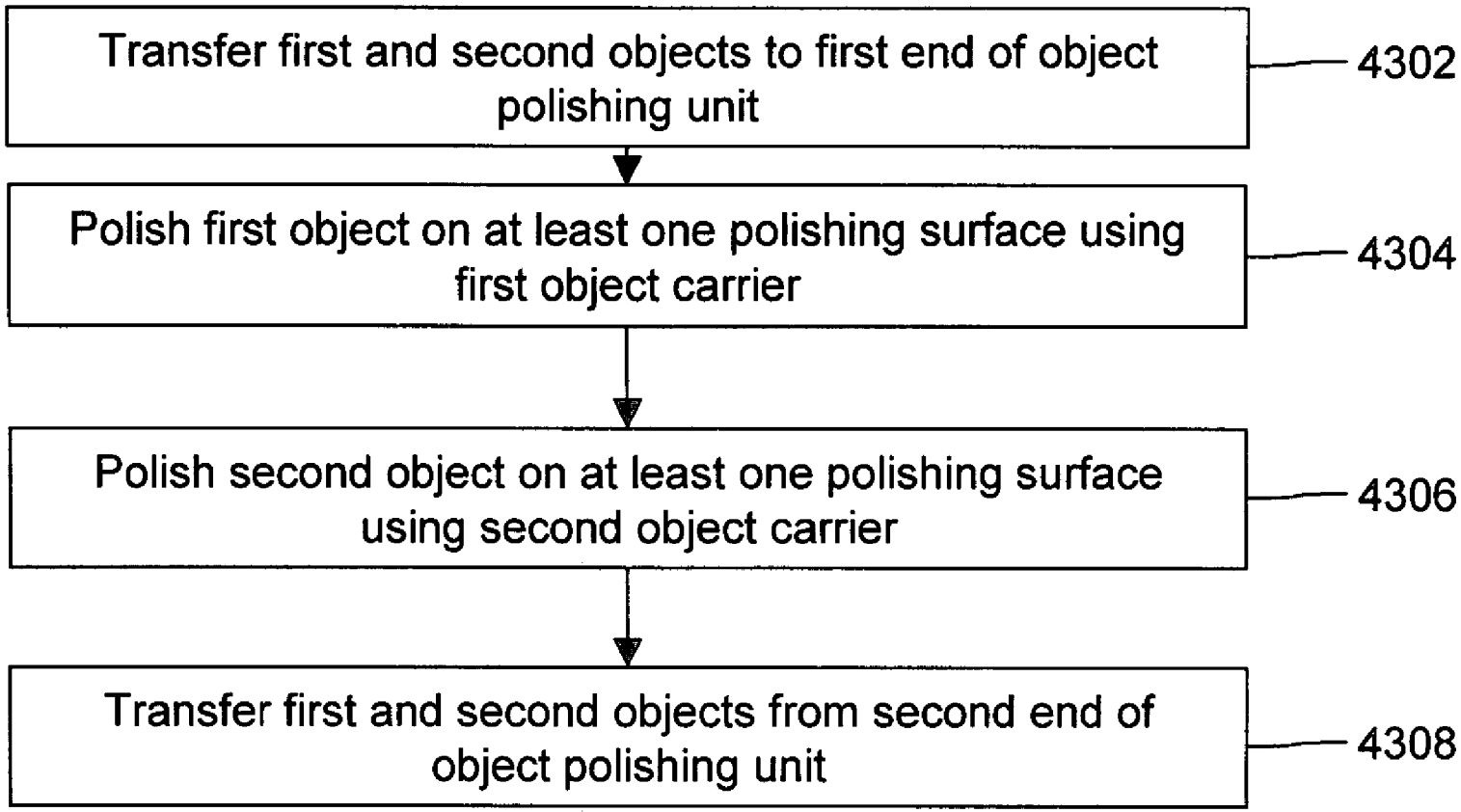
FIG. 43 is a flow diagram of a method for polishing objects in accordance with another embodiment of the invention.

A method for polishing objects in accordance with another embodiment of the invention is described with reference to a flow diagram of FIG. 43. At block 4302, first and second object are transferred to a first end of an object polishing unit using a first object transport device. Next, at block 4304, the first object is polished on at least one polishing surface of the object polishing unit using a first object carrier of the object polishing unit. Next, at block 4306, the second object is polished on at least one polishing surface using a second object carrier of the object polishing unit. Next, at block 4308, the first and second objects are transferred from a second end of the object polishing unit using a second object transport device. The first and second ends are located on opposite ends of the object polishing unit.

Although specific embodiments and examples of the invention have been illustrated and described, the invention is not to be limited to the specific forms or methods described and illustrated.

What is claimed is:

1. An apparatus for polishing objects, said apparatus comprising:

a first object carrier positioned over a first polishing surface;

a second object carrier positioned over a second polishing surface;

a first object relay device positioned between said first and second object carriers, said first object relay device including a first load-and-unload cup and a first pivoting drive mechanism, said first pivoting drive mechanism being configured to pivot said first load-and-unload cup to and from said first and second object carriers about a first pivoting axis to transfer said objects from said first object carrier to said second object carrier; and a second object relay device positioned adjacent to one of said first and second object carriers, said second object relay device including a second load-and-unload cup and a second pivoting drive mechanism, said second pivoting mechanism being configured to pivot said second load-and-unload cup to and from one of said first and second object carriers about a second pivoting axis to transfer said objects to said first object carrier or from said second object carrier.

2. The apparatus of claim 1 wherein said first and second object carriers are arranged in a first linear manner, and parking positions of said first and second load-and-unload cups of said first and second object relay devices are arranged in a second linear manner such that said first and second object carriers are positioned to be substantially parallel to said first and second load-and-unload cups positioned at said parking positions.

3. The apparatus of claim 2 wherein the distance between said first and second object carriers is substantially equivalent to the distance between said parking positions.

4. The apparatus of claim 1 further comprising an object cleaner configured to clean said objects, said object cleaner being positioned such that a longer side of said object cleaner is adjacent to a longer side of an area defined by said first and second polishing surfaces.

5. The apparatus of claim 1 further comprising a first object transport device to transfer said objects to said first object carrier or said second load-and-unload cup of said second object relay device, and a second object transport device to transfer said objects from said second object carrier or from said second load-and-unload cup.

6. The apparatus of claim 1 wherein said second object relay device is positioned adjacent to said first object carrier such that said first object carrier is positioned between said first and second object relay devices, and further comprising a third object relay device positioned adjacent to said second object carrier such that said second object carrier is positioned between said first object relay device and said third object relay device, said third object relay device including a third load-and-unload cup and a third pivoting drive mechanism, said third pivoting mechanism being configured to pivot said third load-and-unload cup to and from said second object carrier about a third pivoting axis to transfer said objects from said second object carrier.

7. An apparatus for polishing objects, said apparatus comprising:

a plurality of object carriers positioned over a plurality of polishing surfaces; and a plurality of object relay devices positioned between said object carriers such that at least one object relay device is positioned between two adjacent object carriers, each object relay device including a load-and-unload cup and a pivoting drive mechanism, said pivoting drive mechanism being configured to pivot said load-and-unload cup to and from said two adjacent object carriers about a pivoting axis to transfer said objects between said two adjacent object carriers.

8. The apparatus of claim 7 wherein said object carriers are arranged in a linear manner.

9. The apparatus of claim 8 wherein parking positions of load-and-unload cups of said object relay devices are further arranged in a linear manner such that said object carriers are positioned to be substantially parallel to said load-and-unload cups positioned at said parking positions.

10. The apparatus of claim 9 wherein the distance between adjacent object carriers of said object carriers is substantially equivalent to the distance between adjacent parking positions of said parking positions.

11. The apparatus of claim 7 wherein parking positions of load-and-unload cups of said object relay devices are arranged in a linear manner.

12. The apparatus of claim 7 further comprising a first object transport device to transfer said objects to a first end object carrier of said object carriers, and a second object transport device to transfer said objects from a second end object carrier of said object carriers.

13. The apparatus of claim 7 further comprising an additional object relay device positioned to transfer said objects to or from a first end object carrier of said object carriers, said additional object relay device including a load-and-unload cup and a pivoting drive mechanism.

14. The apparatus of claim 13 further comprising a first object transport device to transfer said objects to said load-and-unload cup of said additional object relay device, and a second object transport device to transfer said objects from a second end object carrier of said object carriers.

15. The apparatus of claim 13 further comprising a first object transport device to transfer said objects to a second end object carrier of said object carriers, and a second object transport device to transfer said objects from said load-and-unload cup of said additional object relay device.

16. The apparatus of claim 13 further comprising a second additional object relay device positioned to transfer said objects to a second end object carrier of said object carriers, said second additional object relay device including a load-and-unload cup and a pivoting drive mechanism.

17. The apparatus of claim 16 further comprising a first object transport device to transfer said objects to said load-and-unload cup of said additional object relay device, and a second object transport device to transfer said objects from said load-and-unload cup of said second additional object relay device.

18. The apparatus of claim 7 wherein said object carriers are arranged such that distances between adjacent object carriers are substantially equivalent.

19. The apparatus of claim 7 wherein parking positions of load-and-unload cups of said object relay devices are arranged such that distances between adjacent load-and-unload cups are substantially equivalent when said load-and-unload cups are positioned at said parking positions.

20. The apparatus of claim 7 further comprising an object cleaner configured to clean said objects, said object cleaner being positioned such that a longer side of said object cleaner is adjacent to a longer side of an area defined by said polishing surfaces.

* * * * *